US006379852B2

(12) United States Patent
Tsuchida et al.

(10) Patent No.: US 6,379,852 B2
(45) **Date of Patent: *Apr. 30, 2002**

(54) ELECTROPHOTOGRAPHIC LIGHT-RECEIVING MEMBER

(75) Inventors: Shinji Tsuchida, Kyotanabe; Hiroaki Niino, Nara; Satoshi Kojima, Kyotanabe, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/927,414

(22) Filed: Sep. 10, 1997

(30) Foreign Application Priority Data

Sep. 11, 1996 (JP) ..... 8-240409

(51) Int. Cl.[7] ..... G03G 5/08
(52) U.S. Cl. ..... 430/57.7
(58) Field of Search ..... 430/57, 56, 65, 430/66, 57.7, 57.4

(56) References Cited

U.S. PATENT DOCUMENTS

| | | | | |
|---|---|---|---|---|
| 4,265,991 A | | 5/1981 | Hirai et al. | 430/64 |
| 4,650,736 A | | 3/1987 | Saitoh et al. | 430/57 |
| 4,656,110 A | | 4/1987 | Yamazaki | 430/57 |
| 4,696,884 A | | 9/1987 | Saitoh et al. | 430/58 |
| 4,705,733 A | | 11/1987 | Saitoh et al. | 430/57 |
| 4,734,346 A | * | 3/1988 | Kumano et al. | 430/56 |
| 4,735,883 A | | 4/1988 | Honda et al. | 430/69 |
| 4,886,723 A | | 12/1989 | Aoike et al. | 430/65 |
| 5,382,487 A | | 1/1995 | Fukuda et al. | 430/57 |
| 5,397,737 A | * | 3/1995 | Mahan et al. | 437/101 |
| 5,421,909 A | * | 6/1995 | Ishikawa et al. | 136/256 |
| 5,480,750 A | | 1/1996 | Kawada et al. | 430/31 |
| 5,738,963 A | * | 4/1998 | Niino | 430/57 |
| 5,945,241 A | * | 8/1999 | Niino et al. | 430/57 |

FOREIGN PATENT DOCUMENTS

| | | |
|---|---|---|
| DE | 3616608 | 11/1986 |
| EP | 0454456 | 10/1991 |
| EP | 0679955 | 11/1995 |
| EP | 0764887 | 3/1997 |
| JP | 57-115556 | 7/1982 |
| JP | 58-021257 | 2/1983 |
| JP | 58-088115 | 5/1983 |

(List continued on next page.)

*Primary Examiner*—Christopher Rodee
(74) *Attorney, Agent, or Firm*—Fitzpatrick, Cella, Harper & Scinto

(57) ABSTRACT

An electrophotographic light-receiving member comprising a conductive support and provided thereon a photoconductive layer formed of a non-single-crystal material mainly composed of silicon atom and containing hydrogen atom and an element belonging to Group IIIb of the periodic table; wherein the photoconductive layer has hydrogen atom content, an optical band gap and a characteristic energy obtained from the exponential tail of light absorption spectra, all in specific ranges, and has on the surface side thereof a second layer region that absorbs a prescribed amount of light incident on the photoconductive layer and on the support side thereof the other first layer region; the element belonging to Group IIIb of the periodic table being contained in the second layer region in an amount made smaller than that in the first layer region. This can provide an electrophotographic light-receiving member that has achieved all the improvement in chargeability, the improvement in temperature characteristics thereof and the decrease in photomemory, and has been dramatically improved in image quality, and can provide an electrophotographic light-receiving member improved in temperature characteristics of sensitivity and linearity of sensitivity especially in the case where semiconductor lasers or LEDs are used.

10 Claims, 10 Drawing Sheets

FOREIGN PATENT DOCUMENTS

| | | |
|---|---|---|
| JP | 58-121042 | 7/1983 |
| JP | 59-143379 | 8/1984 |
| JP | 60-067951 | 4/1985 |
| JP | 60-095551 | 5/1985 |
| JP | 60-168156 | 8/1985 |
| JP | 60-178457 | 9/1985 |
| JP | 60-225854 | 11/1985 |
| JP | 61-201481 | 9/1986 |
| JP | 61-231561 | 10/1986 |
| JP | 62-083470 | 4/1987 |
| JP | 62-112166 | 5/1987 |
| JP | 62-168161 | 7/1987 |

* cited by examiner

ELECTROPHOTOGRAPHIC LIGHT-RECEIVING MEMBER

BACKGROUND OF THE INVENTION

1. Field of the Invention

This invention relates to an electrophotographic light-receiving member having a sensitivity to electromagnetic waves such as light (which herein refers to light in a broad sense and indicates ultraviolet rays, visible rays, infrared rays, X-rays, γ-rays, etc.).

2. Related Background Art

In the field of image formation, photoconductive materials that form light-receiving layers of light-receiving members are required to have properties as follows: They are highly sensitive, have a high SN ratio [light current (Ip)/dark current (Id)], have absorption spectra suited to spectral characteristics of electromagnetic waves to be radiated, have a high response to light, have the desired dark resistance and are harmless to human bodies when used. In particular, in the case of light-receiving members set in electrophotographic apparatus used as business machines in offices, the safety in their use is important.

Photoconductive materials having good properties in these respects include amorphous silicon hydrides. For example, U.S. Pat. No. 4,265,991 discloses its application in electrophotographic light-receiving members.

In the production of such light-receiving members, it is common to form photoconductive layers comprised of amorphous silicon, by film forming processes such as vacuum deposition, sputtering, ion plating, heat-assisted CVD, light-assisted CVD and plasma-assisted CVD, which layers are formed on conductive supports while heating the supports at 50° C. to 350° C. In particular, their production by plasma-assisted CVD is preferable and has been put into practical use. This plasma-assisted CVD is a process in which material gases are decomposed by high-frequency or microwave glow discharging to form amorphous silicon deposited films on the conductive support.

U.S. Pat. No. 5,382,487 discloses an electrophotographic light-receiving member having a photoconductive layer formed of amorphous silicon containing halogen atom. This publication reports that incorporation of 1 to 40 atom % of halogen atoms into amorphous silicon enables achievement of a high thermal resistance, and also electrical and optical properties preferable for a photoconductive layer of an electrophotographic light-receiving member.

Japanese Patent Application Laid-open No. 57-115556 discloses a technique in which a surface barrier layer formed of a non-photoconductive amorphous material containing silicon atoms and carbon atoms is provided on a photoconductive layer formed of an amorphous material mainly composed of silicon atoms, in order to achieve improvements in electrical, optical and photoconductive properties such as dark resistance, photosensitivity and response to light and service environmental properties such as moisture resistance and also in stability with time. Japanese Patent Application Laid-open No. 60-67951 also discloses a technique concerning a photosensitive member superposingly provided with a light-transmitting insulating overcoat layer containing amorphous silicon, carbon, oxygen and fluorine. Japanese Patent Application Laid-open No. 62-168161 discloses a technique in which an amorphous material containing silicon atoms, carbon atoms and 41 to 70 atom % of hydrogen atoms as constituents is used to form a surface layer.

Japanese Patent Application Laid-open No. 58-21257 discloses a technique in which support temperature is changed in the course of the formation of a photoconductive layer and inhibition bandwidth is changed in the photoconductive layer to thereby obtain a photosensitive member having a high resistance and a broad photosensitive region. Japanese Patent Application Laid-open No. 58-121042 discloses a technique in which energy gap state density is changed in the direction of layer thickness of a photoconductive layer and the energy gap state density of a surface layer is controlled to be $10^{17}$ to $10^{19}$ $cm^{-3}$ to thereby prevent surface potential from being reduced because of humidity. Japanese Patent Application Laid-open No. 59-143379 and No. 61-201481 disclose a technique in which amorphous silicon hydrides having different hydrogen contents are superposingly formed to obtain a photosensitive member having a high dark resistance and a high sensitivity.

Japanese Patent Application Laid-open No. 58-88115 discloses that, aiming at an improvement in image quality of an amorphous silicon photosensitive member, atoms of Group III of the Periodic Table are incorporated in a large quantity on the support side of a photoconductive layer. Japanese Patent Application Laid-open No. 62-83470 discloses a technique in which characteristic energy of an exponential tail of light absorption spectra is controlled to be not more than 0.09 eV in a photoconductive layer of an electrophotographic photosensitive member to thereby obtain high-quality images free of after-image development. Japanese Patent Application Laid-open No. 62-112166 also discloses a technique in which flow rate ratio of $B_2H_6/SiH_4$ is maintained at $3.3\times10^{-7}$ or above to form a carrier transport layer to thereby make free of after-image development.

Further, Japanese Patent Application Laid-open No. 60-95551 discloses a technique in which, aiming at an improvement in image quality of an amorphous silicon photosensitive member, image forming steps of charging, exposure, development and transfer are carried out while maintaining temperature at 30 to 40° C. in the vicinity of the surface of the photosensitive member to thereby prevent the surface of the photosensitive member from undergoing a decrease in surface resistance which is due to water absorption on that surface and also prevent smeared images from occurring concurrently therewith.

These techniques have achieved improvements in electrical, optical and photoconductive properties and service environmental properties of electrophotographic light-receiving members, and also have concurrently brought about an improvement in image quality.

The electrophotographic light-receiving members having a photoconductive layer comprised of an amorphous silicon material have individually achieved improvements in properties in respect of electrical, optical and photoconductive properties such as dark resistance, photosensitivity and response to light and service environmental properties and also in respect of stability with time, and running performance (durability). However, improvements are still unsatisfactory from an overall viewpoint, and there is room for further improvements to make overall properties better.

In particular, there has been rapid progress in making electrophotographic apparatus have higher image quality, higher speed and higher running performance, and the electrophotographic light-receiving members are required to be more improved in electrical properties and photoconductive properties and also to greatly improve their performances in every environment while maintaining chargeability and sensitivity. Then, as a result of improvements made on optical exposure devices, developing devices, transfer devices and so forth in order to improve image characteristics of electrophotographic apparatus, the electrophotographic light-receiving members are now also required to be more improved in image characteristics than ever before.

Under such circumstances, although the conventional techniques as noted above have made it possible to improve properties to a certain degree in respect of the subjects stated above, they still can not be said to be satisfactory in regard to the improvements in chargeability, sensitivity, response to light, and image quality. In particular, as the subjects for making amorphous silicon light-receiving members have much higher image quality, it has now been also sought to prevent variations of electrophotographic performances (e.g., chargeability and sensitivity) due to changes in surrounding temperature (i.e., improve service environmental properties) and to make photomemory such as blank memory and ghost occur less (i.e., improve photoconductive characteristics such as response to light).

For example, in order to prevent smeared images caused by amorphous silicon photosensitive members, a drum heater is provided inside a copying machine to keep the surface temperature of the photosensitive member at about 40° C., as disclosed in Japanese Patent Application Laid-open No. 60-95551. In conventional photosensitive members, however, the dependence of chargeability on temperature, which is ascribable to formation of pre-exposure carriers or heat-energized carriers is so great that, in an actual service environment inside the copying machine, photosensitive members could not avoid being used in the condition wherein they have a lower chargeability than that originally possessed by the photosensitive members. For example, chargeability may drop by nearly 100 V in the state where the photosensitive members are heated to about 40° C., compared with use at room temperature.

In the past, in the period (e.g., at night) when copying machines were not used, the drum heater was maintained under power so as to prevent the smeared images that are caused when ozone products formed by corona discharging of a charging assembly are adsorbed on the surface of a photosensitive member. Nowadays, however, it has become popular not to power the apparatus as far as possible when not in use e.g., at night, for the purpose of saving electric power. When copies are continuously taken without electrifying the drum heater, the surrounding temperature of the photosensitive member rises as a result of charging and so forth to make chargeability lower with a rise of temperature, causing a phenomenon that image density changes during copying.

When the same original is continuously and repeatedly copied, an after-image due to imagewise exposure in they previous copying step (called "ghost") may also occur on the image in the subsequent copying, or a density difference on copied images (called "blank memory") may occur because of the influence of blank exposure which is irradiation made on the photosensitive member at the paper feed intervals during the continuous copying in order to save toner. Such phenomena have been investigated to improve image quality.

Meanwhile, in recent years, computers have come into wide use in offices and ordinary homes, and electrophotographic apparatus are not only used as conventional copying machines but also are now sought to be made digital so that they can play a role as facsimile machines or printers. Semiconductor lasers and LEDs used as exposure light sources for digitizing image data are chiefly those having relatively long wavelengths ranging from near infrared light to red visible light in view of light emission intensity and cost. Hence, it has become desirable to solve problems on characteristics which have been not seen in conventional analog machines employing halogen light.

In particular, the fact that the relationship between the exposure value and the surface potential of photosensitive members, i.e., what is called E-V characteristics (E-V curves) may shift depending on temperature (i.e., temperature characteristics of sensitivity) and the fact that the linearity of the E-V characteristics (E-V curves) (i.e., linearity of sensitivity) may lower have now attracted notice as characteristic features in the case where semiconductor lasers or LEDs are used. More specifically, digital machines making use of semiconductor lasers or LEDs as exposure light sources have caused an additional problem that, when the photosensitive member temperature is not controlled by the drum heater mentioned above, the surrounding temperatures may cause a change in sensitivity because of a lowering of the linearity of sensitivity or the temperature characteristics of sensitivity, resulting in a change in image density.

Accordingly, in designing electrophotographic light-receiving members, it is required to achieve improvements from the overall viewpoints of layer configuration and chemical composition of each layer of the light-receiving members so that the problems as discussed above can be solved, and also to achieve a much more improvement in properties of the amorphous silicon materials themselves.

SUMMARY OF THE INVENTION

Accordingly, an object of the present invention is to solve the various problems caused in conventional electrophotographic light-receiving members having the light-receiving layer formed of amorphous silicon materials as stated above.

That is, an object of the present invention is to provide an electrophotographic light-receiving member that has superior electrical, optical and photoconductive properties, and is substantially always stable (having superior service environmental properties) almost without dependence of these properties on service environment, promising a superior image quality; in particular, to provide an electrophotographic light-receiving member that has achieved all the improvement in chargeability, the improvement in temperature characteristics thereof and the decrease in photomemory, and has been dramatically improved in image quality.

Another object of the present invention is to provide an electrophotographic light-receiving member that has been improved in the temperature characteristics of sensitivity and the linearity of sensitivity especially in the case where semiconductor lasers or LEDs are used as exposure light sources, and has been dramatically improved in image quality.

A still another object of the present invention is to provide an electrophotographic light-receiving member having a superior running performance, which may cause neither exposure fatigue nor any deterioration in repeated use.

To achieve the above objects, the present invention provides an electrophotographic light-receiving member comprising a conductive support and provided thereon a photoconductive layer formed of a non-single-crystal material mainly composed of silicon atom and containing at least one of hydrogen atom and halogen atom and at least one element belonging to Group IIIb of the periodic table; wherein the photoconductive layer has at least one of the hydrogen atom and the halogen atom in a content of from 10 atom % to 30 atom %, an optical band gap of from 1.75 eV to 1.85 eV and a characteristic energy obtained from the exponential tail of light absorption spectra, of from 55 meV to 65 meV, and has on the surface side thereof a second layer region that absorbs a prescribed amount of light incident on the photoconductive layer and on the support side thereof the other first layer region; the element belonging to Group IIIb of the periodic table being contained in the second layer region in an amount made smaller than that in the first layer region.

The present invention also provides an electrophotographic light-receiving member comprising a conductive support and provided thereon a photoconductive layer formed of a non-single-crystal material mainly composed of silicon atom and containing at least one of hydrogen atom and halogen atom and at least one element belonging to Group IIIb of the periodic table; wherein the photoconductive layer has at least one of the hydrogen atom and the halogen atom in a content of from 10 atom % to 20 atom %, an optical band gap of 1.75 eV or below and a characteristic energy obtained from the exponential tail of light absorption spectra, of 55 meV or below, and has on the surface side thereof a second layer region that absorbs a prescribed amount of light incident on the photoconductive layer and on the support side thereof the other first layer region; the element belonging to Group IIIb of the periodic table being contained in the second layer region in an amount made smaller than that in the first layer region.

The present invention still also provides an electrophotographic light-receiving member comprising a conductive support and provided thereon a photoconductive layer formed of a non-single-crystal material mainly composed of silicon atom and containing at least one of hydrogen atom and halogen atom and at least one element belonging to Group IIIb of the periodic table; wherein the photoconductive layer has at least one of the hydrogen atom and the halogen atom in a content of from 25 atom % to 35 atom %, an optical band gap of 1.80 eV or above and a characteristic energy obtained from the exponential tail of light absorption spectra, of 55 meV or below, and has on the surface side thereof a second layer region that absorbs a prescribed amount of light incident on the photoconductive layer and on the support side thereof the other first layer region; the element belonging to Group IIIb of the periodic table being contained in the second layer region in an amount made smaller than that in the first layer region.

The present invention further provides an electrophotographic light-receiving member comprising a conductive support and provided thereon a photoconductive layer formed of a non-single-crystal material mainly composed of silicon atom and containing at least one of hydrogen atom and halogen atom and at least one element belonging to Group IIIb of the periodic table; wherein the photoconductive layer has on the support side thereof a first layer region having at least one of the hydrogen atom and the halogen atom in a content of from 20 atom % to 30 atom %, an optical band gap of from 1.75 eV to 1.85 eV and a characteristic energy obtained from the exponential tail of light absorption spectra, of from 55 meV to 65 meV, and on the surface side thereof a second layer region having at least one of the hydrogen atom and the halogen atom in a content of from 10 atom % to 25 atom %, an optical band gap of from 1.70 eV to 1.80 eV and a characteristic energy obtained from the exponential tail of light absorption spectra, of 55 meV or below; the optical band gap in the second layer region being made smaller than that in the first layer region, and the element belonging to Group IIIb of the periodic table being contained in the second layer region in an amount made smaller than that in the first layer region.

The present invention still further provides an electrophotographic light-receiving member comprising a conductive support and provided thereon a photoconductive layer formed of a non-single-crystal material mainly composed of silicon atom and containing at least one of hydrogen atom and halogen atom and at least one element belonging to Group IIIb of the periodic table; wherein the photoconductive layer has on the support side thereof a first layer region having at least one of the hydrogen atom and the halogen atom in a content of from 25 atom % to 40 atom %, an optical band gap of from 1.80 eV to 1.90 eV and a characteristic energy obtained from the exponential tail of light absorption spectra, of 55 meV or below, and on the surface side thereof a second layer region having at least one of the hydrogen atom and the halogen atom in a content of from 10 atom % to 25 atom %, an optical band gap of from 1.70 eV to 1.80 eV and a characteristic energy obtained from the exponential tail of a light absorption spectrum, of 55 meV or below; the optical band gap in the second layer region being made smaller than that in the first layer region, and the element belonging to Group IIIb of the periodic table being contained in the second layer region in an amount made smaller than that in the first layer region.

DESCRIPTION OF THE PREFERRED EMBODIMENTS

To solve the problems discussed above, the present inventors have took note of the behavior of carriers in the photoconductive layer, and have made extensive studies on the relationship between the localized-state density distribution of amorphous silicon materials (hereinafter often "a-Si") in band gaps and the temperature characteristics or photomemory. As the result, they have reached a finding that the above objects can be achieved by controlling, in the thickness direction of the photoconductive layer, the hydrogen content, the optical band gaps and the localized-state density distribution in band gaps.

More specifically, they have discovered that, in a light-receiving member having a photoconductive layer formed of a non-single-crystal material mainly composed of silicon atom and containing at least one of hydrogen atom and halogen atom, a light-receiving member whose layer configuration has been specified not only exhibits very good performances in practical use but also is superior in every point compared with conventional light-receiving members, and has superior performances especially as an electrophotographic light-receiving member.

The present inventors have also discovered that, in order to make the light-receiving member most suitable for long-wavelength light (of lasers or LEDs) adapted to digitization, the temperature characteristics of sensitivity and linearity of sensitivity can be improved and the chargeability and photomemory can also be improved/prevented by controlling the content of hydrogen atoms and/or halogen atoms, the optical band gap, the characteristic energy obtained from the exponential tail of light absorption spectra and the distribution of the periodic table Group IIIb element as a conductivity-controlling substance while correlating them with each other and while taking account of the roles of light-incident portion and the other portions especially at light-incident regions (layer regions) concerned with photoelectric conversion.

The above "exponential tail" in the present invention refers to an absorption spectrum taken by removing a low-energy side tail region from a light absorption spectrum, and the "characteristic energy" is concerned with the slope of this exponential tail. These will be more detailed with reference to FIG. 1.

Figure 1:
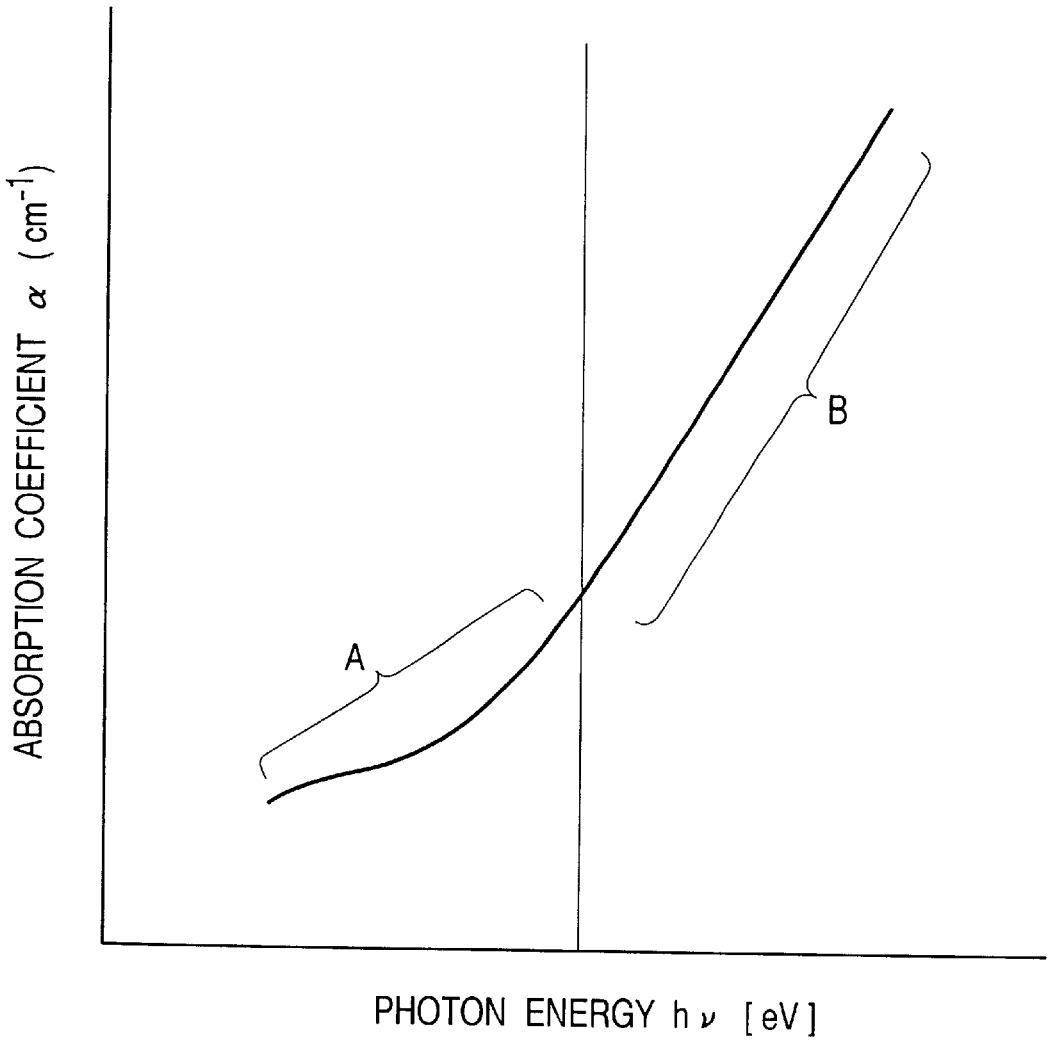
FIG. 1 is a graph showing an example of sub-band gap light absorption spectrum of amorphous silicon, to explain the characteristic energy at exponential tail.

FIG. 1 shows an example of a sub-band gap light absorption spectrum of a-Si in an instance where the photon energy hν is plotted as abscissa and the absorption coefficient α as ordinate. This spectrum can be roughly separated into two regions. That is, they are a region B where the absorption coefficient a changes exponentially with respect to the photon energy hν, i.e., it changes linearly in FIG. 1 (the region called "exponential tail" or "Urbach tail"), and a region A where the absorption coefficient α shows milder dependence on the photon energy hν.

The region B corresponds to light absorption caused by optical transition from the tail level on the side of valency band to the conduction band in a-Si, and the exponential dependence of the absorption coefficient α on the photon energy hν is represented by the following expression.

$$\alpha=\alpha_0 \exp(h\nu/Eu)$$

Taking a logarithm of both sides of this expression gives:

$$\ln \alpha=(1/Eu)\cdot h\nu=\alpha_1$$

where $\alpha_1$ is $\ln\alpha_0$ (a constant).

Thus, the reciprocal (1/Eu) of the characteristic energy Eu indicates the slope of the region B. The Eu corresponds to the characteristic energy of exponential energy distribution of the tail level on the side of valency band. Hence, a smaller Eu indicates less tail level on the side of valency band and a smaller rate of capture of carriers to localized levels.

The temperature characteristics of sensitivity and linearity of sensitivity in the present invention will be described below with reference to FIG. 2.

Figure 2:
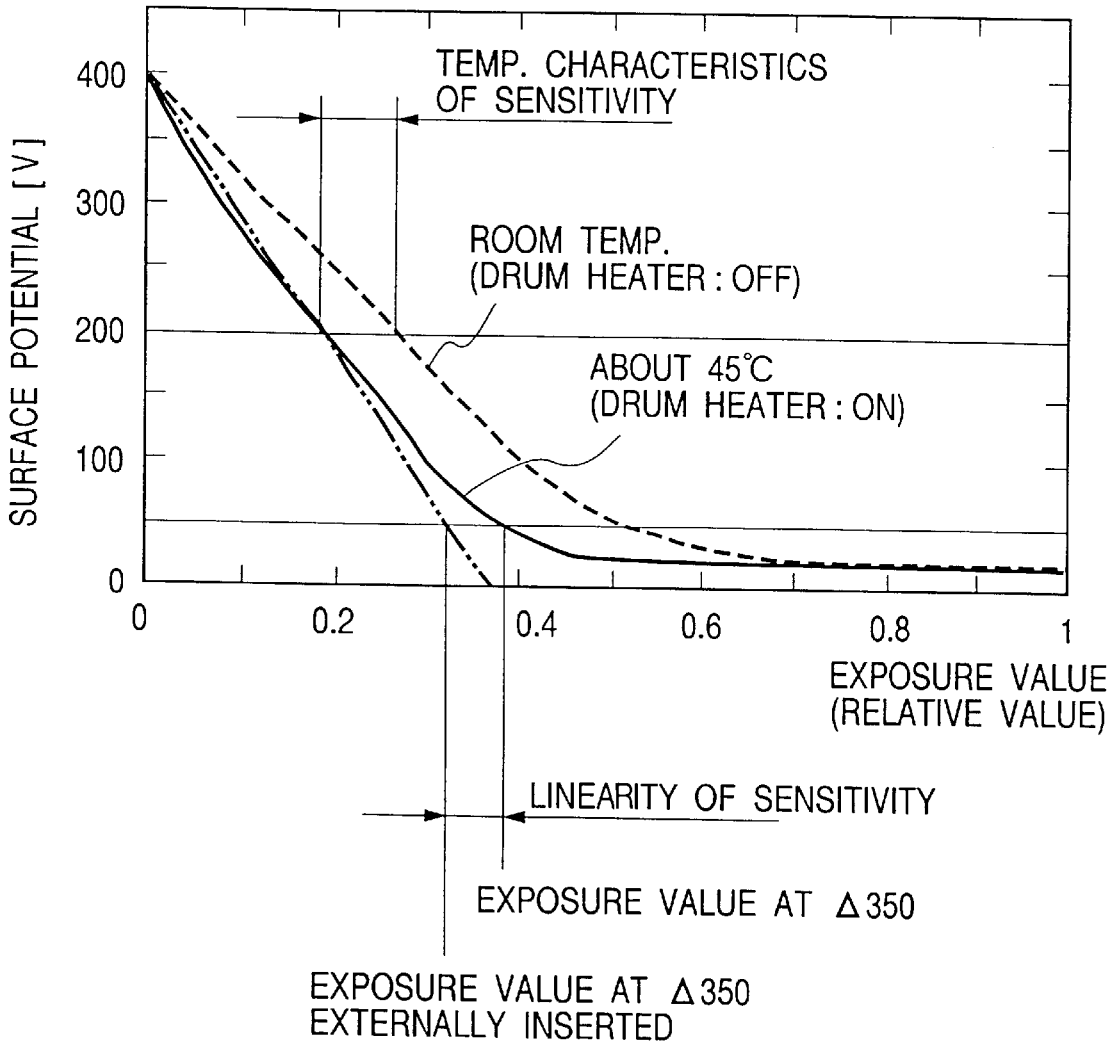
FIG. 2 is a graph showing an example of the exposure value/surface potential curve of an amorphous silicon photosensitive member, to explain the temperature characteristics of sensitivity and the linearity of sensitivity.

FIG. 2 is a graph showing an example of what is called E-V characteristics (E-V curves), showing changes in surface potential (light potential) which are caused when a photosensitive member is charged to have a surface potential of 400 V as its dark potential and then the exposure value is changed under irradiation with light of 680 nm from an LED as an exposure light source, at room temperature (drum heater: OFF) and about 45° C. (drum heater: ON) each. The exposure value is indicated as a relative value given when the exposure value in which the surface potential reaches a lower limit is regarded as 1.

The temperature characteristics of sensitivity correspond to a difference between the value at room temperature and the value at about 45° C., of the exposure value at the time when the difference between dark potential and light potential comes to be 200 V (Δ200) (i.e., half-value exposure value).

The linearity of sensitivity corresponds to a difference between the exposure value (founded value) at room temperature at the time when the difference between dark potential and light potential becomes 350V (Δ350) and the exposure value (calculated value) at the time when the straight line connecting dot of no exposure (dark state) and dot of state of half-life exposure value irradiation is externally inserted to become Δ350.

In both the temperature characteristics of sensitivity and the linearity of sensitivity, the smaller their values are, the better performances the photosensitive member exhibits.

The present inventors have investigated the correlation between i) the optical band gap (hereinafter "Eg") and the characteristic energy at exponential tail (hereinafter Eu") and ii) the photosensitive member performances under various conditions. As a result, they have discovered that the Eg and Eu closely correlate with the chargeability, temperature characteristics and photomemory of a-Si photosensitive members. They have also investigated in detail the regions where incident light is absorbed and the content and distribution of the periodic table Group IIIb element as a conductivity-controlling substance. As a result, they have also discovered that good photosensitive member performances can be exhibited by controlling the content and distribution of the periodic table Group IIIb element to bring it into such a state of distribution that the periodic table Group IIIb element in a region on the light-incident side is in a smaller content than that in the other region(s). Thus, they have accomplished the present invention.

Especially in order to make the light-receiving member most suitable for the long-wavelength laser light, they have investigated in detail i) the balance of holes-electrons mobility at light-incident regions in accordance with the content and distribution of the conductivity-controlling substance, ii) the Eg and Eu and iii) the photosensitive member performances in the case where laser light sources are used. As a result, they have still also discovered that the content and distribution of the conductivity-controlling substance and the Eg and Eu closely correlate with the temperature characteristics of sensitivity and linearity of sensitivity, and further discovered that photosensitive member performances suited for digitization can be exhibited by controlling the Eg and Eu and hydrogen content in the light-incident regions within specific ranges, and also controlling the flow rate ratio of the periodic table Group IIIb element to silicon atoms to bring it into such a state of distribution that the region on the light-incident side has the periodic table Group IIIb element in a smaller content.

More specifically, experiments made by the present inventors have revealed that, in the formation of a photoconductive layer having specified the hydrogen atom content, the optical band gap and the rate of capture of carriers to localized levels, the flow rate ratio of the periodic table Group IIIb element to silicon atoms may be controlled in accordance with the absorption depth at the light-incident regions to bring it into such a state of distribution that the region on the light-incident side has the periodic table Group IIIb element in a smaller content, whereby the temperature characteristics of sensitivity and the linearity of sensitivity can be greatly improved, the chargeability can also be improved, and the photomemory can be made substantially free from occurring.

The foregoing can be explained in greater detail as follows: In band gaps of amorphous silicon containing hydrogen atoms (hereinafter "a-Si:H"), there are commonly a tail (bottom) level ascribable to a structural disorder of Si-Si bonds and a deep level ascribable to structural imperfections of Si unbonded arms (dangling bonds) or the like. These levels are known to act as capture and recombination centers of electrons and holes to cause a lowering of properties of devices.

The state of such localized levels in band gaps is commonly measured by deep-level spectroscopy, isothermal volume-excess spectroscopy, photothermal polarization spectroscopy, photoacoustic spectroscopy, or the constant photocurrent method. In particular, the constant photocurrent method (hereinafter "CPM") is useful as a method for simply measuring sub-band gap light absorption spectra on the basis of the localized levels of a-Si:H.

As the cause of a lowering of chargeability which occurs when the photosensitive member is heated by a drum heater or the like (i.e., the temperature dependence of chargeability), it is considered as follows: Carriers thermally excited are pulled by electric fields formed at the time of charging to move toward the surface while repeating their capture to and release from the localized levels of band tails and deep localized levels in band gaps, and consequently cancel surface charges. Here, the carriers reaching the surface while they pass through a charging assembly (i.e., during the charging) little affect the lowering of chargeability, but the carriers captured in the deep levels reach the surface after they have passed through the charging assembly (i.e., after the charging), to cancel the surface charges to cause a lowering of chargeability, and hence this is observed as a lowering of temperature characteristics (of chargeability). The carriers thermally excited after they have passed through the charging assembly also cancel the surface charges to cause a lowering of chargeability. Accordingly, in order to improve the temperature characteristics, it is necessary to make the optical band gap larger to thereby prohibit the thermally excited carriers from being produced, and also to lessen the deep localized levels to thereby improve the mobility of carriers so as to be balanced.

As for the photomemory, it also occurs when the photocarriers produced by blank exposure or imagewise exposure are captured in the localized levels in band gaps and the carriers remain in the photoconductive layer. More specifically, among photo-carriers produced in a certain process of copying, the carriers having remained in the photoconductive layer are swept out by the electric fields formed by surface charges, at the time of subsequent charging or thereafter, and the potential at the portions exposed to light become lower than other portions, so that a density difference occurs on images. Accordingly, the mobility of carriers must be improved so that they can move through the photoconductive layer at one process of copying without allowing the photo-carriers to remain in the layer as far as possible.

The temperature characteristics of sensitivity are caused by a great difference in mobility between holes and electrons in the photoconductive layer, where the electrons move more quickly than the holes, and also by a change in mobility depending on temperature. Inside the light-incident regions, holes and electrons are produced in pair and, in the case of a positively charged photosensitive drum, the holes move to the support side and the electrons to the surface layer side. However, when the holes and the electrons are mixedly present in the light-incident regions in the course of their movement, they may recombine in a greater proportion before they reach the support or surface. The proportion of such recombination may change as a result of thermal excitation from the re-capture centers, so that the exposure value, i.e., the number of carriers photo-produced and the number of carriers cancelling the surface potential may change depending on temperature, and consequently the sensitivity may change depending on temperature. Accordingly, the proportion of recombination at the light-incident regions must be made smaller, i.e., the deep levels serving as the re-capture centers must be lessened, and, in order to make smaller the regions where the holes and electrons are mixedly present, the light absorptance of long-wavelength light must be made greater and the mobility of carriers must be improved so as to be balanced.

The linearity of sensitivity is ascribable to the fact that carriers photo-produced at places relatively deep from the surface increase and carriers moving over a longer distance (i.e., electrons) increase with an increase in the exposure value by a long-wavelength laser. Accordingly, the mobility of electrons and mobility of holes at the light-incident regions must be improved so as to be balanced, by increasing light absorptance at the light-incident regions and also changing the content and distribution of the conductivity-controlling substance.

More specifically, making the hydrogen content smaller to make the Eg narrower brings about more formation of thermally excited carriers than making the Eg broader, but can make the absorption of long-wavelength light greater to make the light-incident regions smaller, and hence the region where the holes and electrons are mixedly present can be made smaller. Also, making the Eu lower brings about a decrease in the proportion of thermally excited carriers or photo-carriers captured to localized levels, so that the mobility of carriers is dramatically improved. On the other hand, making the hydrogen content larger to make the Eg broader brings about a smaller absorption of long-wavelength light than making the Eg narrower, to therefore make the light-incident regions larger than making the Eg narrower, resulting in a relatively wide region where the holes and electrons are mixedly present. However, the Eg made broader prohibits formation of the thermally excited carriers and also the Eu made lower can bring about a decrease in the proportion of thermally excited carriers or photo-carriers captured to localized levels, so that the mobility of carriers is dramatically improved. Moreover, controlling the content and distribution of the conductivity-controlling substance makes the foregoing more effective, so that the balance of mobility of holes and electrons in the whole photoconductive layer can be improved.

Thus, as described above, the hydrogen content, Eg and Eu are controlled while being balanced and the the content of the periodic table Group IIIb element with respect to to silicon atoms is controlled in accordance with the absorption depth at the light-incident regions to bring it into such a state of distribution that the region on the light-incident side has the periodic table Group IIIb element in a smaller content, whereby the proportion of thermally excited carriers or photo-carriers captured to the localized levels can be made smaller, so that the mobility of carriers can be dramatically improved.

Namely, the present invention, constituted as described above, can achieve at a high level both the improvement in the temperature characteristics of sensitivity, linearity of sensitivity and chargeability in the case where laser light is used, and the improvement in temperature characteristics (of chargeability) and decrease in photomemory. Thus, the various problems in the prior art as discussed previously can be solved and the light-receiving member having very good electrical, optical and photoconductive properties, image quality, running performance and service environmental properties can be obtained.

The electrophotographic light-receiving member of the present invention will be described below in detail with reference to the accompanying drawings.

Figure 3A:
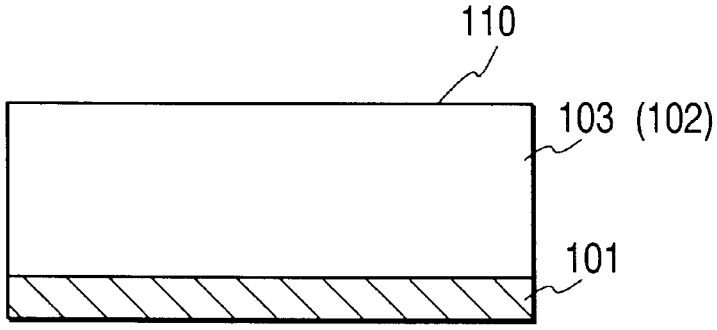
FIGS. 3A, 3B and 3C are diagrammatic cross sections showing examples of layer configuration of the electrophotographic light-receiving member according to the present invention.
Figure 3B:
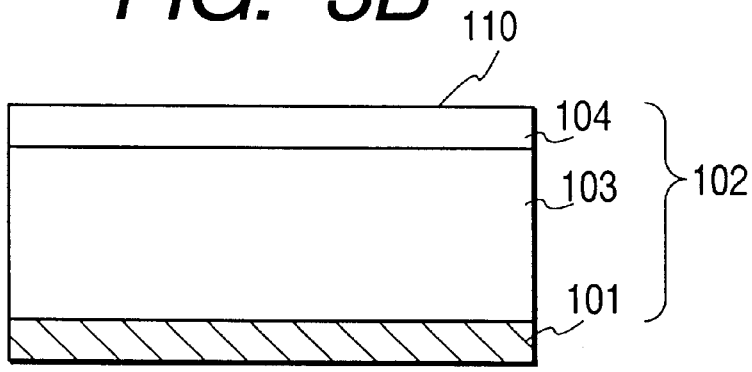
Figure 3C:
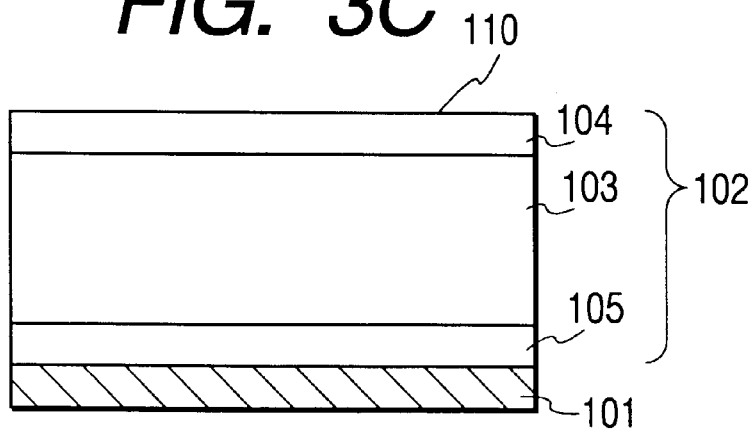

FIGS. 3A to 3C are each a schematic cross section to illustrate an example of layer configuration of the electrophotographic light-receiving member according to the present invention. The electrophotographic light-receiving member shown in FIG. 3A comprises a support 101 and a light-receiving layer 102 provided thereon. This light-receiving layer is constituted of a photoconductive layer 103 having a photoconductivity, formed of amorphous silicon containing at least one of hydrogen atom and halogen atom (hereinafter "a-Si:H,X").

FIG. 3B is a schematic cross section to illustrate another example of layer configuration of the electrophotographic light-receiving member according to the present invention. The electrophotographic light-receiving member shown in FIG. 3B comprises a support 101 and a light-receiving layer 102 provided thereon. This light-receiving layer 102 is constituted of a photoconductive layer 103 having a photoconductivity, formed of a-Si:H,X, and an amorphous silicon type (inclusive of amorphous carbon type) surface layer 104.

FIG. 3C is a schematic cross section to illustrate still another example of layer configuration of the electrophotographic light-receiving member according to the present invention. The electrophotographic light-receiving member shown in FIG. 3C comprises a support 101 and a light-receiving layer 102 provided thereon. This light-receiving layer is constituted of a photoconductive layer 103 having a photoconductivity, formed of a-Si:H,X, an amorphous silicon type (inclusive of amorphous carbon type) surface layer 104 and an amorphous silicon type charge injection blocking layer 105.

Support

The support used in the present invention may be a conductive support, or a support comprising an electrically insulating material whose surface at least on the side where the surface layer is formed has been subjected to conductive treatment, either of which may be used. The conductive support may include those made of a metal such as Al, Cr, Mo, Au, In, Nb, Te, V, Ti, Pt, Pb or Fe, or an alloy of any of these, as exemplified by stainless steel. The electrically insulating material of the support having been subjected to conductive treatment may include a film or sheet of synthetic resin such as polyester, polyethylene, polycarbonate, cellulose acetate, polypropylene, polyvinyl chloride, polystyrene or polyamide, or glass or ceramic.

The support used in the present invention may have the shape of a cylinder or endless belt with a smooth surface or uneven surface. Its thickness may be appropriately so determined that the electrophotographic light-receiving member can be formed as desired. In instances in which the electrophotographic light-receiving member is required to have a flexibility, the support may be made as thin as possible so long as it can well function as a support. In usual instances, however, the support may have a thickness of 10 $\mu$m or more in view of its manufacture and handling, mechanical strength and so forth.

When images are recorded using coherent light such as laser light, the surface of the support may be made uneven so that any faulty images due to what is called interference fringes appearing in visible images can be canceled. The unevenness made on the surface of the support can be produced by the known methods as disclosed in U.S. Pat. Nos. 4,650,736, 4,696,884 and 4,705,733.

As another method for canceling the faulty images due to interference fringes occurring when the coherent light such as laser light (e.g., 788 nm) is used, the surface of the support may be made uneven by making a plurality of sphere-traced concavities on the surface of the support. This unevenness is made more finely uneven than the resolving power required for the light-receiving member and is formed by a plurality of sphere-traced concavities. The unevenness formed by a plurality of sphere-traced concavities on the surface of the support can be produced by the known method as disclosed in U.S. Pat. No. 4,735,883.

Photoconductive Layer

The photoconductive layer in the present invention is, in order to effectively achieve the object thereof, formed on the support by a vacuum-deposition deposited film forming process under conditions appropriately numerically set in accordance with film forming parameters so as to achieve the desired performances, and under appropriate selection of materials gases used. Stated specifically, it can be formed by various thin-film deposition processes as exemplified by glow discharging including AC discharge CVD such as low-frequency CVD, high-frequency CVD or microwave CVD, and DC discharge CVD; and sputtering, vacuum metallizing, ion plating, light-assisted CVD and heat-assisted CVD. When these thin-film deposition processes are employed, suitable ones are selected according to factors such as the conditions for manufacture, the extent of a load on capital investment in equipment, the scale of manufacture and the properties and performances desired on electrophotographic light-receiving members produced. High-frequency glow discharging is preferred in view of its relative easiness to control conditions in the manufacture of electrophotographic light-receiving members having the desired performances.

When the photoconductive layer is formed by glow discharging, basically an Si-feeding material gas capable of feeding silicon atoms (Si), and an H-feeding material gas capable of feeding hydrogen atoms (H) and/or an X-feeding material gas capable of feeding halogen atoms (X) may be introduced in the desired gaseous state into a reactor whose inside can be evacuated, and glow discharge may be caused to take place in the reactor so that the layer comprised of a-Si:H,X is formed on a given support previously set at a given position.

The photoconductive layer in the present invention is required to contain hydrogen atoms and/or halogen atoms. This is because they are contained in order to compensate unbonded arms of silicon atoms in the layer and are essential and indispensable for improving layer quality, in particular, for improving photoconductivity and charge retentivity.

The content of hydrogen atoms or halogen atoms or the total content (Ch) of hydrogen atoms and halogen atoms may preferably be appropriately controlled according to the places of layer regions in which hydrogen atoms or halogen atoms are contained and the characteristic energy (Eu) obtained from the exponential tail of light absorption spectra. In usual instances, the hydrogen atoms and/or halogen atoms may be in a content of from 10 atom % to 40 atom %. In preferred instances, when the Eg is from 1.75 eV to 1.85 eV, the Eu is from 55 meV to 65 meV and these atoms are contained in a surface-side layer region (a), the hydrogen atoms and/or halogen atoms may be in a content of from 10 atom % to 30 atom %;

when the Eg is 1.75 eV or below, the Eu is 55 meV or below and these atoms are contained in a surface-side layer region (b), in a content of from 10 atom % to 20 atom %;

when the Eg is 1.80 eV or above, the Eu is 55 meV or below and these atoms are contained in a surface-side layer region (c), in a content of from 25 atom % to 35 atom %;

when the Eg is from 1.75 eV to 1.85 eV, the Eu is from 55 meV to 65 meV and these atoms are contained in a support-side layer region (d), in a content of from 20 atom % to 30 atom %, and when a surface-side layer region (e) where the Eg is from 1.70 eV to 1.80 eV and the Eu is 55 meV or below is provided on the support-side layer region (d), in a content of from 10 atom % to 25 atom % in the surface-side layer region (e); and when the Eg is from 1.80 eV to 1.90 eV, the Eu is 55 meV or below and these atoms are contained in a support-side layer region (f), in a content of from 10 atom % to 25 atom %, and when a surface-side layer region (g) where the Eg is from 1.70 eV to 1.80 eV and the Eu is 55 meV or below is provided on the support-side layer region (f), in a content of from 10 atom % to 25 atom % in the surface-side layer region (g).

The material that can serve as the Si-feeding gas used in the present invention may include gaseous or gasifiable silicon hydrides (silanes) such as $SiH_4$, $Si_2H_6$, $Si_3H_8$ and $Si_4H_{10}$, which can be effectively used. In view of readiness in handling for layer formation and Si-feeding efficiency, the material may preferably include $SiH_4$ and $Si_2H_6$. Any of these gases may be mixed not only alone in a single species but also in combination of plural species in a desired mixing ratio, without any problems.

To structurally incorporate the hydrogen atoms into the photoconductive layer to be formed and in order to make it more easy to control the percentage of the hydrogen atoms to be incorporated, to obtain film properties that achieve the object of the present invention, the films may preferably be formed using the above gases with which $H_2$ or a mixed gas of $H_2$ and He or a gas of a silicon compound containing hydrogen-atoms is further mixed in a desired quantity.

A material effective as a material gas for feeding halogen atoms used in the present invention may preferably include gaseous or gasifiable halogen compounds as exemplified by halogen gases, halides, halogen-containing interhalogen compounds and silane derivatives substituted with a halogen. The material may also include gaseous or gasifiable, halogen-containing silicon hydride compounds constituted of silicon atoms and halogen atoms, which can be also effective. Halogen compounds that can be preferably used in the present invention may specifically include fluorine gas ($F_2$) and interhalogen compounds such as BrF, ClF, $ClF_3$, $BrF_3$, $BrF_5$, $IF_3$ and $IF_7$. Silicon compounds containing halogen atoms, what is called silane derivatives substituted with halogen atoms, may specifically include silicon fluorides such as $SiF_4$ and $Si_2F_6$, which are preferable examples.

In order to control the quantity of the hydrogen atoms and/or halogen atoms incorporated in the photoconductive layer, for example, the temperature of the support, the quantity of materials used to incorporate the hydrogen atoms and/or halogen atoms, the discharge power and so forth may be controlled.

The photoconductive layer in the present invention must be incorporated with atoms capable of controlling its conductivity. This is because such atoms are essential and indispensable for improving chargeability or photomemory characteristics by controlling or compensating the mobility of carries attributable to the physical properties such as Eg and Eu of the photoconductive layer to thereby balance the mobility at a high level. The atoms capable of controlling the conductivity may include what is called impurities, used in the field of semiconductors, and it is possible to use elements belonging to Group IIIb of the periodic table (hereinafter "Group IIIb elements") capable of imparting p-type conductivity.

The content of the Group IIIb element may also preferably be appropriately controlled according to conditions of the layer region in which it is contained.

To describe its content with reference to the layer regions previously noted, the surface-side layer region (a) may preferably be so controlled as to have a smaller content than its support-side layer region (h), and more preferably a content of from 0.03 atom ppm to 5 atom ppm based on the silicon atoms, the layer region (h), to have a content of from 0.2 atom ppm to 25 atom ppm, and the ratio of the content of Group IIIb element in the layer region (h) to that in layer region (a) may be from 1.2 to 200;

the surface-side layer region (b), to have a smaller content than its support-side layer region (i), and more preferably a content of from 0.03 atom ppm to 5 atom ppm based on the silicon atoms, the layer region (i), to have a content of from 0.2 atom ppm to 25 atom ppm, and the ratio of the content of Group IIIb element in the layer region (i) to that in layer region (b) may be from 1.2 to 200;

the surface-side layer region (c), to have a smaller content than its support-side layer region (j), and more preferably a content of from 0.03 atom ppm to 5 atom ppm based on the silicon atoms, the layer region (j), to have a content of from 0.2 atom ppm to 25 atom ppm, and the ratio of the content of Group IIIb element in the layer region (j) to that in layer region (c) may be from 1.2 to 200;

the support-side layer region (d), to have a larger content than the surface-side layer region (e), and more preferably a content of from 0.2 atom ppm to 30 atom ppm based on the silicon atoms, and the layer region (e), to have a content of from 0.01 atom ppm to 5 atom ppm; and the support-side layer region (f), to have a larger content than the surface-side layer region (g), and more preferably a content of from 0.2 atom ppm to 25 atom ppm based on the silicon atoms, and the layer region (g), to have a content of from 0.01 atom ppm to 5 atom ppm in.

The layer regions (a), (b) and (c) may each preferably be a layer region that absorbs from 50% to 90% of peak wavelength light of imagewise exposure light. The layer regions (e) and (g) may each more preferably contain from 0.01 atom ppm to 5 atom ppm in its surface-side region necessary for absorbing 70% or more of peak wavelength light of imagewise exposure light, and the layer regions (e) and (g) may each preferably be a layer region that absorbs from 80% to 95% of the light.

The Group IIIb element may specifically include boron (B), aluminum (Al), gallium (Ga), indium (In) and thallium (Tl). In particular, B, Al and Ga are preferred.

In order to structurally incorporate the Group IIIb element, the atoms capable of controlling the conductivity, a starting material for incorporating the Group IIIb element may be fed, when the layer is formed, into the reactor in a gaseous state together with other gases used to form the photoconductive layer.

Here, the content of the Group IIIb element in the photoconductive layer may preferably be made smaller from the support side toward the surface side.

Of the photo-carriers produced, it is holes that moves toward the support. Their mobility is inferior to the mobility of electrons. However, problems of a lowering of ghost memory level and an increase in residual potential may occur unless the holes are caused to move. Accordingly, in order to improve the mobility of holes to balance it with the mobility of electrons, the Group IIIb element is incorporated. However, with incorporation of the Group IIIb element, levels in film may increase to cause an effect of a lowering of chargeability. The Group IIIb element is incorporated in order to effectively solve these two problems in a well-balanced state.

Those which can be used as the starting material for incorporating Group IIIb element may preferably be those which are gaseous at normal temperature and normal pressure or at least those which are readily gasifiable under conditions for the formation of the photoconductive layer. Such a starting material for incorporating the Group IIIb element may include, as a material for incorporating boron atoms, boron hydrides such as $B_2H_6$, $B_4H_{10}$, $B_5H_9$, $B_5H_{11}$, $B_6H_{10}$, $B_6H_{12}$ and $B_6H_{14}$ and and boron halides such as $BF_3$, $BCl_3$ and $BBr_3$. Besides, the material may also include $AlCl_3$, $GaCl_3$, $Ga(CH_3)_3$, $InCl_3$ and $TlCl_3$. In particular, $B_2H_6$ is the most preferred material from the viewpoint of handling. These starting materials for incorporating the atoms capable of controlling the conductivity may be optionally diluted with a gas such as $H_2$ and/or He when used.

In the present invention, it is also effective to incorporate carbon atoms and/or oxygen atoms and/or nitrogen atoms. The carbon atoms and/or oxygen atoms and/or nitrogen atoms may preferably be in a content of from $1\times10^{-5}$ to 10 atom %, more preferably from $1\times10^{-4}$ to 8 atom %, and most preferably from $1\times10^{-3}$ to 5 atom %, based on the total amount of the silicon atoms, carbon atoms, oxygen atoms and nitrogen atoms. The carbon atoms and/or oxygen atoms and/or nitrogen atoms may be evenly distributed in the photoconductive layer, or may be partly non-uniformly distributed so as to change in its content in the layer thickness direction of the photoconductive layer.

In the present invention, the thickness of the photoconductive layer may be appropriately determined as desired from the viewpoints of the desired electrophotographic performances to be obtained and economical advantages. The layer may preferably be formed in a thickness in the range of from 20 to 50 $\mu$m, more preferably from 23 to 45 $\mu$m, and most preferably from 25 to 40 $\mu$m. If the layer thickness is smaller than 20 $\mu$m, the electrophotographic performances such as chargeability and sensitivity may become unsatisfactory for practical use. If it is larger than 50 $\mu$m, it may take a longer time to form photoconductive layers, resulting in an increase in production cost.

To the whole photoconductive layer (having the first layer region and the second layer region), the ratio of the thickness of the second layer region may preferably be from 0.05 to 0.5. This ratio is preferred especially between the layer regions (d) and (e) and between the layer regions (f) and (g). If this ratio is smaller than 0.03, the layer can not well absorb pre-exposure light and image exposure light when the second layer region is positioned on the surface layer side, so that the effect of decreasing the temperature characteristics of sensitivity and improving the linearity of sensitivity can not be well exhibited in some cases. If it is more than 0.05, the improvement in chargeability and the effect on the temperature characteristics can not be well achieved in some cases.

In order to form the desired photoconductive layer that can achieve the object of the present invention and has the desired film properties, the mixing proportion of Si-feeding gas and dilute gas, the gas pressure inside the reactor, the discharge power and the support temperature must be appropriately set.

The flow rate of $H_2$ and/or He optionally used as dilute gas may be appropriately selected within an optimum range in accordance with the designing of layer configuration. In respect of a light-receiving member having any of the layer regions (a) to (c), the flow rate of $H_2$ and/or He may usually be controlled within the range of from 3 to 30 times, preferably from 4 to 25 times, and most preferably from 5 to 20 times, based on the Si-feeding gas. The flow rate may also preferably be controlled so as to be at a constant value within that range. In respect of a light-receiving member having the layer regions (d) and (e), the flow rate of $H_2$ and/or He in the first layer region [layer region (d)] may usually be controlled within the range of from 4 to 20 times, preferably from 5 to 15 times, and most preferably from 6 to 10 times, based on the Si-feeding gas. In respect of a light-receiving member having the layer regions (f) and (g), the flow rate of $H_2$ and/or He in the first layer region [layer region (f)] may usually be controlled within the range of from 2 to 15 times, preferably from 3 to 12 times, and most preferably from 4 to 8 times, based on the Si-feeding gas. In all the second layer regions [layer regions (e) and (g)], the flow rate of $H_2$ and/or He may usually be controlled within the range of from 0.5 to 10 times, preferably from 1 to 8 times, and most preferably from 2 to 6 times, based on the Si-feeding gas.

The gas pressure inside the reactor may also be appropriately selected within an optimum range in accordance with the designing of layer configuration. The pressure may usually be controlled in the range of from $1\times10^{-2}$ to $2\times10^{3}$ Pa, preferably from $5\times10^{-2}$ to $5\times10^{2}$ Pa, and most preferably from $1\times10^{-1}$ to $2\times10^{2}$ Pa.

The discharge power may also be appropriately selected within an optimum range in accordance with the designing of layer configuration, where the ratio (W/SCCM) of the discharge power to the flow rate of Si-feeding gas may preferably be controlled in the range of from 0.3 to 10, more preferably from 0.5 to 9, and most preferably from 1 to 6. Then, the ratio of discharge power to the flow rate of Si-feeding gas in the first layer region may preferably be made larger than the ratio in the second layer region so that the layer is produced in what is called the flow-limit region.

The temperature of the support may also be appropriately selected within an optimum range in accordance with the designing of layer configuration. The temperature may preferably be set in the range of from 200 to 350° C., more preferably from 230 to 330° C., and still more preferably from 250 to 300° C.

Preferable numerical values for the above gas mixing ratio, gas pressure inside the reactor, discharge power and support temperature can not be independently separately determined. Optimum values should be determined on the basis of mutual and systematic relationship so that the light-receiving member having the desired properties can be formed.

Surface Layer

In the present invention, a surface layer of an a-Si type may preferably be further formed on the photoconductive layer formed on the support in the manner as described above. This surface layer has a free surface 110, and is provided so that the object of the present invention can be achieved chiefly with regard to moisture resistance, performance on continuous repeated use, electrical breakdown strength, service environmental properties and running performance.

In the present invention, the amorphous material forming the photoconductive layer and that forming the surface layer each have a common constituent, silicon atoms, and hence a chemical stability is well ensured at the interface between layers.

The surface layer may be formed using any materials so long as they are a-Si materials, as exemplified by an amorphous silicon containing hydrogen atom (H) and/or halogen atom (X) and further containing a carbon atom (hereinafter "a-SiC:H,X"), an amorphous silicon containing hydrogen atom (H) and/or halogen atom (X) and further containing an oxygen atom (hereinafter "a-SiO:H,X"), an amorphous silicon containing hydrogen atom (H) and/or halogen atom (X) and further containing a nitrogen atom (hereinafter "a-SiN:H,X"), and, as a generic term inclusive of these, an amorphous silicon containing hydrogen atom (H) and/or halogen atom (X) and further containing at least one of a carbon atom, an oxygen atom and a nitrogen atom (hereinafter "a-SiCON:H,X"), or an amorphous carbon optionally containing hydrogen atom (H) or halogen atom (X) (hereinafter "a-C:H,X"), any of which may preferably be used.

In the present invention, in order to effectively achieve the object thereof, the surface layer is prepared by a vacuum-deposition deposited film forming process under conditions appropriately numerically set in accordance with film forming parameters so as to achieve the desired performances. Stated specifically, it can be formed by various thin-film deposition processes as exemplified by glow discharging (including AC discharge CVD such as low-frequency CVD, high-frequency CVD or microwave CVD, and DC discharge CVD), sputtering, vacuum metallizing, ion plating, light CVD and heat CVD. When these thin-film deposition processes are employed, suitable ones are selected according to the conditions for manufacture, the extent of a load on capital investment in equipment, the scale of manufacture and the properties and performances desired on electrophotographic light-receiving members produced. In view of productivity of light-receiving members, it is preferable to use the same deposition process as the photoconductive layer.

When, for example, the surface layer comprised of a-SiC:H,X or a-C:H,X is formed by glow discharging, basically an Si-feeding material gas capable of feeding silicon atoms (Si), which is optionally used, a C-feeding material gas capable of feeding carbon atoms (C), and an H-feeding material gas capable of feeding hydrogen atoms (H) and/or an X-feeding material gas capable of feeding halogen atoms (X) may be introduced in the desired gaseous state into a reactor whose inside can be evacuated, and glow discharge may be caused to take place in the reactor so that the layer comprised of a-SiC:H,X or a-C:H,X is formed on the support previously set at a given position and on which the photoconductive layer has been formed.

As materials for the surface layer in the present invention, any amorphous materials containing silicon may be used. Amorphous silicon materials containing at least one element selected from carbon, nitrogen and oxygen are preferred. In particular, a-SiC:H,X is preferred. The a-C:H,X layer may be formed on the a-SiC:H,X layer.

When the surface layer is formed of a-SiC as a main constituent, its carbon content may preferably be in the range of from 30% to 90% based on the total of silicon atoms and carbon atoms.

In the present invention, the surface layer is required to contain hydrogen atoms and/or halogen atoms. This is because they are contained in order to compensate unbonded arms of constituent atoms such as silicon atoms and are essential and indispensable for improving layer quality, in particular, for improving photoconductivity and charge retentivity. The hydrogen atoms may usually be in a content of from 30 to 70 atom %, preferably from 35 to 65 atom %, and more preferably from 40 to 60 atom %, based on the total amount of constituent atoms. The fluorine atoms may usually be in a content of from 0.01 to 15 atom %, preferably from 0.1 to 10 atom %, and more preferably from 0.6 to 4 atom %.

The light-receiving member formed to have the hydrogen content and/or fluorine content within these ranges is well applicable as a product hitherto unavailable and remarkably superior in its practical use.

Any defects or imperfections (mainly comprised of dangling bonds of silicon atoms or carbon atoms) present inside the surface layer are known to have ill influences on the properties required for electrophotographic light-receiving members. For example, chargeability may deteriorate because of the injection of charges from the free surface; chargeability may vary because of changes in surface structure in a service environment, e.g., in an environment of high humidity; and the injection of charges into the surface layer from the photoconductive layer at the time of corona discharging or irradiation with light may cause a phenomenon of after images during repeated use because of entrapment of charges in the defects inside the surface layer. These can be given as the ill influences. However, the controlling of the hydrogen content in the surface layer so as to be 30 atom % or more brings about a great decrease in the defects inside the surface layer, so that dramatic improvements can be achieved in respect of electrical properties and high-speed continuous-use performance. On the other hand, if the hydrogen content in the surface layer is more than 70 atom %, the hardness of the surface layer tends to lower, and hence the layer can not endure the repeated use in some cases. Thus, the controlling of hydrogen content in the surface layer within the range set out above is very important for obtaining much superior electrophotographic performance as desired. The hydrogen content in the surface layer can be controlled according to the flow rate (ratio) of material gases, the support temperature, the discharge power, the gas pressure and so forth.

The controlling of halogen atom content in the surface layer so as to be 0.01 atom % or more also makes it possible to effectively generate the bonds between silicon atoms and carbon atoms in the surface layer. As a function of the halogen atoms in the surface layer, it is also possible to effectively prevent the bonds between silicon atoms and carbon atoms from breaking because of damage caused by coronas or the like. On the other hand, if the halogen atom content in the surface layer is more than 15 atom %, it becomes almost ineffective to generate the bonds between silicon atoms and carbon atoms in the surface layer and to prevent the bonds between silicon atoms and carbon atoms from breaking because of damage caused by coronas or the like. Moreover, residual potential and image memory may become remarkably seen because the excessive halogen atoms inhibit the mobility of carriers in the surface layer. Thus, the controlling of halogen content in the surface layer within the range set out above is important for obtaining the desired electrophotographic performance. The halogen content in the surface layer, like the hydrogen content, can be controlled according to the flow rate (flow ratio) of material gases, the support temperature, the discharge power, the gas pressure and so forth.

Materials that can serve as material gases for feeding silicon (Si), used to form the surface layer in the present invention, may include gaseous or gasifiable silicon hydrides (silanes) such as $SiH_4$, $Si_2H_6$, $Si_3H_8$ and $Si_4H_{10}$, which can be effectively used. In view of readiness in handling for layer formation and Si-feeding efficiency, the material may preferably include $SiH_4$ and $Si_2H_6$. These Si-feeding material gases may be used optionally after their dilution with a gas such as $H_2$, He, Ar or Ne.

Materials that can serve as material gases for feeding carbon (C) may include gaseous or gasifiable hydrocarbons such as $CH_4$, $C_2H_2$, $C_2H_6$, $C_3H_8$ and $C_4H_{10}$. In view of readiness in handling for layer formation and C-feeding efficiency, the material may preferably include $CH_4$, $C_2H_2$ and $C_2H_6$. These C-feeding material gases may be used optionally after their dilution with a gas such as $H_2$, He, Ar or Ne.

Materials that can serve as material gases for feeding nitrogen or oxygen may include gaseous or gasifiable compounds such as $NH_3$, NO, $N_2O$, $NO_2$, $O_2$, CO, $CO_2$ and $N_2$. These nitrogen- or oxygen-feeding material gases may be used optionally after their dilution with a gas such as $H_2$, He, Ar or Ne.

To make it more easy to control the percentage in which the hydrogen atoms are incorporated into the surface layer, the films may preferably be formed using any of these gases further mixed with a desired amount of hydrogen gas or a gas of a silicon compound containing hydrogen atoms. Each gas may be mixed not only alone in a single species but also in combination of plural species in a desired mixing ratio, without any problems.

A material effective as a material gas for feeding halogen atoms may preferably include gaseous or gasifiable halogen compounds as exemplified by halogen gases, halides, halogen-containing interhalogen compounds and silane derivatives substituted with a halogen. The material may also include gaseous or gasifiable, halogen-containing silicon hydride compounds constituted of silicon atoms and halogen atoms, which can be also effective. Halogen compounds that can be preferably used in the present invention may specifically include fluorine gas ($F_2$) and interhalogen compounds such as BrF, ClF, $ClF_3$, $BrF_3$, $BrF_5$, $IF_3$ and $IF_7$. Silicon compounds containing halogen atoms, what is called silane derivatives substituted with halogen atoms, may specifically include silicon fluorides such as SiF4 and $Si_2F_6$, which are preferable examples.

In order to control the quantity of the hydrogen atoms and/or halogen atoms incorporated in the surface layer, for example, the temperature of the support, the quantity of materials used to incorporate the hydrogen atoms and/or halogen atoms into the reactor, the discharge power and so forth may be controlled.

The carbon atoms and/or oxygen atoms and/or nitrogen atoms may be evenly distributed in the surface layer, or may be partly non-uniformly distributed so as to change in its content in the layer thickness direction of the surface layer.

In the present invention, the surface layer may preferably be also incorporated with atoms capable of controlling its conductivity as occasion calls. The atoms capable of controlling the conductivity may be contained in the surface layer in an evenly uniformly distributed state, or may be contained partly in such a state that they are distributed non-uniformly in the layer thickness direction.

The atoms capable of controlling the conductivity may include what is called impurities, used in the field of semiconductors, and it is possible to use elements belonging to Group IIIb of the periodic table (Group IIIb element) capable of imparting p-type conductivity or elements belonging to Group Vb of the periodic table (Group Vb element) capable of imparting n-type conductivity.

The Group IIIb element may specifically include boron (B), aluminum (Al), gallium (Ga), indium (In) and thallium (Tl). In particular, B, Al and Ga are preferred. The Group Vb element may specifically include phosphorus (P), arsenic (As), antimony (Sb) and bismuth (Bi). In particular, P and As are preferred.

The atoms capable of controlling the conductivity, incorporated in the surface layer, may preferably be in an amount of from $1\times10^{-3}$ to $1\times10^{3}$ atom ppm more preferably from $1\times10^{-2}$ to $5\times10^{2}$ atom ppm and most preferably from $1\times10^{-1}$ to $1\times10^{2}$ atom ppm.

In order to structurally incorporate the atoms capable of controlling the conductivity, e.g., the Group IIIb element or Group Vb element, a starting material for incorporating the Group IIIb element or a starting material for incorporating the Group Vb element may be fed, when the layer is formed, into the reactor in a gaseous state together with other gases used to form the surface layer.

Those which can be used as the starting material for incorporating the Group IIIb element or starting material for incorporating the Group Vb element may preferably be those which are gaseous at normal temperature and normal pressure or at least those which can be readily gasified under conditions for the layer formation. Such a starting material for incorporating the Group IIIb element may specifically include, as a material for incorporating boron atoms, boron hydrides such as $B_2H_6$, $B_4H_{10}$, $B_5H9$, $B_5H_{11}$, $B_6H_{10}$, $B_6H_{12}$ and $B_6H_{14}$, and boron halides such as $BF_3$, $BCl_3$ and $BBr_3$. Besides, the material may also include $AlCl_3$, $GaCl_3$, $Ga(CH_3)_3$, $InCl_3$ and $TlCl_3$. The starting material for incorporating Group Vb element may include, as a material for incorporating phosphorus atoms, phosphorus hydrides such as $PH_3$ and $P2H_4$ and phosphorus halides such as $PH_4I$, $PF_3$, $PF_5$, $PCl_3$, $PCl_5$, $PBr_3$, $PBr_5$ and $PI_3$. Besides, the material that can be effectively used as the starting material for incorporating Group Vb element may also include $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BiBr_3$. These starting materials for incorporating the atoms capable of controlling the conductivity may be used optionally after their dilution with a gas such as $H_2$, He, Ar or Ne.

The surface layer in the present invention may usually be formed in a thickness of from 0.01 to 3 $\mu$m, preferably from 0.05 to 2 $\mu$m, and more preferably from 0.1 to 1 $\mu$m. If the layer thickness is smaller than 0.01 $\mu$m, the surface layer may become lost because of friction or the like during the use of the light-receiving member. If it is larger than 3 $\mu$m, a lowering of electrophotographic performance such as an increase in residual potential may occur.

The surface layer in the present invention is carefully formed so that the required performances can be obtained as desired. More specifically, from the structural viewpoint, the material constituted of i) at least one element of Si, C, N and O and ii) H and/or X takes the form of from crystalline to amorphous (generically termed as "non-single-crystal") depending on the conditions for its formation. From the viewpoint of electric properties, it exhibits the nature of from conductive to semiconductive and up to insulating, and also the nature of from photoconductive to non-photoconductive. Accordingly, in the present invention, the conditions for its formation are severely selected as desired so that a compound having the desired properties as intended can be formed.

For example, in order to provide the surface layer mainly for the purpose of improving its breakdown strength, the compound is prepared as a non-single-crystal material having a remarkable electrical insulating behavior in the service environment. When the surface layer is provided mainly for the purpose of improving the performance on continuous repeated use and service environmental properties, the compound is formed as a non-single-crystal material having become milder in its degree of the above electrical insulating properties to a certain extent and having a certain sensitivity to the light with which the layer is irradiated.

In order to form the surface layer having the desired properties that can achieve the object of the present invention, the temperature of the support and the gas pressure inside the reactor must be appropriately set as desired. The temperature (Ts) of the support may be appropriately selected within an optimum range in accordance with the designing of layer configuration. In usual instances, the temperature may preferably be set in the range of from 200 to 350° C., more preferably from 230 to 330° C., and most preferably from 250 to 300° C. The gas pressure inside the reactor may also be appropriately selected within an optimum range in accordance with the designing of layer configuration. In usual instances, the pressure may preferably be in the range of from $1\times10^{-2}$ to $2\times10^{3}$ Pa, more preferably from $5\times10^{-2}$ to $5\times10^{2}$ Pa, and most preferably from $1\times10^{-1}$ to $2\times10^{2}$ Pa.

In the present invention, preferable numerical values for the support temperature and gas pressure necessary to form the surface layer may be in the ranges as defined above. In usual instances, these conditions can not be independently separately determined. Optimum values should be determined on the basis of mutual and systematic relationship so that the light-receiving member having the desired properties can be formed.

In the present invention, as an intermediate layer, a blocking layer (a lower surface layer) having a smaller content of carbon atoms, oxygen atoms and nitrogen atoms than the surface layer may be further provided between the photoconductive layer and the surface layer. This is effective for more improving performances such as chargeability.

Between the surface layer and the photoconductive layer, there may also be provided with a region in which the content of carbon atoms, oxygen atoms and nitrogen atoms changes in the manner that it decreases toward the photoconductive layer. This makes it possible to improve the adhesion between the surface layer and the photoconductive layer, to smooth the movement of photo-carriers to the surface, and to more decrease an influence of interference due to reflected light at the interface between the layers.

Charge Injection Blocking Layer

In the electrophotographic light-receiving member of the present invention, it is more effective to provide between the conductive support and the photoconductive layer a charge injection blocking layer having the function to block the injection of charges from the conductive support side. More specifically, the charge injection blocking layer has the function to prevent charges from being injected from the support side to the photoconductive layer side when the light-receiving layer is subjected to charging in a certain polarity on its free surface, and exhibits no such function when subjected to charging in a reverse polarity, which is what is called polarity dependence.

In order to impart such function, atoms capable of controlling its conductivity are incorporated in a relatively large content compared with those in the photoconductive layer. The atoms capable of controlling the conductivity, contained in that layer, may be evenly uniformly distributed in the layer, or may be evenly contained in the layer thickness but contained partly in such a state that they are distributed non-uniformly. In the case where they are distributed in non-uniform concentration, they may preferably be contained so as to be distributed in a larger quantity on the support side. In any case, however, in the in-plane direction parallel to the surface of the support, it is necessary for such atoms to be evenly contained in a uniform distribution so that the properties in the in-plane direction can also be made uniform.

The atoms capable of controlling the conductivity, incorporated in the charge injection blocking layer, may include what is called impurities used in the field of semiconductors, and it is possible to use Group IIIb element or Group Vb element.

The Group IIIb element may specifically include boron (B), aluminum (Al), gallium (Ga), indium (In) and thallium (Tl). In particular, B, Al and Ga are preferred. The Group Vb element may specifically include phosphorus (P), arsenic (As), antimony (Sb) and bismuth (Bi). In particular, P and As are preferred. Materials used to incorporate these atoms may be the same as those used to form the surface layer.

The atoms capable of controlling the conductivity, incorporated in the charge injection blocking layer in the present invention, may preferably be in an amount of from 10 to $1\times10^4$ atom ppm more preferably from 50 to $5\times10^3$ atom ppm and most preferably from $1\times10^2$ to $3\times10^3$ atom ppm which may be appropriately determined as desired so that the object of the present invention can be effectively achieved.

The charge injection blocking layer may be further incorporated with at least one kind of carbon atoms, nitrogen atoms and oxygen atoms. This enables more improvement of the adhesion between the charge injection blocking layer and other layer provided in direct contact with the charge injection blocking layer. The carbon atoms, nitrogen atoms and oxygen atoms contained in that layer may be evenly uniformly distributed in the layer, or may be evenly contained in the layer thickness direction but contained partly in such a state that they are distributed non-uniformly. In any case, however, in the in-plane direction parallel to the surface of the support, it is necessary for such atoms to be evenly contained in a uniform distribution so that the properties in the in-plane direction can also be made uniform.

The carbon atoms, nitrogen atoms and oxygen atoms contained in the whole layer region of the charge injection blocking layer in the present invention may preferably be in an amount, as an amount of one kind thereof or as a total of two or more kinds, of from $1\times10^{-3}$ to 50 atom %, more preferably from $5\times10^{-3}$ to 30 atom %, and most preferably from $1\times10^{-2}$ to 10 atom %, which may be appropriately determined so that the object of the present invention can be effectively achieved.

Hydrogen atoms and/or halogen atoms may be contained in the charge injection blocking layer in the present invention, which are effective for compensating unbonded arms of constituent atoms to improve film quality. The hydrogen atoms or halogen atoms or the total of hydrogen atoms and halogen atoms in the charge injection blocking layer may preferably be in a content of from 1 to 50 atom %, more preferably from 5 to 40 atom %, and most preferably from 10 to 30 atom %.

The charge injection blocking layer in the present invention may preferably be formed in a thickness of from 0.1 to 5 $\mu$m, more preferably from 0.3 to 4 $\mu$m, and most preferably from 0.5 to 3 $\mu$m in view of the desired electrophotographic performance and economical effects and the like. If the layer thickness is smaller than 0.1 $\mu$m, the ability to block the injection of charges from the support may become insufficient to obtain no satisfactory chargeability. If it is made larger than 5 $\mu$m, no more improvement in electrophotographic performance can be expected and the time taken to form the layer becomes longer to cause an increase in production cost.

To form the charge injection blocking layer in the present invention, the same vacuum deposition process as in the formation of the photoconductive layer previously described may be employed. In order to form the charge injection blocking layer having the properties that can achieve the object of the present invention, the mixing proportion of Si-feeding gas and dilute gas, the gas pressure inside the reactor, the discharge power and the temperature of the support must be appropriately set.

The flow rate of $H_2$ and/or He as dilute gas may be appropriately selected within an optimum range in accordance with the designing of layer configuration, and $H_2$ and/or He may preferably be controlled within the range of from 0.3 to 20 times, more preferably from 5 to 15 times, and most preferably from 1 to 10 times, based on the Si-feeding gas.

The gas pressure inside the reactor may also be appropriately selected within an optimum range in accordance with the designing of layer configuration. The pressure may preferably be controlled in the range of from $1\times10^{-2}$ to $2\times10^3$ Pa, more preferably from $5\times10^{-2}$ to $5\times10^2$ Pa, and most preferably from $1\times10^{-1}$ to $2\times10^2$ Pa.

The discharge power may also be appropriately selected within an optimum range in accordance with the designing of layer configuration, where the ratio (W/SCCM) of the discharge power to the flow rate of Si-feeding gas may preferably be set in the range of from 0.5 to 8, more preferably from 0.8 to 7, and most preferably from 1 to 6.

The temperature of the support may also be appropriately selected within an optimum range in accordance with the designing of layer configuration. The temperature may preferably be set in the range of from 200 to 350° C., more preferably from 230 to 330° C., and most preferably from 250 to 310° C.

In the present invention, preferable numerical values for the dilute gas mixing ratio, gas pressure, discharge power and support temperature necessary to form the charge injection blocking layer can not be independently separately determined. Optimum values should be determined on the basis of mutual and systematic relationship so that the charge injection blocking layer having the desired properties can be formed.

In addition to the foregoing, in the electrophotographic light-receiving member of the present invention, the light-receiving layer may preferably have, on its side of the support, a layer region in which at least aluminum atoms, silicon atoms and hydrogen atoms and/or halogen atoms are contained in such a state that they are distributed non-uniformly in the layer thickness direction. In the electrophotographic light-receiving member of the present invention, for the purpose of more improve the adhesion between the support and the photoconductive layer or charge injection blocking layer, an adherent layer may be provided which is formed of, e.g., $Si_3N_4$, $SiO_2$, SiO, or an amorphous material mainly composed of silicon atoms and containing hydrogen atoms and/or halogen atoms and carbon atoms and/or oxygen atoms and/or nitrogen atoms. A light absorption layer may also be provided for preventing occurrence of interference fringes due to the light reflected from the support.

Light-receiving Layer-forming Apparatus and Film-forming Method

Apparatus and film forming methods for forming the light-receiving layer will be described below in detail.

Figure 4:
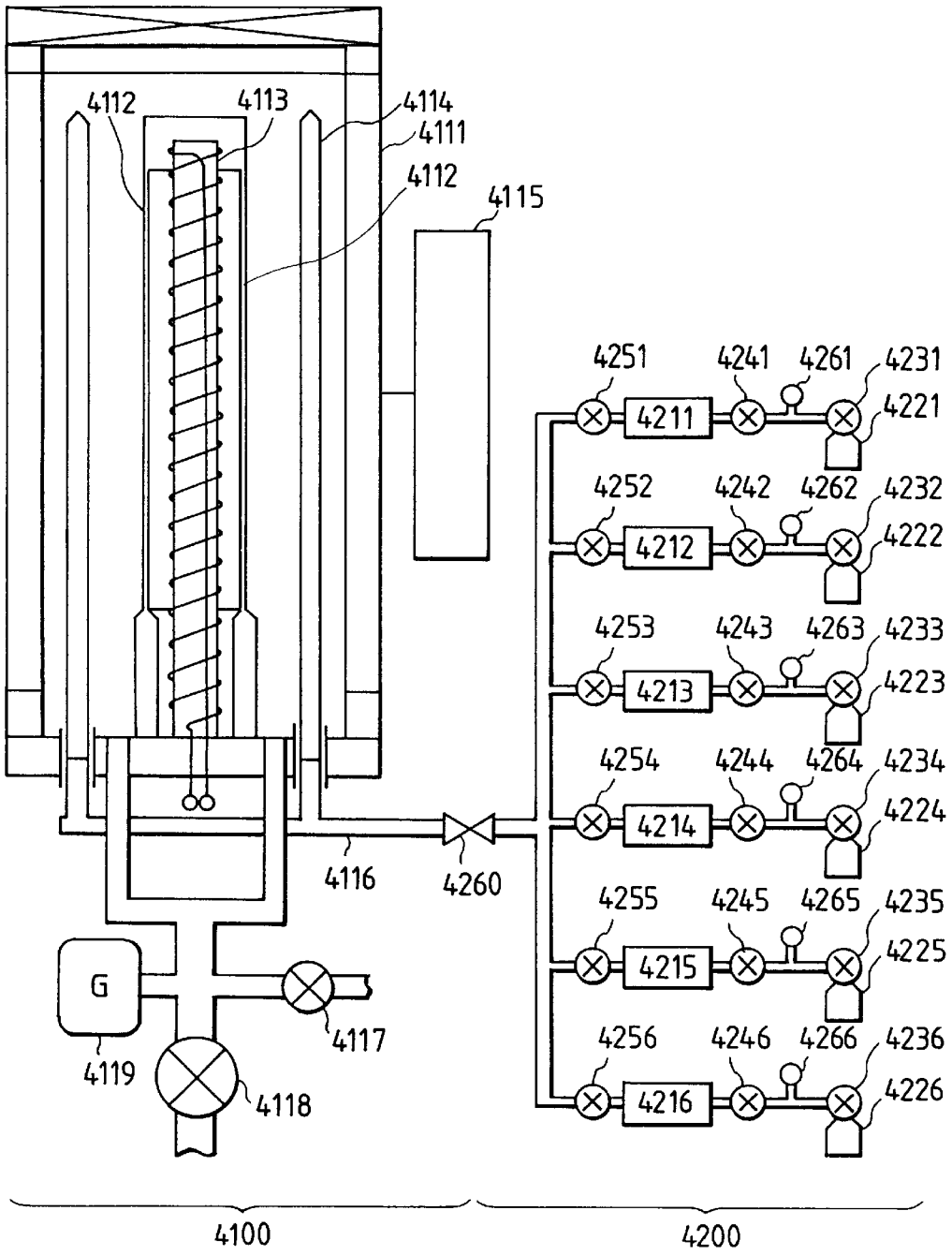
FIG. 4 schematically illustrates the constitution of an apparatus for producing the light-receiving member by high-frequency plasma-assisted CVD making use of an RF band frequency power source.

FIG. 4 diagrammatically illustrates the constitution of an example of an apparatus for producing the electrophotographic light-receiving member by high-frequency plasma-assisted CVD making use of frequencies of RF bands (hereinafter simply "RF-PCVD"). The production apparatus shown in FIG. 4 is constituted in the following way.

This apparatus is constituted chiefly of a deposition system 4100, a material gas feed system 4200 and an exhaust system (not shown) for evacuating the inside of a reactor 4111. In the reactor 4111 in the deposition system 4100, a cylindrical support 4112, a support heater 4113 and a material gas feed pipe 4114 are provided. A high-frequency matching box 4115 is also connected to the reactor.

The material gas feed system 4220 is constituted of gas cylinders 4221 to 4226 for material gases such as $SiH_4$, $GeH_4$, $H_2$, $CH_4$, $B_2H_6$ and $PH_{31}$ valves 4231 to 4236, 4241 to 4246 and 4251 to 4256, and mass flow controllers 4211 to 4216. The gas cylinders for the respective material gases are connected to the gas feed pipe 4114 in the reactor 4111 through a valve 4260.

Using this apparatus, deposited films can be formed, e.g., in the following way.

First, the cylindrical support 4112 is set in the reactor 4111, and the inside of the reactor is evacuated by means of an exhaust device (e.g., a vacuum pump; not shown). Subsequently, the temperature of the cylindrical support 4112 is controlled at a prescribed temperature of, e.g., from 200° C. to 350° C. by means of the heater 4113 for heating the support.

Before material gases for forming deposited films are flowed into the reactor 4111, gas cylinder valves 4231 to 4236 and a leak valve 4117 of the reactor are checked to make sure that they are closed, and also flow-in valves 4241 to 4246, flow-out valves 4251 to 4256 and an auxiliary valve 4260 are checked to make sure that they are opened. Thereafter, a main valve 4118 is opened to evacuate the insides of the reactor 4111 and a gas pipe 4116.

Next, at the time a vacuum gauge 4119 has been read to indicate a pressure of about $1\times10^{-2}$ Pa, the auxiliary valve 4260 and the flow-out valves 4251 to 4256 are closed.

Thereafter, gas cylinder valves 4231 to 4236 are opened so that gases are respectively introduced from gas cylinders 4221 to 4226, and each gas is controlled to have a pressure of 2 kg/cm$^2$ by operating pressure controllers 4261 to 4266. Next, the flow-in valves 4241 to 4246 are slowly opened so that gases are respectively introduced into mass flow controllers 4211 to 4216.

After the film formation is thus ready to start, the respective layers are formed according to the following procedure.

At the time the cylindrical support 4112 has had a prescribed temperature, some necessary flow-out valves 4251 to 4256 and the auxiliary valve 4260 are slowly opened so that prescribed gases are fed into the reactor 4111 from the gas cylinders 4221 to 4226 through a gas feed pipe 4114. Next, the mass flow controllers 4211 to 4216 are operated so that each material gas is adjusted to flow at a prescribed rate. In that course, the opening of the main valve 4118 is adjusted while watching the vacuum gauge 4119 so that the pressure inside the reactor 4111 comes to be a prescribed pressure of not higher than $1.5\times10^2$ Pa. At the time the inner pressure has become stable, an RF power source (not shown) with a frequency of 13.56 MHz is set at the desired electric power, and an RF power is supplied to the inside of the reactor 4111 through the high-frequency matching box 4115 to cause glow discharge to take place. The material gases fed into the reactor are decomposed by the discharge energy thus produced, so that a prescribed deposited film mainly composed of silicon is formed on the cylindrical support. After a film with a prescribed thickness has been formed, the supply of RF power is stopped, and the flow-out valves are closed to stop gases from flowing into the reactor. The formation of a deposited film is thus completed.

The same operation is repeated plural times, whereby a light-receiving layer with the desired multi-layer structure can be formed.

When the corresponding layers are formed, the flow-out valves other than those for necessary gases are all closed. Also, in order to prevent the corresponding gases from remaining in the reactor 4111 and in the pipe extending from the flow-out valves 4251 to 4256 to the reactor 4111, the flow-out valves 4251 to 4256 are closed, the auxiliary valve 4260 is opened and then the main valve 4118 is full-opened so that the inside of the system is once evacuated to a high vacuum; this may be optionally operated.

In order to achieve uniform film formation, it is effective to rotate the cylindrical support at a prescribed speed by means of a driving mechanism (not shown) while the films are formed.

Needless to say, the gas species and valve operations described above are changed according to the conditions under which each layer is formed.

In the above process, the support temperature at the time of the formation of deposited films may preferably be set at from 200° C. to 350° C., more preferably from 230° C. to 330° C., and most preferably from 250° C. to 300° C.

The support may be heated by any means so long as it is a heating element of a vacuum type, specifically including electrical resistance heaters such as a winding heater of sheathed-heater, a plate heater and a ceramic heater, heat radiation lamp heating elements such as a halogen lamp and an infrared lamp, and heating elements comprising a heat exchange means employing a liquid, gas or the like as a hot medium. As surface materials of the heating means, metals such as stainless steel, nickel, aluminum and copper, ceramics, heat-resistant polymer resins or the like may be used. As another method that may be used, a container exclusively used for heating may be provided in addition to the reactor and the support having been heated therein may be transported into the reactor in vacuo.

Experiments

The following Experiments will specifically demonstrate the effect of the present invention.

Experiment A1

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under conditions as shown in Table A1, to produce a light-receiving member. The photoconductive layer was formed in the order of the first layer region and the second layer region (a region with a layer thickness for absorbing 70% of light with a 680 nm wavelength). $B_2H_6$ was used as a gas species containing the Group IIIb element, and the content of the Group IIIb element based on silicon atoms was controlled.

Meanwhile, the aluminum cylinder was replaced with a cylindrical sample holder having been worked to have grooves for setting sample substrates. Glass substrates (7059; available from Corning Glass Works) and silicon (Si) wafers were set on the sample holder, and a-Si films of about 1 μm in layer thickness were deposited thereon under the same conditions as the formation of the photoconductive layer. The deposited films formed on the glass substrates were examined to measure their optical band gaps (Eg), and thereafter Cr comb electrodes were formed thereon by vacuum deposition, where the characteristic energy at the exponential tail (Eu) was measured by CPM. In respect of the deposited films on the Si wafers, the hydrogen content (Ch) was measured by FTIR (Fourier transformation infrared absorption spectroscopy).

In the photoconductive layer of the light-receiving member produced under the conditions shown in Table A1, the Ch, Eg and Eu were 21 atom %, 1.80 eV and 60 meV, respectively (light-receiving member a).

Next, films were formed in the same manner but variously changing in Table A1 the mixing ratio of $SiH_4$ gas to $H_2$ gas, the ratio of $SiH_4$ gas flow rate to discharge power and the support temperature, to produce various light-receiving members in which the Ch, Eg and Eu of the photoconductive layer were 10 atom %, 1.75 eV and 55 meV, respectively (light-receiving member b); 26 atom %, 1.82 eV and 61 meV (light-receiving member c); and 30 atom %, 1.85 eV and 65 meV (light-receiving member d).

The light-receiving members thus produced were each set in an electrophotographic apparatus (NP-6550, manufactured by CANON INC., modified for testing; 680 nm wavelength LED or laser light is replaceable), to make evaluation of potential characteristics.

In this evaluation, process speed was set at 380 mm/sec, pre-exposure (a 700 nm wavelength LED) at 4 lux·sec, and electric current value of its charging assembly at 1,000 μA, under conditions of which the surface potential of the light-receiving member was measured using a potential sensor of a surface potentiometer (Model 344, manufactured by Trek Co.) set at the position of the developing assembly of the electrophotographic apparatus, and the value obtained was used to represent chargeability. With regard to residual potential, the surface potential at the time of imagewise exposure at 1.5 lux·sec was measured, and the value obtained was used to represent residual potential.

Temperature of the light-receiving member was changed from room temperature (about 25° C.) to 50° C. by means of a built-in drum heater, and the chargeability was measured under such conditions. Changes in chargeability per temperature 1° C. during the measurement was used to represent the temperature characteristics of chargeability.

Then, charging conditions were so set as to provide a dark potential of 400 V for each of room temperature and 45° C., and, using a 680 nm wavelength LED as an exposure light source, the E-V characteristics (E-V curves) were measured to evaluate the temperature characteristics of sensitivity and the linearity of sensitivity.

In respect of the photomemory, the 680 nm wavelength LED was used as an exposure light source, and the potential difference between the surface potential in an unexposed state and the surface potential at the time when the surface was once exposed and thereafter again charged was measured. The value obtained was used to represent memory potential.

Image characteristics were evaluated by reproducing images using NP-6650, setting therein the 680 nm wavelength LED.

With regard to the respective light-receiving members a to d, the chargeability, residual potential, temperature characteristics (of chargeability), memory potential, temperature characteristics of sensitivity and linearity of sensitivity were evaluated according to the following criteria, on the basis of an instance where a photoconductive layer with a layer thickness of 30 μm was constituted of only the first layer region or the second layer region.

AA: Much better than the instance where the photoconductive layer was constituted of only the first layer region or the second layer region.

A: Better than the instance where the photoconductive layer was constituted of only the first layer region or the second layer region.

B: Equivalent to the instance where the photoconductive layer was constituted of only the first layer region or the second layer region.

C: Inferior to the instance where the photoconductive layer was constituted of only the first layer region or the second layer region.

Results obtained when compared with the instance where the photoconductive layer was constituted of only the first layer region are shown in Table A2, and the results obtained when compared with the instance where the photoconductive layer was constituted of only the second layer region are shown in Table A3. As is clear from these results, all the chargeability, residual potential, temperature characteristics (of chargeability), memory potential, temperature characteristics of sensitivity and linearity of sensitivity are better than those in the instance where the photoconductive layer is constituted of only the first layer region or the second layer region. In respect of image characteristics, too, better results were found to be obtained than those in that instance. It was also found that similar good results were obtained also when as the exposure light source the LED was replaced with a semiconductor laser (wavelength: 680 nm).

Experiment A2

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under the same conditions as the light-receiving member a of Experiment A1, to produce various light-receiving members in which each second layer region had a different light absorptance. When they were produced, each second layer region was changed to have a layer thickness for absorbing 40%, 50%, 80%, 90% or 92% of light with a 680 nm wavelength.

With regard to the respective light-receiving members thus produced, the chargeability, residual potential, temperature characteristics (of chargeability), memory potential, temperature characteristics of sensitivity and linearity of sensitivity were evaluated according to the following criteria, on the basis of an instance where a photoconductive layer with a layer thickness of 30 μm was constituted of only the first layer region.

AA: Much better than the instance where the photoconductive layer was constituted of only the first layer region.

A: Better than the instance where the photoconductive layer was constituted of only the first layer region.

B: Equivalent to the instance where the photoconductive layer was constituted of only the first layer region.

C: Inferior to the instance where the photoconductive layer was constituted of only the first layer region.

Results obtained are shown in Table A4. As is clear from Table A4, the effect of the present invention is obtained when the second layer region has a layer thickness for absorbing 50% to 90% of light with a 680 nm wavelength. In respect of image characteristics, too, good results were found to be obtained within that range. It was also found that similar good results were obtained also when as the exposure light source the LED was replaced with a semiconductor laser (wavelength: 680 nm).

Experiment A3

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under the same conditions as the light-receiving member b of Experiment A1, to produce various light-receiving members in which each second layer region had a different content of Group IIIb element. When they were produced, the content of the Group IIIb element in the first layer region was set at 6 ppm based on silicon atoms and the content of the Group IIIb element in the second layer was changed so as to be 0.01 ppm 0.03 ppm 0.10 ppm 2 ppm 5 ppm or 5.5 ppm based on silicon atoms. Here, $B_2H_6$ was used as a gas species containing the Group IIIb element, and the content of the Group IIIb element based on silicon atoms was controlled.

With regard to the respective light-receiving members thus produced, the chargeability, residual potential, temperature characteristics (of chargeability), memory potential, temperature characteristics of sensitivity and linearity of sensitivity were evaluated according to the following criteria, on the basis of an instance where a photoconductive layer with a layer thickness of 30 $\mu$m was constituted of only the first layer region.

AA: Much better than the instance where the photoconductive layer was constituted of only the first layer region.

A: Better than the instance where the photoconductive layer was constituted of only the first layer region.

B: Equivalent to the instance where the photoconductive layer was constituted of only the first layer region.

C: Inferior to the instance where the photoconductive layer was constituted of only the first layer region.

Results obtained are shown in Table A5. As is clear from Table A5, the effect of the present invention is obtained when in the second layer region the Group IIIb element is controlled to be in a content of from 0.03 to 5 ppm based on silicon atoms. In respect of image characteristics, too, good results were found to be obtained within that range. It was also found that similar good results were obtained also when as the exposure light source the LED was replaced with a semiconductor laser (wavelength: 680 nm).

Experiment A4

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under the same conditions as the light-receiving member c of Experiment A1, to produce various light-receiving members in which each first layer region had a different content of Group IIIb element. When they were produced, the content of the Group IIIb element in the second layer region was set at 0.13 ppm based on silicon atoms and the content of the Group IIIb element in the first layer region was changed so as to be 0.15 ppm 0.20 ppm 2 ppm 10 ppm 25 ppm or 30 ppm based on silicon atoms. Here, $B_2H_6$ was used as a gas species containing the Group IIIb element, and the content of the Group IIIb element based on silicon atoms was controlled.

With regard to the respective light-receiving members thus produced, the chargeability, residual potential, temperature characteristics (of chargeability), memory potential, temperature characteristics of sensitivity and linearity of sensitivity were evaluated according to the following sail criteria, on the basis of an instance where a photoconductive layer with a layer thickness of 30 $\mu$m was constituted of only the second layer region.

AA: Much better than the instance where the photoconductive layer was constituted of only the second layer region.

A: Better than the instance where the photoconductive layer was constituted of only the second layer region.

B: Equivalent to the instance where the photoconductive layer was constituted of only the second layer region.

C: Inferior to the instance where the photoconductive layer was constituted of only the second layer region.

Results obtained are shown in Table A6. As is clear from Table A6, the effect of the present invention is obtained when in the first layer region the Group IIIb element is controlled to be in a content of from 0.2 to 25 ppm based on silicon atoms. In respect of image characteristics, too, good results were found to be obtained within that range. It was also found that similar good results were obtained also when as the exposure light source the LED was replaced with a semiconductor laser (wavelength: 680 nm).

Experiment A5

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under the same conditions as the light-receiving member d of Experiment A1, to produce various light-receiving members in which each first layer region and second layer contained the Group IIIb element in a different ratio. When they were produced, the content of the Group IIIb element in the first layer region was set constant (6 ppm) based on silicon atoms and the ratio of the content of the Group IIIb element in the first layer region to the content of the Group IIIb element in the second layer region, based on silicon atoms, was changed so as to be 1.1, 1.2, 3, 60, 200 and 600. Here, $B_2H_6$ was used as a gas species containing the Group IIIb element, and the content of the Group IIIb element based on silicon atoms was controlled.

With regard to the respective light-receiving members thus produced, the chargeability, residual potential, temperature characteristics (of chargeability), memory potential, temperature characteristics of sensitivity and linearity of sensitivity were evaluated according to the following criteria, on the basis of an instance where a photoconductive layer with a layer thickness of 30 $\mu$m was constituted of only the first layer region.

AA: Much better than the instance where the photoconductive layer was constituted of only the first layer region.

A: Better than the instance where the photoconductive layer was constituted of only the first layer region.

B: Equivalent to the instance where the photoconductive layer was constituted of only the first layer region.

C: Inferior to the instance where the photoconductive layer was constituted of only the first layer region.

Results obtained are shown in Table A7. As is clear from Table 7, the effect of the present invention is obtained when the ratio of the content of the Group IIIb element in the first layer region to the content of the Group IIIb element in the second layer region, based on silicon atoms, is controlled to be in the range of from 1.2 to 200. In respect of image characteristics, too, good results were found to be obtained within that range. It was also found that similar good results were obtained also when as the exposure light source the LED was replaced with a semiconductor laser (wavelength: 680 nm).

Experiment A6

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter to produce various light-receiving members. When they were produced, the procedure of Experiment A1 was repeated except that the photoconductive layer shown in Table A1 of Experiment A1 was formed in the following way.

(i) The content of the Group IIIb element in the first layer region was changed so as to be from 2 ppm to 0.5 ppm based on silicon atoms, from the charge injection blocking layer side (support side) toward the surface layer side (light-incident side) as shown in FIGS. 5A to 5G each, and the content of the Group IIIb element in the second layer region was set at 0.2 ppm based on silicon atoms.

(ii) The content of the Group IIIb element in the first layer region was set at 2 ppm based on silicon atoms, and the content of the Group IIIb element in the second layer region was changed so as to be from 0.2 ppm to 0.1 ppm based on silicon atoms, from the. photoconductive layer side (support side) toward the surface layer side (light-incident side) as shown in FIGS. 5A to 5G each.

(iii) The content of the Group IIIb element in the first layer region was changed so as to be from 2 ppm to 0.5 ppm based on silicon atoms, from the charge injection blocking layer side (support side) toward the surface layer side (light-incident side) as shown in FIGS. 5A to 5G each, and, for each counterpart thereof, the content of the Group IIIb element in the second layer region was changed so as to be from 0.2 ppm to 0.1 ppm based on silicon atoms, from the photoconductive layer side (support side) toward the surface layer side (light-incident side) as shown in FIGS. 5A to 5G each.

With regard to the respective light-receiving members thus produced, evaluation was made in the same manner as in Experiment A1. As a result, like Experiment A1, good results were obtained on all the chargeability, residual potential, temperature characteristics (of chargeability), memory potential, temperature characteristics of sensitivity, linearity of sensitivity and image characteristics. It was also found that similar good results were obtained also when as the exposure light source the LED was replaced with a semiconductor laser (wavelength: 680 nm).

Experiment A7

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under conditions as shown in Table A8, to produce a light-receiving member. The photoconductive layer was formed in the order of the first layer region and the second layer region (a region with a layer thickness for absorbing 70% of light with a 680 nm wavelength). $B_2H_6$ was used as a gas species containing the Group IIIb element, and the content of the Group IIIb element based on silicon atoms was controlled.

Meanwhile, the aluminum cylinder was replaced with a cylindrical sample holder having been worked to have grooves for setting sample substrates. Glass substrates (7059; available from Corning Glass Works) and silicon (Si) wafers were set on the sample holder, and a-Si films of about 1 $\mu$m in layer thickness were deposited under the same conditions as the formation of the photoconductive layer. The deposited films formed on the glass substrates were examined to measure their optical band gaps (Eg), and thereafter Cr comb electrodes were formed thereon by vacuum deposition, where the characteristic energy at the exponential tail (Eu) was measured by CPM. In respect of the deposited films on the Si wafers, the hydrogen content (Ch) was measured by FTIR.

In the photoconductive layer of the light-receiving member produced under the conditions shown in Table A8, the Ch, Eg and Eu were 20 atom %, 1.75 eV and 55 meV, respectively (light-receiving member e).

Next, films were formed in the same manner but variously changing in Table A8 the mixing ratio of $SiH_4$ gas to $H_2$ gas, the ratio of $SiH_4$ gas flow rate to discharge power and the support temperature, to produce various light-receiving members in which the Ch, Eg and Eu of the photoconductive layer were 10 atom %, 1.68 eV and 47 meV, respectively (light-receiving member f); 15 atom %, 1.7 eV and 50 meV (light-receiving member g); and 18 atom %, 1.73 eV and 53 meV (light-receiving member h).

With regard to the respective light-receiving members e to h, evaluation was made in the same manner as in Experiment A1. As a result, like Experiment A1, all the chargeability, residual potential, temperature characteristics (of chargeability), memory potential, temperature characteristics of sensitivity, linearity of sensitivity and image characteristics were found to be good. It was also found that similar good results were obtained also when as the exposure light source the LED was replaced with a semiconductor laser (wavelength: 680 nm).

Experiment A8

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under the same conditions as the light-receiving member e of Experiment A7, to produce various light-receiving members in which each second layer region had a different light absorptance. When they were produced, each second layer region was changed to have a layer thickness for absorbing 40%, 50%, 80%, 90% or 92% of light with a 680 nm wavelength.

With regard to the respective light-receiving members thus produced, the chargeability, residual potential, temperature characteristics (of chargeability), memory potential, temperature characteristics of sensitivity, linearity of sensitivity and image characteristics were evaluated in the same manner as in Experiment A2. As a result, like Experiment A2, the effect of the present invention was obtained when the second layer region had a layer thickness for absorbing 50% to 90% of light with a 680 nm wavelength. In respect of image characteristics, too, good results were found to be obtained within that range. It was also found that similar good results were obtained also when as the exposure light source the LED was replaced with a semiconductor laser (wavelength: 680 nm).

Experiment A9

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under the same conditions as the light-receiving member f of Experiment A7, to produce various light-receiving members in which each second layer region had a different content of Group IIIb element. When they were produced, the content of the Group IIIb element in the first layer region was set at 6 ppm based on silicon atoms and the content of the Group IIIb element in the second layer was changed so as to be 0.01 ppm 0.03 ppm 0.1 ppm 2 ppm 5 ppm or 5.5 ppm based on silicon atoms.

With regard to the respective light-receiving members thus produced, the chargeability, residual potential, temperature characteristics (of chargeability), memory potential, temperature characteristics of sensitivity, linearity of sensitivity and image characteristics were evaluated in the same manner as in Experiment A3. As a result, like Experiment A3, the effect of the present invention was obtained when in the second layer region the Group IIIb element was controlled to be in a content of from 0.03 to 5 ppm based on silicon atoms. In respect of image characteristics, too, good results were found to be obtained within that range. It was also found that similar good results were obtained also when as the exposure light source the LED was replaced with a semiconductor laser (wavelength: 680 nm).

Experiment A10

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under the same conditions as the light-receiving member g of Experiment A7, to produce various light-receiving members in which each first layer region had a different content of Group IIIb element. When they were produced, the content of the Group IIIb element in the second layer region was set at 0.13 ppm based on silicon atoms and the content of the Group IIIb element in the first layer region was changed so as to be 0.15 ppm 0.2 ppm 2 ppm 10 ppm 25 ppm or 30 ppm based on silicon atoms.

With regard to the respective light-receiving members thus produced, the chargeability, residual potential, temperature characteristics (of chargeability), memory potential, temperature characteristics of sensitivity, linearity of sensitivity and image characteristics were evaluated in the same manner as in Experiment A4. As a result, like Experiment A4, the effect of the present invention was obtained when in the first layer region the Group IIIb element was controlled to be in a content of from 0.2 to 25 ppm based on silicon atoms. In respect of image characteristics, too, good results were found to be obtained within that range. It was also found that similar good results were obtained also when as the exposure light source the LED was replaced with a semiconductor laser (wavelength: 680 nm).

Experiment A11

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under the same conditions as the light-receiving member h of Experiment A7, to produce various light-receiving members in which each first layer region and second layer contained the Group IIIb element in a different ratio. When they were produced, the content of the Group IIIb element in the first layer region was set constant (6 ppm) based on silicon atoms and the ratio of the content of the Group IIIb element in the first layer region to the content of the Group IIIb element in the second layer region, based on silicon atoms, was changed so as to be 1.1, 1.2, 3, 60, 200 and 600.

With regard to the respective light-receiving members thus produced, the chargeability, residual potential, temperature characteristics (of chargeability), memory potential, temperature characteristics of sensitivity, linearity of sensitivity and image characteristics were evaluated in the same manner as in Experiment A5. As a result, like Experiment A5, the effect of the present invention was obtained when the ratio of the content of the Group IIIb element in the first layer region to the content of the Group IIIb element in the second layer region, based on silicon atoms, was controlled to be in the range of from 1.2 to 200. In respect of image characteristics, too, good results were found to be obtained within that range. It was also found that similar good results were obtained also when as the exposure light source the LED was replaced with a semiconductor laser (wavelength: 680 nm).

Experiment A12

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter to produce various light-receiving members. When they were produced, the procedure of Experiment A7 was repeated except that the photoconductive layer shown in Table A8 of Experiment A7 was formed in the following way.

(i) The content of the Group IIIb element in the first layer region was changed so as to be from 2 ppm to 0.5 ppm based on silicon atoms, from the charge injection blocking layer side (support side) toward the surface layer side (light-incident side) as shown in FIGS. 5A to 5G each, and the content of the Group IIIb element in the second layer region was set at 0.2 ppm based on silicon atoms.

(ii) The content of the Group IIIb element in the first layer region was set at 2 ppm based on silicon atoms, and the content of the Group IIIb element in the second layer region was changed so as to be from 0.2 ppm to 0.1 ppm based on silicon atoms, from the photoconductive layer side (support side) toward the surface layer side (light-incident side) as shown in FIGS. 5A to 5G each.

(iii) The content of the Group IIIb element in the first layer region was changed so as to be from 2 ppm to 0.5 ppm based on silicon atoms, from the charge injection blocking layer side (support side) toward the surface layer side (light-incident side) as shown in FIGS. 5A to 5G each, and, for each counterpart thereof, the content of the Group IIIb element in the second layer region was changed so as to be from 0.2 ppm to 0.1 ppm based on silicon atoms, from the photoconductive layer side (support side) toward the surface layer side (light-incident side) as shown in FIGS. 5A to 5G each.

With regard to the respective light-receiving members thus produced, evaluation was made in the same manner as in Experiment A1. As a result, like Experiment A1, good results were obtained on all the chargeability, residual potential, temperature characteristics (of chargeability), memory potential, temperature characteristics of sensitivity, linearity of sensitivity and image characteristics. It was also found that similar good results were obtained also when as the exposure light source the LED was replaced with a semiconductor laser (wavelength: 680 nm).

Experiment A13

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under conditions as shown in Table A9, to produce a light-receiving member. The photoconductive layer was formed in the order of the first layer region and the second layer region (a region with a layer thickness for absorbing 70% of light with a 680 nm wavelength). $B_2H_6$ was used as a gas species containing the Group IIIb element, and the content of the Group IIIb element based on silicon atoms was controlled.

Meanwhile, the aluminum cylinder was replaced with a cylindrical sample holder having been worked to have grooves for setting sample substrates. Glass substrates (7059; available from Corning Glass Works) and silicon (Si) wafers were set on the sample holder, and a-Si films of about 1 $\mu$m in layer thickness were deposited under the same conditions as the formation of the photoconductive layer. The deposited films formed on the glass substrates were examined to measure their optical band gaps (Eg), and thereafter Cr comb electrodes were formed thereon by vacuum deposition, where the characteristic energy at the exponential tail (Eu) was measured by CPM. In respect of the deposited films on the Si wafers, the hydrogen content (Ch) was measured by FTIR.

In the photoconductive layer of the light-receiving member produced under the conditions shown in Table A9, the Ch, Eg and Eu were 30 atom %, 1.84 eV and 53 meV, respectively (light-receiving member i).

Next, films were formed in the same manner but variously changing in Table A9 the mixing ratio of $SiH_4$ gas to $H_2$ gas, the ratio of $SiH_4$ gas flow rate to discharge power and the support temperature, to produce various light-receiving members in which the Ch, Eg and Eu of the photoconductive layer were 25 atom %, 1.80 eV and 47 meV, respectively (light-receiving member j); 33 atom %, 1.85 eV and 54 meV (light-receiving member k); and 35 atom %, 1.87 eV and 55 meV (light-receiving member l).

With regard to the respective light-receiving members i to l, evaluation was made in the same manner as in Experiment A1. As a result, like Experiment A1, all the chargeability, residual potential, temperature characteristics (of chargeability), memory potential, temperature characteristics of sensitivity, linearity of sensitivity and image characteristics were found to be good. It was also found that similar good results were obtained also when as the exposure light source the LED was replaced with a semiconductor laser (wavelength: 680 nm).

Experiment A14

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under the same conditions as the light-receiving member i of Experiment A13, to produce various light-receiving members in which each second layer region had a different light absorptance. When they were produced, each second layer region was changed to have a layer thickness for absorbing 40%, 50%, 80%, 90% or 92% of light with a 680 nm wavelength.

With regard to the respective light-receiving members thus produced, the chargeability, residual potential, temperature characteristics (of chargeability), memory potential, temperature characteristics of sensitivity, linearity of sensitivity and image characteristics were evaluated in the same manner as in Experiment A2. As a result, like Experiment A2, the effect of the present invention was obtained when the second layer region had a layer thickness for absorbing 50% to 90% of light with a 680 nm wavelength. In respect of image characteristics, too, good results were found to be obtained within that range. It was also found that similar good results were obtained also when as the exposure light source the LED was replaced with a semiconductor laser (wavelength: 680 nm).

Experiment A15

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under the same conditions as the light-receiving member j of Experiment A13, to produce various light-receiving members in which each second layer region had a different content of Group IIIb element. When they were produced, the content of the Group IIIb element in the first layer region was set at 6 ppm based on silicon atoms and the content of the Group IIIb element in the second layer was changed so as to be 0.01 ppm 0.03 ppm 0.1 ppm 2 ppm 5 ppm or 5.5 ppm based on silicon atoms.

With regard to the respective light-receiving members thus produced, the chargeability, residual potential, temperature characteristics (of chargeability), memory potential, temperature characteristics of sensitivity, linearity of sensitivity and image characteristics were evaluated in the same manner as in Experiment A3. As a result, like Experiment A3, the effect of the present invention was obtained when in the second layer region the Group IIIb element was controlled to be in a content of from 0.03 to 5 ppm based on silicon atoms. In respect of image characteristics, too, good results were found to be obtained within that range. It was also found that similar good results were obtained also when as the exposure light source the LED was replaced with a semiconductor laser (wavelength: 680 nm).

Experiment A16

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under the same conditions as the light-receiving member k of Experiment A13, to produce various light-receiving members in which each first layer region had a different content of Group IIIb element. When they were produced, the content of the Group IIIb element in the second layer region was set at 0.13 ppm based on silicon atoms and the content of the Group IIIb element in the first layer region was changed so as to be 0.15 ppm 0.2 ppm 2 ppm 10 ppm 25 ppm or 30 ppm based on silicon atoms.

With regard to the respective light-receiving members thus produced, the chargeability, residual potential, temperature characteristics (of chargeability), memory potential, temperature characteristics of sensitivity, linearity of sensitivity and image characteristics were evaluated in the same manner as in Experiment A4. As a result, like Experiment A4, the effect of the present invention was obtained when in the first layer region the Group IIIb element was controlled to be in a content of from 0.2 to 25 ppm based on silicon atoms. In respect of image characteristics, too, good results were found to be obtained within that range. It was also found that similar good results were obtained also when as the exposure light source the LED was replaced with a semiconductor laser (wavelength: 680 nm).

Experiment A17

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under the same conditions as the light-receiving member l of Experiment A13, to produce various light-receiving members in which each first layer region and second layer contained the Group IIIb element in a different ratio. When they were produced, the content of the Group IIIb element in the first layer region was set constant (6 ppm) based on silicon atoms and the ratio of the content of the Group IIIb element in the first layer region to the content of the Group IIIb element in the second layer region, based on silicon atoms, was changed so as to be 1.1, 1.2, 3, 60, 200 and 600.

With regard to the respective light-receiving members thus produced, the chargeability, residual potential, temperature characteristics (of chargeability), memory potential, temperature characteristics of sensitivity, linearity of sensitivity and image characteristics were evaluated in the same manner as in Experiment A5. As a result, like Experiment A5, the effect of the present invention was obtained when the ratio of the content of the Group IIIb element in the first layer region to the content of the Group IIIb element in the second layer region, based on silicon atoms, was controlled to be in the range of from 1.2 to 200. In respect of image characteristics, too, good results were found to be obtained within that range. It was also found that similar good results were obtained also when as the exposure light source the LED was replaced with a semiconductor laser (wavelength: 680 nm).

Experiment A18

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter to produce various light-receiving members. When they were produced, the procedure of Experiment A13 was repeated except that the photoconductive layer shown in Table A9 of Experiment A13 was formed in the following way.

(i) The content of the Group IIIb element in the first layer region was changed so as to be from 2 ppm to 0.5 ppm based on silicon atoms, from the charge injection blocking layer side (support side) toward the surface layer side (light-incident side) as shown in FIGS. 5A to 5G each, and the content of the Group IIIb element in the second layer region was set at 0.2 ppm based on silicon atoms.

(ii) The content of the Group IIIb element in the first layer region was set at 2 ppm based on silicon atoms, and the content of the Group IIIb element in the second layer region was changed so as to be from 0.2 ppm to 0.1 ppm based on silicon atoms, from the photoconductive layer side (support side) toward the surface layer side (light-incident side) as shown in FIGS. 5A to 5G each.

(iii) The content of the Group IIIb element in the first layer region was changed so as to be from 2 ppm to 0.5 ppm based on silicon atoms, from the charge injection blocking layer side (support side) toward the surface layer side (light-incident side) as shown in FIGS. 5A to 5G each, and, for each counterpart thereof, the content of $B_2H_6$ in the second layer region was changed so as to be from 0.2 ppm to 0.1 ppm based on $SiH_4$, from the photoconductive layer side (support side) toward the surface layer side (light-incident side) as shown in FIGS. 5A to 5G each.

With regard to the respective light-receiving members thus produced, evaluation was made in the same manner as in Experiment A1. As a result, like Experiment A1, good results were obtained on all the chargeability, residual potential, temperature characteristics (of chargeability), memory potential, temperature characteristics of sensitivity, linearity of sensitivity and image characteristics. It was also found that similar good results were obtained also when as the exposure light source the LED was replaced with a semiconductor laser (wavelength: 680 nm).

Experiment B1

Using the apparatus shown in FIG. 4, for producing light-receiving members by RF-PCVD, a charge injection blocking layer, a photoconductive layer and a surface layer were formed on a mirror-finished aluminum cylinder (support) of 108 mm diameter under conditions as shown in Table B1, to produce a light-receiving member. The photoconductive layer was formed in the order of the first layer region and the second layer region.

Meanwhile, the aluminum cylinder was replaced with a cylindrical sample holder having been worked to have grooves for setting sample substrates. Glass substrates (7059; available from Corning Glass Works) and silicon (Si) wafers were set on the sample holder, and a-Si films of about 1 $\mu$m in layer thickness were deposited thereon under the same conditions as the formation of the photoconductive layer. The deposited films formed on the glass substrates were examined to measure their optical band gaps (Eg), and thereafter Cr comb electrodes were formed thereon by vacuum deposition, where the characteristic energy at the exponential tail (Eu) was measured by CPM. In respect of the deposited films on the Si wafers, the hydrogen content (Ch) was measured by FTIR (Fourier transformation infrared absorption spectroscopy).

In the first layer region of the photoconductive layer of the light-receiving member produced under the conditions shown in Table B1, the Ch, Eg and Eu were 28 atom %, 1.80 eV and 58 meV, respectively, and in the second layer region, 14 atom %, 1.72 eV and 53 meV, respectively.

Next, films were formed in the same manner but variously changing in the second layer region the $SiH_4$ gas flow rate, the mixing ratio of $SiH_4$ gas to $H_2$ gas, the ratio of $SiH_4$ gas flow rate to discharge power and the support temperature, to produce various light-receiving members in which each second layer region of the photoconductive layer had different Eg (Ch) and Eu. The layer thickness of the first and second layer regions were fixed at 24 $\mu$m and 6 $\mu$m, respectively.

The light-receiving members thus produced were each set in an electrophotographic apparatus (NP-6650, manufactured by CANON INC., modified for testing), to make evaluation of potential characteristics.

In this evaluation, process speed was set at 380 mm/sec, pre-exposure (a 700 nm wavelength LED) at 4 lux·sec, and electric current value of its charging assembly at 1,000 $\mu$A, under conditions of which the surface potential of the light-receiving member was measured using a potential sensor of a surface potentiometer (Model 344, manufactured by Trek Co.) set at the position of the developing assembly of the electrophotographic apparatus, and the value obtained was used to represent chargeability.

Temperature of the light-receiving member was changed from room temperature (about 25° C.) to 45° C. by means of a built-in drum heater, and the chargeability was measured under such conditions. Changes in chargeability per temperature 1° C. during the measurement was used to represent the temperature characteristics of chargeability.

Then, charging conditions were so set as to provide a dark potential of 400 V for each of room temperature and 45° C., and, using a 680 nm wavelength LED as an exposure light source, the E-V characteristics (E-V curves) were measured to evaluate the temperature characteristics of sensitivity and the linearity of sensitivity.

In respect of the photomemory, the 680 nm wavelength LED was used as an exposure light source, and the potential difference between the surface potential in an unexposed state and the surface potential at the time when the surface was once exposed and thereafter again charged was measured. The value obtained was used to represent memory potential.

The relationship between the Eu and Eg and each of the chargeability, temperature characteristics of chargeability, photomemory, temperature characteristics of sensitivity and linearity of sensitivity in the present Experiment was examined. The results in respect of the second layer region are shown in FIGS. 6 to 10. In these drawings, the values on the ordinate are relative values of an instance assumed as 1 where a photoconductive layer (total layer thickness: 30 μm) was constituted of only the first layer region; showing that, the greater the value, the more improved.

As is clear also from FIGS. 6 to 10, it was found that good characteristics were obtained on all the chargeability, temperature characteristics of chargeability, photomemory, temperature characteristics of sensitivity and linearity of sensitivity under the conditions that in the first layer region the Eg was from 1.75 to 1.85 eV, the Eu was from 55 to 65 meV and the hydrogen atom content (Ch) was from 20 atom % to 30 atom %, and in the second layer region the Eg was from 1.70 to 1.80 eV, the Eu was 55 meV or below and the Ch was from 10 atom % to 25 atom %.

Experiment B2

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter under conditions as shown in Table B2, to produce a light-receiving member. The photoconductive layer was formed in the order of the first layer region and the second layer region.

Meanwhile, the aluminum cylinder was replaced with a cylindrical sample holder having been worked to have grooves for setting sample substrates. Glass substrates (7059; available from Corning Glass Works) and silicon (Si) wafers were set on the sample holder, and a-Si films of about 1 μm in layer thickness were deposited thereon under the same conditions as the formation of the photoconductive layer. The deposited films formed on the glass substrates were examined to measure their optical band gaps (Eg), and thereafter Cr comb electrodes were formed thereon by vacuum deposition, where the characteristic energy at the exponential tail (Eu) was measured by CPM. In respect of the deposited films on the Si wafers, the hydrogen content (Ch) was measured by FTIR (Fourier transformation infrared absorption spectroscopy).

In the first layer region of the photoconductive layer of the light-receiving member produced under the conditions shown in Table B2, the Ch, Eg and Eu were 29 atom %, 1.83 eV and 54 meV, respectively, and in the second layer region the Ch, Eg and Eu were 16 atom %, 1.73 eV and 54 meV, respectively.

Next, films were formed in the same manner but variously changing in the second layer region the $SiH_4$ gas flow rate, the mixing ratio of $SiH_4$ gas to $H_2$ gas, the ratio of $SiH_4$ gas flow rate to discharge power and the support temperature, to produce various light-receiving members in which each second layer region of the photoconductive layer had different Eg (Ch) and Eu. Then, with regard to the light-receiving members thus produced, the potential characteristics were evaluated in the same manner as in Experiment B1, and the relationship between the Eu and Eg and each of the chargeability, temperature characteristics of chargeability, photomemory, temperature characteristics of sensitivity and linearity of sensitivity was examined in the same manner as in Experiment B1. As a result, the same tendency as the results of Experiment B1 was shown, and it was found that good characteristics were obtained on all the chargeability, temperature characteristics of chargeability, photomemory, temperature characteristics of sensitivity and linearity of sensitivity under the conditions that in the first layer region the Eg was from 1.80 to 1.90 eV, the Eu was 55 meV or below and the hydrogen atom content (Ch) was from 25 atom % to 40 atom %, and in the second layer region the Eg was from 1.70 to 1.80 eV, the Eu was 55 meV or below and the Ch was from 10 atom % to 25 atom %.

Experiment B3

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter under conditions as shown in Table B3, to produce a light-receiving member. The photoconductive layer was formed in the order of the first layer region and the second layer region.

Meanwhile, the aluminum cylinder was replaced with a cylindrical sample holder having been worked to have grooves for setting sample substrates. Glass substrates (7059; available from Corning Glass Works) and silicon (Si) wafers were set on the sample holder, and a-Si films of about 1 μm in layer thickness were deposited thereon under the same conditions as the formation of the photoconductive layer. The deposited films formed on the glass substrates were examined to measure their optical band gaps (Eg), and thereafter Cr comb electrodes were formed thereon by vacuum deposition, where the characteristic energy at the exponential tail (Eu) was measured by CPM. In respect of the deposited films on the Si wafers, the hydrogen content (Ch) was measured by FTIR (Fourier transformation infrared absorption spectroscopy).

In the first layer region of the photoconductive layer of the light-receiving member produced under the conditions shown in Table B3, the Ch, Eg and Eu were 28 atom %, 1.82 eV and 53 meV, respectively, and in the second layer region the Ch, Eg and Eu were 15 atom %, 1.75 eV and 54 meV, respectively.

Here, as the content of the Group IIIb element in the photoconductive layer, in its second layer region the content in the surface-side layer region necessary for absorbing 50%, 60%, 70%, 80% or 90% of peak wavelength light of imagewise exposure light was set at 0.3 ppm and the content in the other region was uniformly set at 1.0 ppm to produce various light-receiving members having the Group IIIb element in different content. In addition, in respect of each of these light-receiving members, the ratio of the layer thickness of the second layer region to the total layer thickness (30 μm) of the photoconductive layer was changed.

With regard to the light-receiving members thus produced, the potential characteristics were evaluated in the same manner as in Experiment B1. The relationship between the content distribution and layer thickness ratio and the chargeability, temperature characteristics of chargeability, photomemory, temperature characteristics of sensitivity and linearity of sensitivity was examined to obtain the results as shown in FIGS. 11 to 15. In these drawings, the values on the ordinate are relative values of an instance assumed as 1 where the Group IIIb element was incorporated uniformly into the whole photoconductive layer in a content of 1.0 ppm; showing that, the greater the value, the more improved.

As is clear from FIGS. 11 to 15, it was found that, compared with the one in which the Group IIIb element was uniformly incorporated, the light-receiving members in which the content of the Group IIIb element in the surface-side layer region necessary for absorbing 70% or more of peak wavelength light of imagewise exposure light in the second layer region was smaller than that in the support-side first layer region were improved in the level of characteristics of all the chargeability, temperature characteristics of chargeability, photomemory, temperature characteristics of sensitivity and linearity of sensitivity, when the layer thickness ratio was from 0.05 to 0.5.

Experiment B4

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter under conditions as shown in Table B4, to produce a light-receiving member. The photoconductive layer was formed in the order of the first layer region and the second layer region.

Meanwhile, the aluminum cylinder was replaced with a cylindrical sample holder having been worked to have grooves for setting sample substrates. Glass substrates (7059; available from Corning Glass Works) and silicon (Si) wafers were set on the sample holder, and a-Si films of about 1 $\mu$m in layer thickness were deposited thereon under the same conditions as the formation of the photoconductive layer. The deposited films formed on the glass substrates were examined to measure their optical band gaps (Eg), and thereafter Cr comb electrodes were formed thereon by vacuum deposition, where the characteristic energy at the exponential tail (Eu) was measured by CPM. In respect of the deposited films on the Si wafers, the hydrogen content (Ch) was measured by FTIR (Fourier transformation infrared absorption spectroscopy).

In the first layer region of the photoconductive layer of the light-receiving member produced under the conditions shown in Table B4, the Ch,. Eg and Eu were 24 atom %, 1.81 eV and 58 meV, respectively, and in the second layer region the Ch, Eg and Eu were 14 atom %, 1.76 eV and 53 meV, respectively.

Here, as the content of the Group IIIb element in the photoconductive layer, in its second layer region the content in the surface-side layer region necessary for absorbing 50%, 60%, 70%, 80% or 90% of peak wavelength light of imagewise exposure light was set at 0.3 ppm and the content in the other region was set at 1.0 ppm to produce various light-receiving members having the Group IIIb element in different content. In addition, in respect of each of these light-receiving members, the ratio of the layer thickness of the second layer region to the total layer thickness (30 $\mu$m) of the photoconductive layer was changed.

With regard to the light-receiving members thus produced, the potential characteristics were evaluated in the same manner as in Experiment B1. The relationship between the content distribution and layer thickness ratio and the chargeability, temperature characteristics of chargeability, photomemory, temperature characteristics of sensitivity and linearity of sensitivity showed the same tendency as that in Experiment B3. More specifically, it was found that, compared with the one in which the Group IIIb element was uniformly incorporated, the light-receiving members in which the content of the Group IIIb element in the surface-side layer region necessary for absorbing 70% or more of peak wavelength light of imagewise exposure light in the second layer region was smaller than that in the support-side first layer region were improved in the level of characteristics of all the chargeability, temperature characteristics of chargeability, photomemory, temperature characteristics of sensitivity and linearity of sensitivity, when the layer thickness ratio was from 0.05 to 0.5.

EXAMPLES

The present invention will be described below in greater detail by giving Examples. The present invention is by no means limited to these.

Example A1

Using the production apparatus shown in FIG. 4, a light-receiving member having a surface layer in which its silicon atom content and carbon atom content were distributed non-uniformly in the layer thickness direction was produced under conditions as shown in Table A10. Here, $B_2H_6$ was used as a gas species containing the Group IIIb element, and the content of the Group IIIb element based on silicon atoms was controlled. In the photoconductive layer formed under the conditions shown in Table A10, the Ch, Eg and Eu were 25 atom %, 1.81 eV and 57 meV, respectively [light-receiving member a)].

Then, films were formed in the same manner but variously changing in Table A10 the mixing ratio of $SiH_4$ gas to $H_2$ gas, the ratio of $SiH_4$ gas flow rate to discharge power and the support temperature, to produce various light-receiving members in which the Ch, Eg and Eu of the photoconductive layer had the following values.

(i) Light-receiving members b) to e) in which the Ch, Eg and Eu of the photoconductive layer were from 10 to 30 atom %, from 1.75 to 1.85 eV and from 55 to 65 meV, respectively, i.e.:
b) 22 atom %, 1.81 eV, 60 meV;
c) 10 atom %, 1.75 eV, 55 meV;
d) 28 atom %, 1.83 eV, 62 meV; and
e) 30 atom %, 1.85 eV, 65 meV.

(ii) Light-receiving members f) to i) in which the Ch, Eg and Eu of the photoconductive layer were from 10 to 20 atom %, 1.75 eV or below and 55 meV or below, respectively, i.e.:
f) 20 atom %, 1.75 eV, 55 meV;
g) 10 atom %, 1.68 eV, 47 meV;
h) 15 atom %, 1.70 eV, 50 meV; and
i) 19 atom %, 1.74 eV, 53 meV.

(iii) Light-receiving members j) to m) in which the Ch, Eg and Eu of the photoconductive layer were from 25 to 35 atom %, 1.80 eV or above and 55 meV or below, respectively, i.e.:
j) 32 atom %, 1.85 eV, 53 meV;
k) 25 atom %, 1.80 eV, 47 meV;
1) 34 atom %, 1.85 eV, 54 meV; and
m) 35 atom %, 1.87 eV, 55 meV.

With regard to the respective light-receiving members a) to m) thus produced, evaluation was made in the same manner as in Experiment A1. As a result, like Experiment A1, good results were obtained on all the chargeability, residual potential, temperature characteristics (of chargeability), memory potential, temperature characteristics of sensitivity, linearity of sensitivity and image characteristics. It was also found that similar good results were obtained also when as the exposure light source the LED was replaced with a semiconductor laser (wavelength: 680 nm).

Namely, it is seen that the present invention can achieve good electrophotographic performances also when the surface layer is provided in which its silicon atom content and carbon atom content are distributed non-uniformly in the layer thickness direction.

Example A2

Using the production apparatus shown in FIG. 4, a light-receiving member having a surface layer in which its silicon atom content and carbon atom content were distributed non-uniformly in the layer thickness direction, and containing fluorine atoms, boron atoms, carbon atoms, oxygen atoms and nitrogen atoms in all the layers was produced under conditions as shown in Table A11. Here, $B_2H_6$ was used as a gas species containing the Group IIIb element, and the content of the Group IIIb element based on silicon atoms was controlled. In the photoconductive layer formed under the conditions shown in Table A11, the Ch, Eg and Eu were 23 atom %, 1.82 eV and 56 meV, respectively.

Then, films were formed in the same manner but variously changing in Table A11 the mixing ratio of $SiH_4$ gas to $H_2$ gas, the ratio of $SiH_4$ gas flow rate to discharge power and the support temperature, to produce, like Example A1, the following light-receiving members.

(i) Light-receiving members in which the Ch, Eg and Eu of the photoconductive layer were from 10 to 30 atom %, from 1.75 to 1.85 eV and from 55 to 65 meV, respectively.

(ii) Light-receiving members in which the Ch, Eg and Eu of the photoconductive layer were from 10 to 20 atom %, 1.75 eV or below and 55 meV or below, respectively.

(iii) Light-receiving members in which the Ch, Eg and Eu of the photoconductive layer were from 25 to 35 atom %, 1.80 eV or above and 55 meV or below, respectively.

With regard to the various light-receiving members thus produced, evaluation was made in the same manner as in Experiment A1. As a result, like Experiment A1, good results were obtained on all the chargeability, residual potential, temperature characteristics (of chargeability), memory potential, temperature characteristics of sensitivity, linearity of sensitivity and image characteristics. It was also found that similar good results were obtained also when as the exposure light source the LED was replaced with a semiconductor laser (wavelength: 680 nm).

Namely, it is seen that the present invention can achieve good electrophotographic performances also when the surface layer is provided in which its silicon atom content and carbon atom content are distributed non-uniformly in the layer thickness direction, and fluorine atoms, boron atoms, carbon atoms, oxygen atoms and nitrogen atoms are incorporated in all the layers.

Example A3

Using the production apparatus shown in FIG. 4, a light-receiving member in which, in place of carbon atoms, nitrogen atoms were incorporated into the surface layer as atoms constituting the surface layer was produced under conditions as shown in Table A12. Here, $B_2H_6$ was used as a gas species containing the Group IIIb element, and the content of the Group IIIb element based on silicon atoms was controlled. In the photoconductive layer formed under the conditions shown in Table A12, the Ch, Eg and Eu were 28 atom %, 1.83 eV and 57 meV, respectively.

Then, films were formed in the same manner but variously changing in Table A12 the mixing ratio of $SiH_4$ gas to $H_2$ gas, the ratio of $SiH_4$ gas flow rate to discharge power and the support temperature, to produce, like Example A1, the following light-receiving members.

(i) Light-receiving members in which the Ch, Eg and Eu of the photoconductive layer were from 10 to 30 atom %, from 1.75 to 1.85 eV and from 55 to 65 meV, respectively.

(ii) Light-receiving members in which the Ch, Eg and Eu of the photoconductive layer were from 10 to 20 atom %, 1.75 eV or below and 55 meV or below, respectively.

(iii) Light-receiving members in which the Ch, Eg and Eu of the photoconductive layer were from 25 to 35 atom %, 1.80 eV or above and 55 meV or below, respectively.

With regard to the various light-receiving members thus produced, evaluation was made in the same manner as in Experiment A1. As a result, like Experiment A1, good results were obtained on all the chargeability, residual potential, temperature characteristics (of chargeability), memory potential, temperature characteristics of sensitivity, linearity of sensitivity and image characteristics. It was also found that similar good results were obtained also when as the exposure light source the LED was replaced with a semiconductor laser (wavelength: 680 nm).

Namely, it is seen that the present invention can achieve good electrophotographic performances also when, in place of carbon atoms, nitrogen atoms are incorporated into the surface layer as atoms constituting the surface layer.

Example A4

Using the production apparatus shown in FIG. 4, a light-receiving member in which nitrogen atoms and oxygen atoms were incorporated as atoms constituting the surface layer was produced under conditions as shown in Table A13. Here, $B_2H_6$ was used as a gas species containing the Group IIIb element, and the content of the Group IIIb element based on silicon atoms was controlled. In the photoconductive layer formed under the conditions shown in Table A13, the Ch, Eg and Eu were 25 atom %, 1.82 eV and 55 meV, respectively.

Then, films were formed in the same manner but variously changing in Table A13 the mixing ratio of $SiH_4$ gas to $H_2$ gas, the ratio of $SiH_4$ gas flow rate to discharge power and the support temperature, to produce, like Example A1, the following light-receiving members.

(i) Light-receiving members in which the Ch, Eg and Eu of the photoconductive layer were from 10 to 30 atom %, from 1.75 to 1.85 eV and from 55 to 65 meV, respectively.

(ii) Light-receiving members in which the Ch, Eg and Eu of the photoconductive layer were from 10 to 20 atom %, 1.75 eV or below and 55 meV or below, respectively.

(iii) Light-receiving members in which the Ch, Eg and Eu of the photoconductive layer were from 25 to 35 atom %, 1.80 eV or above and 55 meV or below, respectively.

With regard to the various light-receiving members thus produced, evaluation was made in the same manner as in Experiment A1. As a result, like Experiment A1, good results were obtained on all the chargeability, residual potential, temperature characteristics (of chargeability), memory potential, temperature characteristics of sensitivity, linearity of sensitivity and image characteristics. It was also found that similar good results were obtained also when as the exposure light source the LED was replaced with a semiconductor laser (wavelength: 680 nm).

Namely, it is seen that the present invention can achieve good electrophotographic performances also when the surface layer incorporated with nitrogen atoms and oxygen atoms as atoms constituting the surface layer is provided.

Example A5

Using the production apparatus shown in FIG. 4, a light-receiving member was produced under conditions as shown in Table A14, i.e., forming no charge injection blocking layer, and using $C_2H_2$ gas as the carbon source in place of $CH_3$ gas to form a photoconductive layer and a surface layer both containing carbon atoms. Here, $B_2H_6$ was used as a gas species containing the Group IIIb element, and the content of the Group IIIb element based on silicon atoms was controlled. In the photoconductive layer formed under the conditions shown in Table A14, the Ch, Eg and Eu were 22 atom %, 1.82 eV and 55 meV, respectively.

Then, films were formed in the same manner but variously changing in Table A14 the mixing ratio of $SiH_4$ gas to $H_2$ gas, the ratio of $SiH_4$ gas flow rate to discharge power and the support temperature, to produce, like Example A1, the following light-receiving members.

(i) Light-receiving members in which the Ch, Eg and Eu of the photoconductive layer were from 10 to 30 atom %, from 1.75 to 1.85 eV and from 55 to 65 meV, respectively.

(ii) Light-receiving members in which the Ch, Eg and Eu of the photoconductive layer were from 10 to 20 atom %, 1.75 eV or below and 55 meV or below, respectively.

(iii) Light-receiving members in which the Ch, Eg and Eu of the photoconductive layer were from 25 to 35 atom %, 1.80 eV or above and 55 meV or below, respectively.

With regard to the various light-receiving members thus produced, evaluation was made in the same manner as in Experiment A1. As a result, like Experiment A1, good results were obtained on all the chargeability, residual potential, temperature characteristics (of chargeability), memory potential, temperature characteristics of sensitivity, linearity of sensitivity and image characteristics. It was also found that similar good results were obtained also when as the exposure light source the LED was replaced with a semiconductor laser (wavelength: 680 nm).

Namely, it is seen that the present invention can achieve good electrophotographic performances also when no charge injection blocking layer is provided and $C_2H_2$ gas is used as the carbon source to form the photoconductive layer and surface layer containing carbon atoms.

Example B1

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter to produce a light-receiving member. Conditions for producing this light-receiving member were as shown in Table B5.

In the present Example, in the first layer region of the photoconductive layer, the Ch, Eg and Eu were 26 atom %, 1.84 eV and 58 meV, respectively, and in the second layer region the Ch, Eg and Eu were 19 atom %, 1.74 eV and 55 meV, respectively.

The content of the Group IIIb element in the photoconductive layer was kept constant at 2.0 ppm in the first layer region. In the second layer region, the content only in the surface-side layer region necessary for absorbing 80% of peak wavelength light of imagewise exposure light was set at 0.4 ppm and in the other region, kept constant at 2.0 ppm.

With regard to the light-receiving members thus produced, evaluation was made in the same manner as in Experiment B1. As a result, good results were obtained on all the chargeability, temperature characteristics of chargeability, photomemory, temperature characteristics of sensitivity and linearity of sensitivity. The light-receiving members produced were positively charged and images were formed to make evaluation. As a result, the photomemory was not observed also on the images, and good electrophotographic performances were obtained also on other image characteristics (dots, smeared images).

More specifically, it was found that good electrophotographic performances were obtained by controlling the Ch, Eg and Eu in the first layer region so as to be from 20 atom % to 30 atom %, from 1.75 eV to 1.85 eV and from 55 meV to 65 meV, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure in the second layer region, so as to be smaller than that in the first layer region.

Example B2

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter to produce a light-receiving member. In the present Example, as the dilute gas used when the charge injection blocking layer and the photoconductive layer were formed, $H_2$ in Example B1 was replaced with He, and as to the surface layer, the silicon atom content and carbon atom content were distributed non-uniformly in the layer thickness direction. Conditions for producing this light-receiving member were as shown in Table B6.

In the present Example, in the first layer region of the photoconductive layer, the Ch, Eg and Eu were 22 atom %, 1.78 eV and 61 meV, respectively, and in the second layer region the Ch, Eg and Eu were 13 atom %, 1.72 eV and 55 meV, respectively.

The content of the Group IIIb element in the photoconductive layer was kept constant at 4.0 ppm in the first layer region. In the second layer region, the content only in the surface-side layer region necessary for absorbing 80% of peak wavelength light of imagewise exposure light was set at 0.1 ppm and in the other region, kept constant at 4.0 ppm.

With regard to the light-receiving members thus produced, evaluation was made in the same manner as in Example B1. As a result, similar good results were obtained. More specifically, it was found that good electrophotographic performances were obtained by controlling the Ch, Eg and Eu in the first layer region so as to be from 20 atom % to 30 atom %, from 1.75 eV to 1.85 eV and from 55 meV to 65 meV, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B3

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter to produce a light-receiving member. In the present Example, the silicon atom content and carbon atom content in the surface layer were distributed non-uniformly in the layer thickness direction, and also fluorine atoms, boron atoms, carbon atoms, oxygen atoms and nitrogen atoms were incorporated in all the layers. Conditions for producing this light-receiving member were as shown in Table B7.

In the present Example, in the first layer region of the photoconductive layer, the Ch, Eg and Eu were 29 atom %, 1.84 eV and 55 meV, respectively, and in the second layer region the Ch, Eg and Eu were 15 atom %, 1.73 eV and 53 meV, respectively.

Figure 5A:
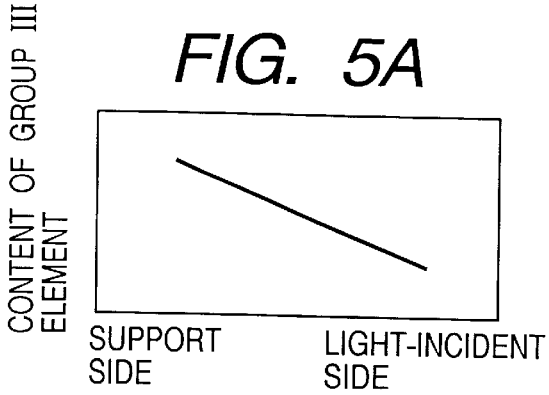
FIGS. 5A, 5B, 5C, 5D, 5E, 5F and 5G diagrammatically illustrates examples of the state of distribution of the periodic table Group IIIb element in the photoconductive layer of the electrophotographic light-receiving member according to the present invention.
Figure 5B:
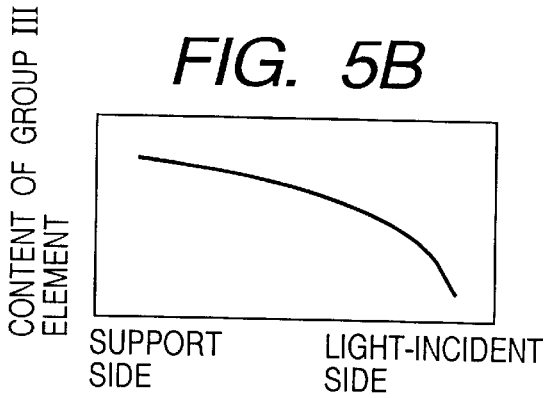
Figure 5C:
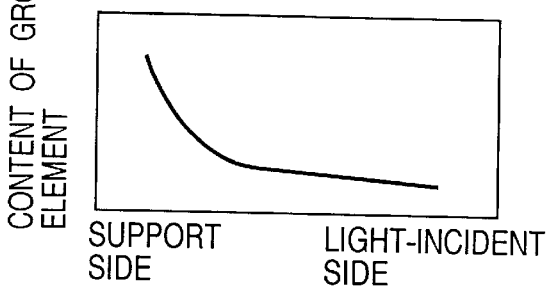
Figure 5D:
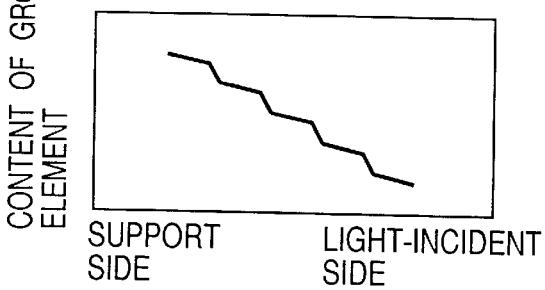

The content of the Group IIIb element in the photoconductive layer was set at 5.0 ppm on the support side of the first layer region and changed therefrom so as to become 0.1 ppm on the outermost surface side of the second layer region at its region necessary for absorbing 70% of peak wavelength light of imagewise exposure light from the outermost surface. This was changed in the form as shown in FIG. 5D, i.e., its content was distributed stepwise equally dividedly in the layer thickness direction.

With regard to the light-receiving members thus produced, evaluation was made in the same manner as in Example B1. As a result, similar good results were obtained. More specifically, it was found that good electrophotographic performances were obtained by changing the content of the Group IIIb element in the photoconductive layer so as to be distributed stepwise equally dividedly in the layer thickness direction as shown in FIG. 5D, controlling the Ch, Eg and Eu in the first layer region so as to be from 20 atom % to 30 atom %, from 1.75 eV to 1.85 eV and from 55 meV to 65 meV, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B4

Using the apparatus shown in FIG. 4, for producing light-receiving members by RF-PCVD, an IR absorption layer, a charge injection blocking layer, a photoconductive layer and a surface layer were formed on a mirror-finished aluminum cylinder (support) of 80 mm diameter to produce a light-receiving member. The IR absorption layer was formed between the support and the charge injection blocking layer, as a light absorption layer for preventing occurrence of interference fringes due to the light reflected from the support. In the surface layer, the silicon atom content and carbon atom content were distributed non-uniformly in the layer thickness direction. Conditions for producing this light-receiving member were as shown in Table B8.

In the present Example, in the first layer region of the photoconductive layer, the Ch, Eg and Eu were 29 atom %, 1.83 eV and 53 meV, respectively, and in the second layer region the Ch, Eg and Eu were 11 atom %, 1.71 eV and 53 meV, respectively.

The content of the Group IIIb element in the photoconductive layer was set at 8.0 ppm on the support side of the first layer region and changed therefrom so as to become 0.1 ppm on the outermost surface side of the second layer region at its region necessary for absorbing 70% of peak wavelength light of imagewise exposure light from the outermost surface. This was changed in the form as shown in FIG. 5A, i.e., changed linearly.

With regard to the light-receiving members thus produced, evaluation was made in the same manner as in Example B1. As a result, similar good results were obtained. More specifically, it was found that good electrophotographic performances were obtained by controlling the content of the Group IIIb element in the photoconductive layer so as to be changed linearly as shown in FIG. 5A, providing the IR absorption layer on the support side, controlling the Ch, Eg and Eu in the first layer region so as to be from 20 atom % to 30 atom %, from 1.75 eV to 1.85 eV and from 55 meV to 65 meV, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B5

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter to produce a light-receiving member. In the present Example, a surface layer was provided in which the silicon atom content and carbon atom content were distributed non-uniformly in the layer thickness direction. Conditions for producing this light-receiving member were as shown in Table B9.

In the present Example, in the first layer region of the photoconductive layer, the Ch, Eg and Eu were 27 atom %, 1.82 eV and 58 meV, respectively, and in the second layer region the Ch, Eg and Eu were 17 atom %, 1.76 eV and 54 meV, respectively.

The content of the Group IIIb element in the photoconductive layer was set at 6.0 ppm on the support side of the first layer region and changed therefrom so as to become 0.5 ppm on the outermost surface side of the second layer region at its region necessary for absorbing 85% of peak wavelength light of imagewise exposure light from the outermost surface. This was changed in the form as shown in FIG. 5C, i.e., changed steeply in the first layer region and thereafter changed gently and smoothly up to the outermost surface.

With regard to the light-receiving members thus produced, evaluation was made in the same manner as in Example B1. As a result, similar good results were obtained. More specifically, it was found that good electrophotographic performances were obtained by controlling the content of the Group IIIb element in the photoconductive layer so as to be changed steeply in the first layer region and thereafter changed gently and smoothly up to the outermost surface as shown in FIG. 5C, controlling the Ch, Eg and Eu in the first layer region so as to be from 20 atom % to 30 atom %, from 1.75 eV to 1.85 eV and from 55 meV to 65 meV, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B6

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter to produce a light-receiving member. Conditions for producing this light-receiving member were as shown in Table B10.

In the present Example, in the first layer region of the photoconductive layer, the Ch, Eg and Eu were 27 atom %, 1.83 eV and 56 meV, respectively, and in the second layer region the Ch, Eg and Eu were 22 atom %, 1.75 eV and 52 meV, respectively.

The content of the Group IIIb element in the photoconductive layer was set at 3.0 ppm on the support side of the first layer region and changed therefrom so as to become 1 ppm in the second layer region and further to become 0.3 ppm on the outermost surface side of the second layer region at its region necessary for absorbing 90% of peak wavelength light of imagewise exposure light from the outermost surface. This was changed in the form as shown in FIG. 5B, i.e., changed gently in the first layer region and thereafter changed steeply and smoothly at the region necessary for absorbing 90% of peak wavelength light of imagewise exposure light and up to the outermost surface.

With regard to the light-receiving members thus produced, evaluation was made in the same manner as in Example B1. As a result, similar good results were obtained. More specifically, it was found that good electrophotographic performances were obtained by controlling the content of the Group IIIb element in the photoconductive layer so as to be changed gently in the first layer region and thereafter changed steeply and smoothly at the region necessary for absorbing 90% of peak wavelength light of imagewise exposure light and up to the outermost surface as shown in FIG. 5B, controlling the Ch, Eg and Eu in the first layer region so as to be from 20 atom % to 30 atom %, from 1.75 eV to 1.85 eV and from 55 meV to 65 meV, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B7

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter to produce a light-receiving member. In the present Example, $H_2$ used in Example B6 was replaced with He, and $SiF_4$ was not used. Also, a surface layer was provided in which, as the atoms constituting the surface layer, nitrogen atoms were incorporated in place of carbon atoms. Conditions for producing this light-receiving member were as shown in Table B11.

In the present Example, in the first layer region of the photoconductive layer, the Ch, Eg and Eu were 23 atom %, 1.81 eV and 60 meV, respectively, and in the second layer region the Ch, Eg and Eu were 20 atom %, 1.77 eV and 53 meV, respectively.

Figure 5E:
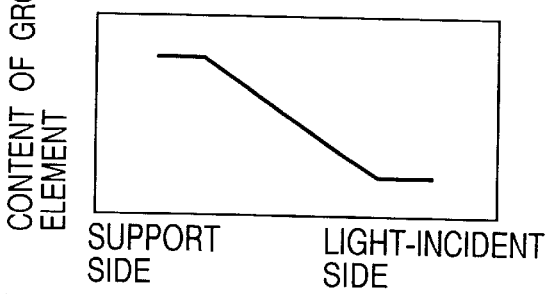

The content of the Group IIIb element in the photoconductive layer was set at 10.0 ppm on the support side of the first layer region and changed therefrom so as to become 1.0 ppm in the second layer region at its region necessary for absorbing 90% of peak wavelength light of imagewise exposure light from the outermost surface. This was changed in the form as shown in FIG. 5E, i.e., the content was partly kept constant on the support side of the first layer region, and thereafter changed linearly and thereafter so as to become constant in the region necessary for absorbing 90% of peak wavelength light of imagewise exposure light.

With regard to the light-receiving members thus produced, evaluation was made in the same manner as in Example B1. As a result, similar good results were obtained. More specifically, it was found that good electrophotographic performances were obtained by controlling the content of the Group IIIb element in the photoconductive layer so as to be partly kept constant on the support side of the first layer region, and thereafter changed linearly and thereafter so as to become constant in the region necessary for absorbing 90% of peak wavelength light of imagewise exposure light as shown in FIG. 5E, using He in place of $H_2$, providing the surface layer in which, as the atoms constituting the surface layer, nitrogen atoms were incorporated in place of carbon atoms, controlling the Ch, Eg and Eu in the first layer region so as to be from 20 atom % to 30 atom %, from 1.75 eV to 1.85 eV and from 55 meV to 65 meV, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B8

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter to produce a light-receiving member. In the present Example, nitrogen atoms and oxygen atoms were incorporated into the surface layer. Conditions for producing this light-receiving member were as shown in Table B12.

In the present Example, in the first layer region of the photoconductive layer, the Ch, Eg and Eu were 24 atom %, 1.83 eV and 60 meV, respectively, and in the second layer region the Ch, Eg and Eu were 17 atom %, 1.74 eV and 52 meV, respectively.

Figure 5F:
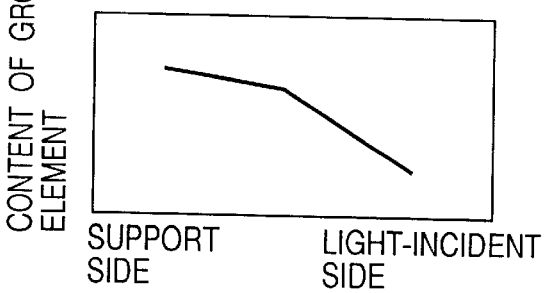

The content of the Group IIIb element in the photoconductive layer was set at 1.5 ppm on the support side of the first layer region and changed therefrom so as to become 0.2 ppm in the second layer region at its region necessary for absorbing 90% of peak wavelength light of imagewise exposure light from the outermost surface. This was changed in the form as shown in FIG. 5F, i.e., changed linearly while being changed in gradation halfway.

With regard to the light-receiving members thus produced, evaluation was made in the same manner as in Example B1. As a result, similar good results were obtained. More specifically, it was found that good electrophotographic performances were obtained by controlling the content of the Group IIIb element in the photoconductive layer so as to be changed linearly while being changed in gradation halfway as shown in FIG. 5F, providing the surface layer incorporated with nitrogen atoms and oxygen atoms, controlling the Ch, Eg and Eu in the first layer region so as to be from 20 atom % to 30 atom %, from 1.75 eV to 1.85 eV and from 55 meV to 65 meV, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B9

Using the apparatus shown in FIG. 4, for producing light-receiving members by RF-PCVD, a charge injection blocking layer, a photoconductive layer, an intermediate layer and a surface layer were formed on a mirror-finished aluminum cylinder (support) of 80 mm diameter to produce a light-receiving member. In the present Example, $H_2$ was replaced with He, and an intermediate layer (an upper blocking layer) incorporated with atoms capable of controlling conductivity, having carbon atoms in a smaller content than the surface layer, was provided between the photoconductive layer and the surface layer. Conditions for producing this light-receiving member were as shown in Table B13.

In the present Example, in the first layer region of the photoconductive layer, the Ch, Eg and Eu were 29 atom %, 1.82 eV and 59 meV, respectively, and in the second layer region the Ch, Eg and Eu were 24 atom %, 1.78 eV and 54 meV, respectively.

Figure 5G:
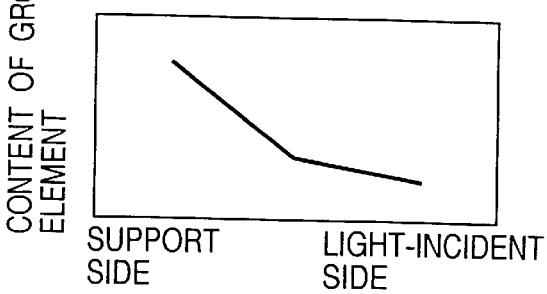
Figure 6:
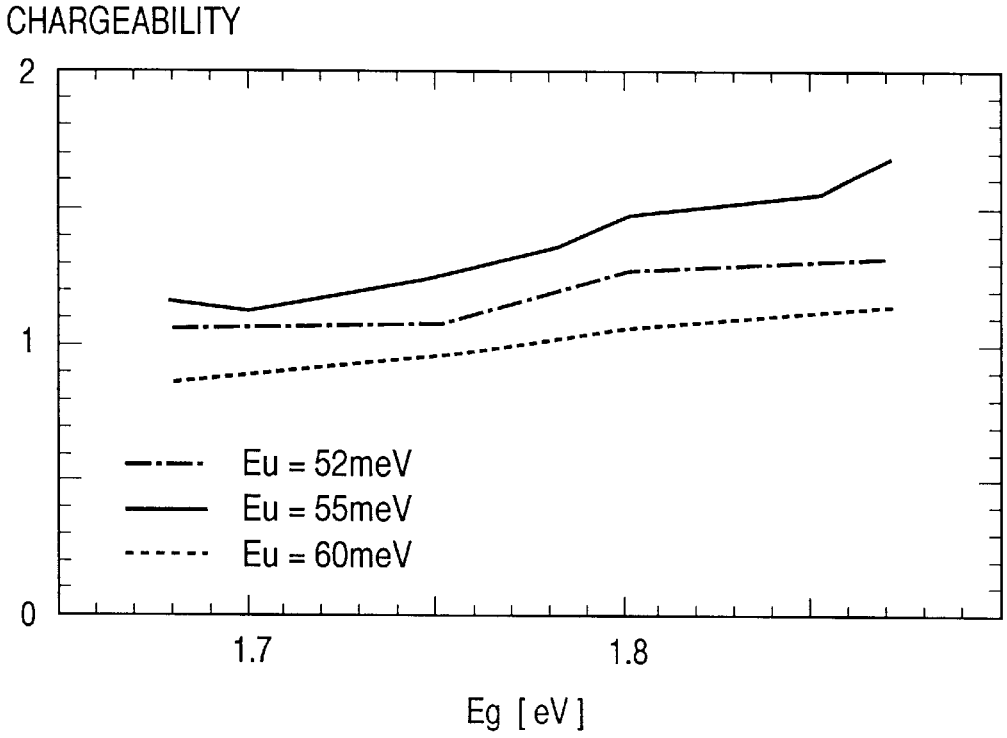
FIG. 6 is a graph showing an example of the relationship between i) the optical band gap (Eg) and characteristic energy at exponential tail (Eu) in the second layer region of the photoconductive layer and ii) the chargeability, in the electrophotographic light-receiving member of the present invention.
Figure 7:
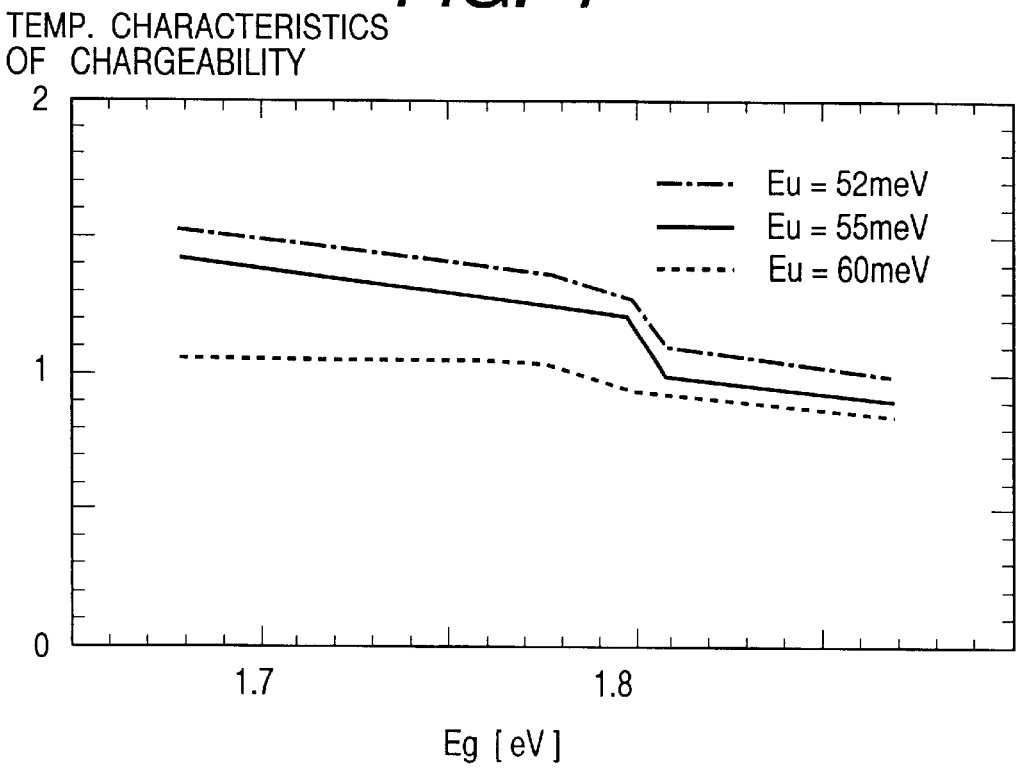
FIG. 7 is a graph showing an example of the relationship between i) the optical band gap (Eg) and characteristic energy at exponential tail (Eu) in the second layer region of the photoconductive layer and ii) the temperature characteristics of chargeability, in the electrophotographic light-receiving member of the present invention.
Figure 8:
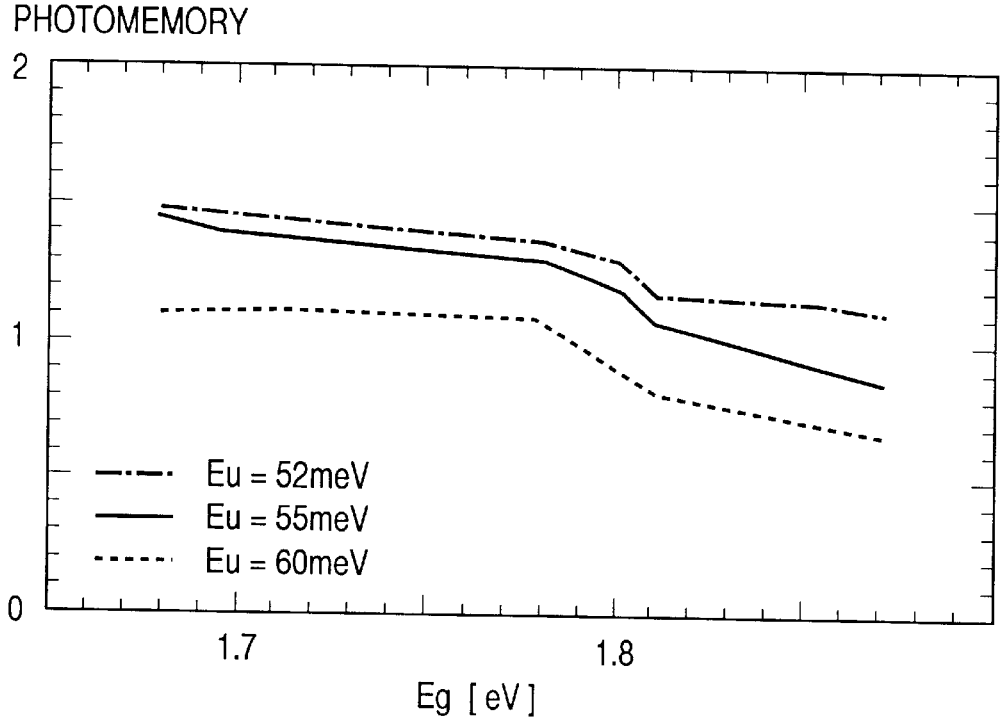
FIG. 8 is a graph showing an example of the relationship between i) the optical band gap (Eg) and characteristic energy at exponential tail (Eu) in the second layer region of the photoconductive layer and ii) the photomemory, in the electrophotographic light-receiving member of the present invention.
Figure 9:
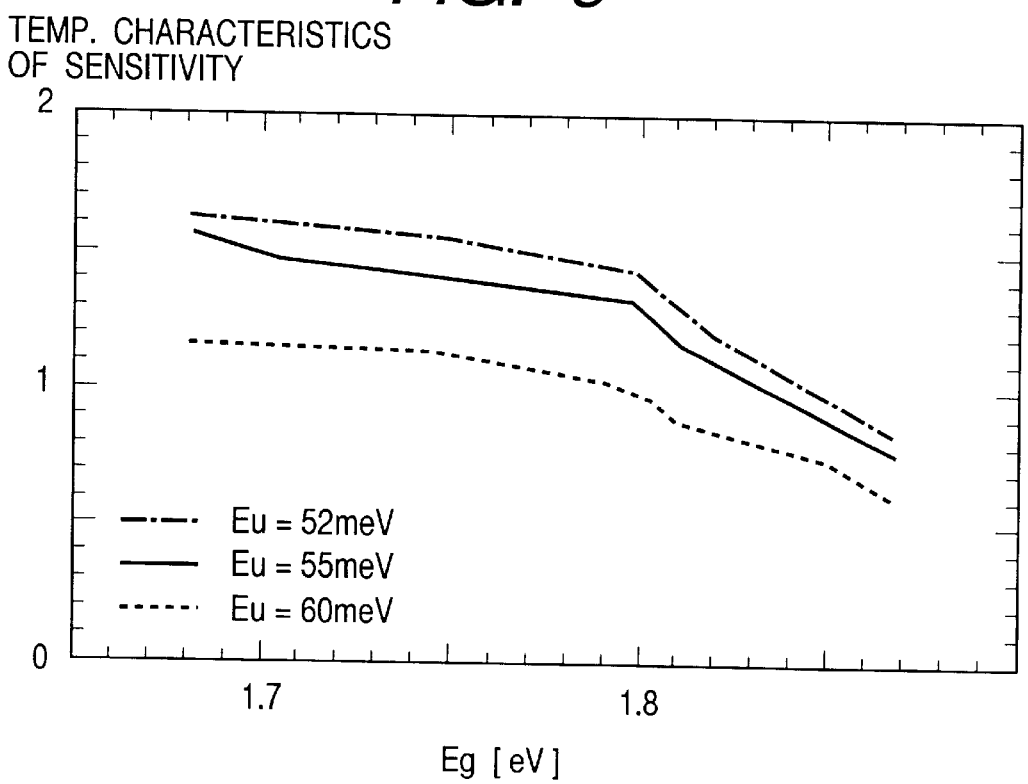
FIG. 9 is a graph showing an example of the relationship between i) the optical band gap (Eg) and characteristic energy at exponential tail (Eu) in the second layer region of the photoconductive layer and ii) the temperature characteristics of sensitivity, in the electrophotographic light-receiving member of the present invention.
Figure 10:
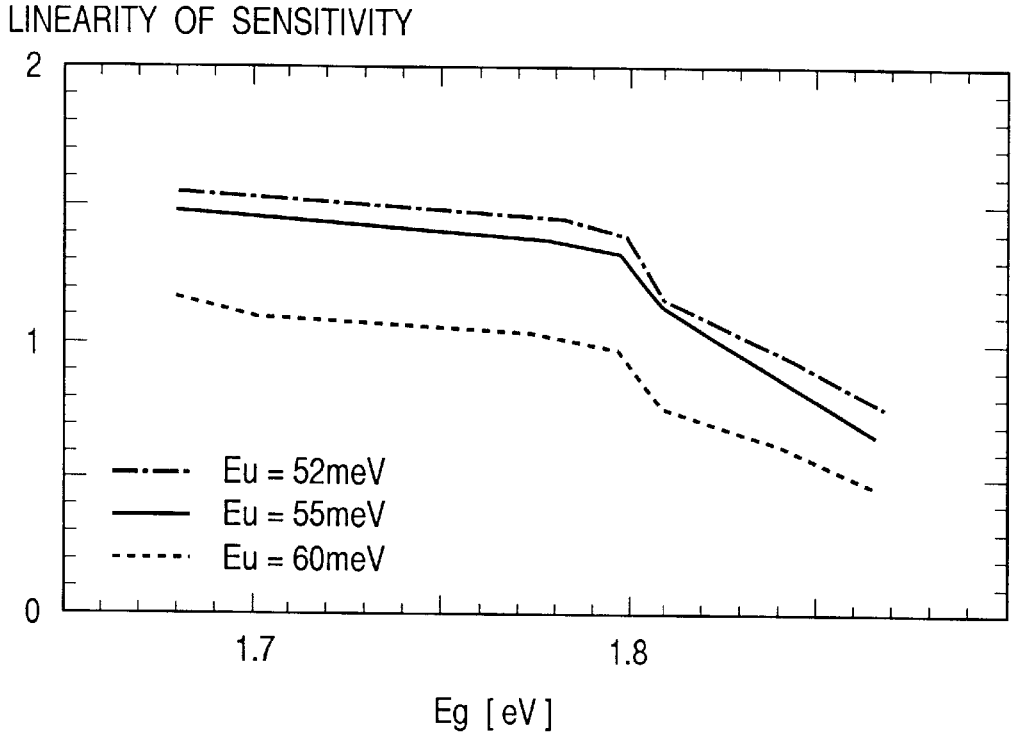
FIG. 10 is a graph showing an example of the relationship between i) the optical band gap (Eg) and characteristic energy at exponential tail (Eu) in the second layer region of the photoconductive layer and ii) the linearity of sensitivity, in the electrophotographic light-receiving member of the present invention.
Figure 11:
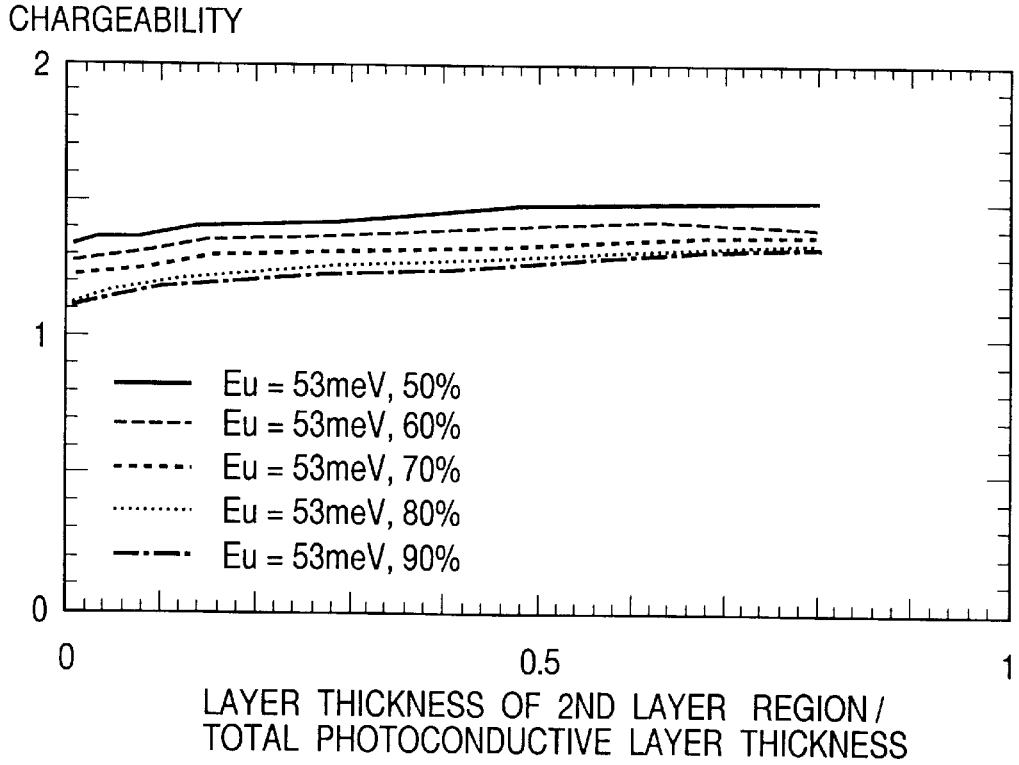
FIG. 11 is a graph showing another example of the relationship between i) the layer thickness of, and the range of controlling the content of periodic table Group IIIb element according to absorptance of light in, the second layer region of the photoconductive layer and ii) the chargeability, in the electrophotographic light-receiving member of the present invention.
Figure 12:
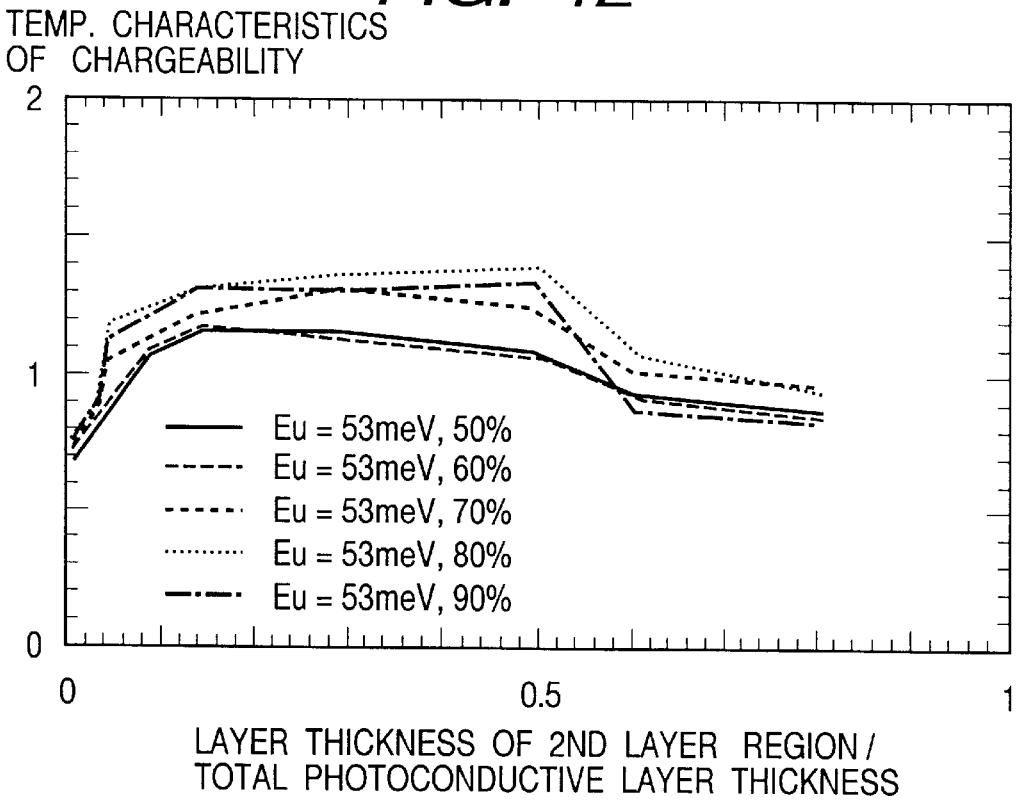
FIG. 12 is a graph showing another example of the relationship between i) the layer thickness of, and the range of controlling the content of periodic table Group IIIb element according to absorptance of light in, the second layer region of the photoconductive layer and ii) the temperature characteristics of chargeability, in the electrophotographic light-receiving member of the present invention.
Figure 13:
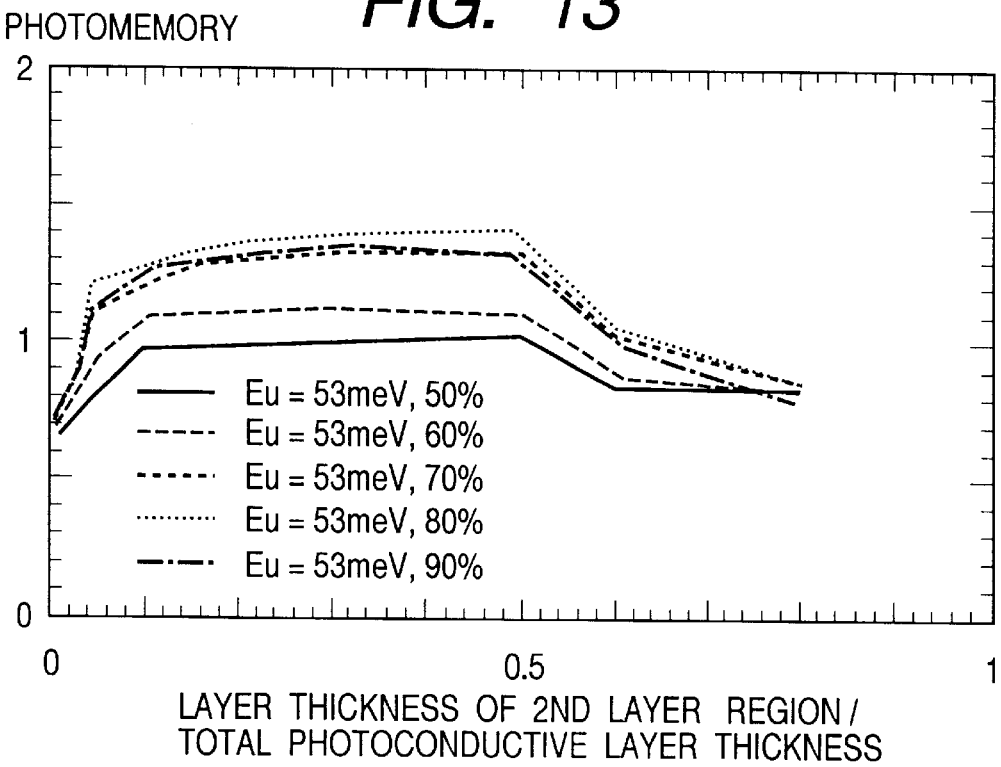
FIG. 13 is a graph showing another example of the relationship between i) the layer thickness of, and the range of controlling the content of periodic table Group IIIb element according to absorptance of light in, the second layer region of the photoconductive layer and ii) the photomemory, in the electrophotographic light-receiving member of the present invention.
Figure 14:
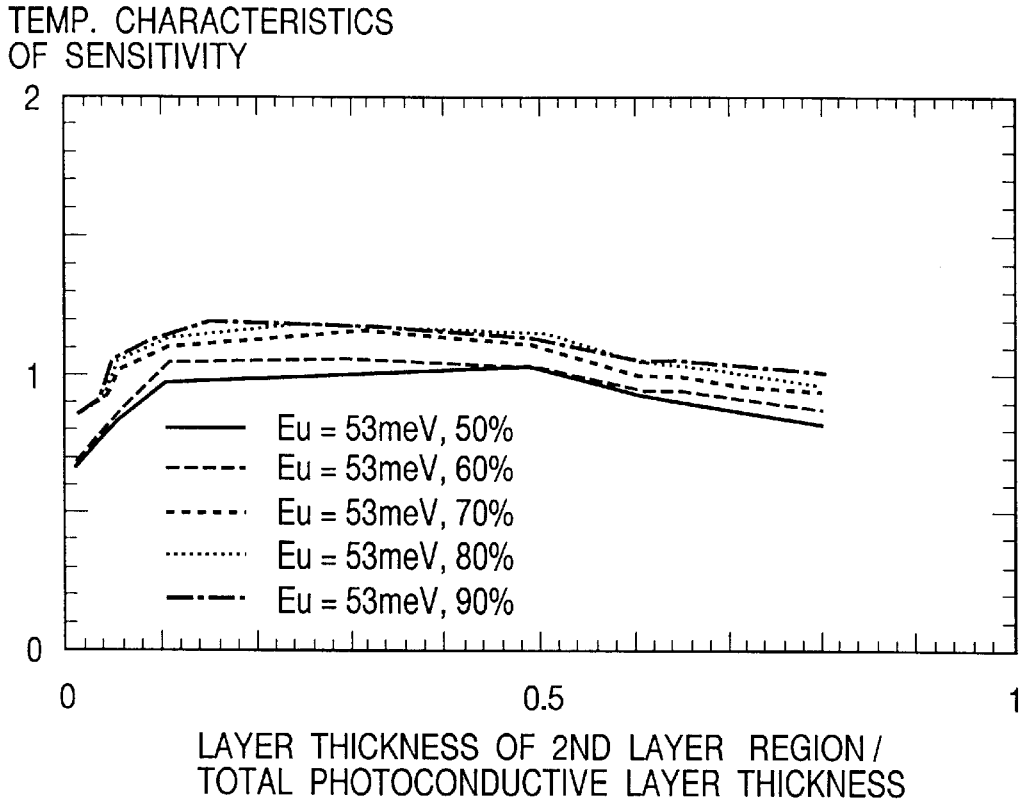
FIG. 14 is a graph showing another example of the relationship between i) the layer thickness of, and the range of controlling the content of periodic table Group IIIb element according to absorptance of light in, the second layer region of the photoconductive layer and ii) the temperature characteristics of sensitivity, in the electrophotographic light-receiving member of the present invention.

The content of the Group IIIb element in the photoconductive layer was set at 8.0 ppm on the support side of the first layer region and changed therefrom so as to become 0.1 ppm in the second layer region at its region necessary for absorbing 90% of peak wavelength light of imagewise exposure light from the outermost surface. This was changed in the form as shown in FIG. 5G, i.e., changed linearly while being changed in gradation halfway.

With regard to the light-receiving members thus produced, evaluation was made in the same manner as in Example B1. As a result, similar good results were obtained. More specifically, it was found that good electrophotographic performances were obtained by controlling the content of the Group IIIb element in the photoconductive layer so as to be changed linearly while being changed in gradation halfway as shown in FIG. 5G, using He in place of $H_2$, providing the intermediate layer (an upper blocking layer) incorporated with atoms capable of controlling conductivity, controlling the Ch, Eg and Eu in the first layer region so as to be from 20 atom % to 30 atom %, from 1.75 eV to 1.85 eV and from 55 meV to 65 meV, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B10

Using the apparatus shown in FIG. 4, for producing light-receiving members by RF-PCVD, a photoconductive layer and a surface layer were formed on a mirror-finished aluminum cylinder (support) of 80 mm diameter to produce a light-receiving member. In the present Example, the charge injection blocking layer was not provided, and $C_2H_2$ gas was used as the carbon source to form a first layer region, a second layer region and a surface layer which contained carbon atoms. Conditions for producing this light-receiving member were as shown in Table B14.

In the present Example, in the first layer region of the photoconductive layer, the Ch, Eg and Eu were 25 atom %, 1.78 eV and 58 meV, respectively, and in the second layer region the Ch, Eg and Eu were 17 atom %, 1.74 eV and 54 meV, respectively.

The content of the Group IIIb element in the photoconductive layer was set at 20 ppm on the support side of the first layer region and changed therefrom so as to become 0.3 ppm in the second layer region at its region necessary for absorbing 85% of peak wavelength light of imagewise exposure light from the outermost surface. This was changed in a linear form so as to give the values shown in Table B14.

With regard to the light-receiving members thus produced, evaluation was made in the same manner as in Example B1. As a result, similar good results were obtained. More specifically, it was found that good electrophotographic performances were obtained by controlling the content of the Group IIIb element in the photoconductive layer so as to be changed linearly in multiple steps, providing no charge injection blocking layer, using $C_2H_2$ gas as the carbon source to form the photoconductive layer and surface layer which contained carbon atoms, controlling the Ch, Eg and Eu in the first layer region so as to be from 20 atom % to 30 atom %, from 1.75 eV to 1.85 eV and from 55 meV to 65 meV, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B11

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter to produce a light-receiving member. Conditions for producing this light-receiving member were as shown in Table B15.

In the present Example, in the first layer region of the photoconductive layer, the Ch, Eg and Eu were 31 atom %, 1.86 eV and 54 meV, respectively, and in the second layer region the Ch, Eg and Eu were 17 atom %, 1.73 eV and 54 meV, respectively.

The content of the Group IIIb element in the photoconductive layer was kept constant at 2.0 ppm on the support side of the first layer region. In the second layer region, the content only in the surface-side layer region necessary for absorbing 80% of peak wavelength light of imagewise exposure light was set at 0.4 ppm and in the other region, kept constant at 2.0 ppm.

With regard to the light-receiving members thus produced, evaluation was made in the same manner as in Experiment B1. As a result, good results were obtained on all the chargeability, temperature characteristics of chargeability, photomemory, temperature characteristics of sensitivity and linearity of sensitivity. The light-receiving members produced were positively charged and images were formed to make evaluation. As a result, the photomemory was not observed also on the images, and good electrophotographic performances were obtained also on other image characteristics (dots, smeared images).

More specifically, it was found that good electrophotographic performances were obtained by controlling the Ch, Eg and Eu in the first layer region so as to be from 25 atom % to 40 atom %, from 1.80 eV to 1.90 eV and 55 meV or below, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure in the second layer region, so as to be smaller than that in the first layer region.

Example B12

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter to produce a light-receiving member. In the present Example, $H_2$ was replaced with He, and the silicon atom content and carbon atom content in the surface layer were distributed non-uniformly in the layer thickness direction. Conditions for producing this light-receiving member were as shown in Table B16.

In the present Example, in the first layer region of the photoconductive layer, the Ch, Eg and Eu were 28 atomo, 1.84 eV and 55 meV, respectively, and in the second layer region the Ch, Eg and Eu were 12 atom %, 1.72 eV and 53 meV, respectively.

The content of the Group IIIb element in the photoconductive layer was kept constant at 6.5 ppm on the support side of the first layer region. In the second layer region, the content only in the surface-side layer region necessary for absorbing 80% of peak wavelength light of imagewise exposure light was set at 0.1 ppm and in the other region, kept constant at 6.5 ppm.

With regard to the light-receiving members thus produced, evaluation was made in the same manner as in Example B1. As a result, similar good results were obtained. More specifically, it was found that good electrophotographic performances were obtained by controlling the Ch, Eg and Eu in the first layer region so as to be from 25 atom % to 40 atom %, from 1.80 eV to 1.90 eV and 55 meV or below, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B13

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter to produce a light-receiving member. In the present Example, the silicon atom content and carbon atom content in the surface layer were distributed non-uniformly in the layer thickness direction, and also fluorine atoms, boron atoms, carbon atoms, oxygen atoms and nitrogen atoms were incorporated in all the layers. Conditions for producing this light-receiving member were as shown in Table B17.

In the present Example, in the first layer region of the photoconductive layer, the Ch, Eg and Eu were 35 atom %, 1.86 eV and 55 meV, respectively, and in the second layer region the Ch, Eg and Eu were 14 atom %, 1.73 eV and 54 meV, respectively.

The content of the Group IIIb element in the photoconductive layer was set at 8.0 ppm on the support side of the first layer region and changed therefrom so as to become 0.2 ppm on the outermost surface side of the second layer region at its region necessary for absorbing 70% of peak wavelength light of imagewise exposure light from the outermost surface. This was changed in the form as shown in FIG. 5D, i.e., its content was distributed stepwise equally dividedly in the layer thickness direction.

With regard to the light-receiving members thus produced, evaluation was made in the same manner as in Example B1. As a result, similar good results were obtained. More specifically, it was found that good electrophotographic performances were obtained by changing the content of the Group IIIb element in the photoconductive layer so as to be distributed stepwise equally dividedly in the layer thickness direction as shown in FIG. 5D, controlling the Ch, Eg and Eu in the first layer region so as to be from 25 atom % to 40 atom %, from 1.80 eV to 1.90 eV and 55 meV or below, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B14

Using the apparatus shown in FIG. 4, for producing light-receiving members by RF-PCVD, an IR absorption layer, a charge injection blocking layer, a photoconductive layer and a surface layer were formed on a mirror-finished aluminum cylinder (support) of 80 mm diameter to produce a light-receiving member. The IR absorption layer was formed between the support and the charge injection blocking layer, as a light absorption layer for preventing occurrence of interference fringes due to the light reflected from the support. In the surface layer, the silicon atom content and carbon atom content were distributed non-uniformly in the layer thickness direction. Conditions for producing this light-receiving member were as shown in Table B18.

In the present Example, in the first layer region of the photoconductive layer, the Ch, Eg and Eu were 29 atom %, 1.83 eV and 53 meV, respectively, and in the second layer region the Ch, Eg and Eu were 11 atom %, 1.71 eV and 53 meV, respectively.

The content of the Group IIIb element in the photoconductive layer was set at 10.0 ppm on the support side of the first layer region and changed therefrom so as to become 0.15 ppm on the outermost surface side of the second layer region at its region necessary for absorbing 70% of peak wavelength light of imagewise exposure light from the outermost surface. This was changed in the form as shown in FIG. 5A, i.e., changed linearly.

With regard to the light-receiving members thus produced, evaluation was made in the same manner as in Example B1. As a result, similar good results were obtained. More specifically, it was found that good electrophotographic performances were obtained by controlling the content of the Group IIIb element in the photoconductive layer so as to be changed linearly as shown in FIG. 5A, providing the IR absorption layer on the support side, controlling the Ch, Eg and Eu in the first layer region so as to be from 25 atom % to 40 atom %, from 1.80 eV to 1.90 eV and 55 meV or below, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B15

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter to produce a light-receiving member. In the present Example, a surface layer was provided in which the silicon atom content and carbon atom content were distributed non-uniformly in the layer thickness direction. Conditions for producing this light-receiving member were as shown in Table B19.

In the present Example, in the first layer region of the photoconductive layer, the Ch, Eg and Eu were 35 atom %, 1.88 eV and 55 meV, respectively, and in the second layer region the Ch, Eg and Eu were 19 atom %, 1.77 eV and 54 meV, respectively.

The content of the Group IIIb element in the photoconductive layer was set at 8.5 ppm on the support side of the first layer region and changed therefrom so as to become 0.5 ppm on the outermost surface side of the second layer region at its region necessary for absorbing 85% of peak wavelength light of imagewise exposure light from the outermost surface. This was changed in the form as shown in FIG. 5C, i.e., changed steeply in the first layer region and thereafter changed gently and smoothly up to the outermost surface.

With regard to the light-receiving members thus produced, evaluation was made in the same manner as in Example B1. As a result, similar good results were obtained. More specifically, it was found that good electrophotographic performances were obtained by controlling the content of the Group IIIb element in the photoconductive layer so as to be changed steeply in the first layer region and thereafter changed gently and smoothly up to the outermost surface as shown in FIG. 5C, controlling the Ch, Eg and Eu in the first layer region so as to be from 25 atom % to 40 atom %, from 1.80 eV to 1.90 eV and 55 meV or below, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B16

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter to produce a light-receiving member. Conditions for producing this light-receiving member were as shown in Table B20.

In the present Example, in the first layer region of the photoconductive layer, the Ch, Eg and Eu were 26 atom %, 1.82 eV and 52 meV, respectively, and in the second layer region the Ch, Eg and Eu were 12 atom %, 1.71 eV and 51 meV, respectively.

The content of the Group IIIb element in the photoconductive layer was set at 4.0 ppm on the support side of the first layer region and changed therefrom so as to become 2.7 ppm in the second layer region and further to become 0.25 ppm on the outermost surface side of the second layer region at its region necessary for absorbing 90% of peak wavelength light of imagewise exposure light from the outermost surface. This was changed in the form as shown in FIG. 5B, i.e., changed gently in the first layer region and thereafter changed steeply and smoothly at the region necessary for absorbing 90% of peak wavelength light of imagewise exposure light and up to the outermost surface.

With regard to the light-receiving members thus produced, evaluation was made in the same manner as in Example B1. As a result, similar good results were obtained. More specifically, it was found that good electrophotographic performances were obtained by controlling the content of the Group IIIb element in the photoconductive layer so as to be changed gently in the first layer region and thereafter changed steeply and smoothly at the region necessary for absorbing 90% of peak wavelength light of imagewise exposure light and up to the outermost surface as shown in FIG. 5B, using RF-PCVD, controlling the Ch, Eg and Eu in the first layer region so as to be from 25 atom % to 40 atom %, from 1.80 eV to 1.90 eV and 55 meV or below, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B17

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter to produce a light-receiving member. In the present Example, $H_2$ used in Example B16 was replaced with He, and $SiF_4$ was not used. Also, a surface layer was provided in which, as the atoms constituting the surface layer, nitrogen atoms were incorporated in place of carbon atoms. Conditions for producing this light-receiving member were as shown in Table B21.

In the present Example, in the first layer region of the photoconductive layer, the Ch, Eg and Eu were 33 atom %, 1.88 eV and 55 meV, respectively, and in the second layer region the Ch, Eg and Eu were 18 atom %, 1.74 eV and 54 meV, respectively.

The content of the Group IIIb element in the photoconductive layer was set at 12.0 ppm on the support side of the first layer region and changed therefrom so as to become 0.5 ppm in the second layer region at its region necessary for absorbing 90% of peak wavelength light of imagewise exposure light from the outermost surface. This was changed in the form as shown in FIG. 5E, i.e., the content was partly kept constant on the support side of the first layer region, and thereafter changed linearly and thereafter so as to become constant in the region necessary for absorbing 90% of peak wavelength light of imagewise exposure light.

With regard to the light-receiving members thus produced, evaluation was made in the same manner as in Example B1. As a result, similar good results were obtained. More specifically, it was found that good electrophotographic performances were obtained by controlling the content of the Group IIIb element in the photoconductive layer so as to be partly kept constant on the support side of the first layer region, and thereafter changed linearly and thereafter so as to become constant in the region necessary for absorbing 90% of peak wavelength light of imagewise exposure light as shown in FIG. 5E, using He in place of $H_2$, providing the surface layer in which, as the atoms constituting the surface layer, nitrogen atoms were incorporated in place of carbon atoms, controlling the Ch, Eg and Eu in the first layer region so as to be from 25 atom % to 40 atom %, from 1.80 eV to 1.90 eV and 55 meV or below, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B18

Using the apparatus shown in FIG. 4, for producing light-receiving members by RF-PCVD, a charge injection blocking layer, a photoconductive layer and a surface layer were formed on a mirror-finished aluminum cylinder (support) of 80 mm diameter to produce a light-receiving member. In the present Example, nitrogen atoms and oxygen atoms were incorporated into the surface layer. Conditions for producing this light-receiving member were as shown in Table B22.

In the present Example, in the first layer region of the photoconductive layer, the Ch, Eg and Eu were 26 atom %, 1.82 eV and 52 meV, respectively, and in the second layer region the Ch, Eg and Eu were 12 atom %, 1.72 eV and 52 meV, respectively.

The content of the Group IIIb element in the photoconductive layer was set at 4.5 ppm on the support side of the first layer region and changed therefrom so as to become 0.1 ppm in the second layer region at its region necessary for absorbing 90% of peak wavelength light of imagewise exposure light from the outermost surface. This was changed in the form as shown in FIG. 5F, i.e., changed linearly while being changed in gradation halfway.

With regard to the light-receiving members thus produced, evaluation was made in the same manner as in Example B1. As a result, similar good results were obtained. More specifically, it was found that good electrophotographic performances were obtained by controlling the content of the Group IIIb element in the photoconductive layer so as to be changed linearly while being changed in gradation halfway as shown in FIG. 5F, providing the surface layer incorporated with nitrogen atoms and oxygen atoms, controlling the Ch, Eg and Eu in the first layer region so as to be from 25 atom % to 40 atom %, from 1.80 eV to 1.90 eV and 55 meV or below, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B19

Using the apparatus shown in FIG. 4, for producing light-receiving members by RF-PCVD, a charge injection blocking layer, a photoconductive layer, an intermediate layer and a surface layer were formed on a mirror-finished aluminum cylinder (support) of 80 mm diameter to produce a light-receiving member. In the present Example, $H_2$ was replaced with He, and the intermediate layer (an upper blocking layer) incorporated with atoms capable of controlling conductivity, having carbon atoms in a smaller content than the surface layer, was provided between the photoconductive layer and the surface layer. Conditions for producing this light-receiving member were as shown in Table B23.

In the present Example, in the first layer region of the photoconductive layer, the Ch, Eg and Eu were 38 atom %, 1.88 eV and 55 meV, respectively, and in the second layer region the Ch, Eg and Eu were 22 atom %, 1.74 eV and 54 meV, respectively.

The content of the Group IIIb element in the photoconductive layer was set at 9.5 ppm on the support side of the first layer region and changed therefrom so as to become 0.15 ppm in the second layer region at its region necessary for absorbing 90% of peak wavelength light of imagewise exposure light from the outermost surface. This was changed in the form as shown in FIG. 5G, i.e., changed linearly while being changed in gradation halfway.

With regard to the light-receiving members thus produced, evaluation was made in the same manner as in Example B1. As a result, similar good results were obtained. More specifically, it was found that good electrophotographic performances were obtained by controlling the content of the Group IIIb element in the photoconductive layer so as to be changed linearly while being changed in gradation halfway as shown in FIG. 5G, using He in place of $H_2$, providing the intermediate layer (an upper blocking layer) incorporated with atoms capable of controlling conductivity, controlling the Ch, Eg and Eu in the first layer region so as to be from 25 atom % to 40 atom %, from 1.80 eV to 1.90 eV and 55 meV or below, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

Example B20

Using the apparatus shown in FIG. 4, for producing light-receiving members by RF-PCVD, a photoconductive layer and a surface layer were formed on a mirror-finished aluminum cylinder (support) of 80 mm diameter to produce a light-receiving member. In the present Example, the charge injection blocking layer was not provided, and $C_2H_2$ gas was used as the carbon source to form a first layer region, a second layer region and a surface layer which contained carbon atoms. Conditions for producing this light-receiving member were as shown in Table B24.

In the present Example, in the first layer region of the photoconductive layer, the Ch, Eg and Eu were 26 atom %, 1.81 eV and 52 meV, respectively, and in the second layer region the Ch, Eg and Eu were 19 atom %, 1.75 eV and 55 meV, respectively.

The content of the Group IIIb element in the photoconductive layer was set at 22 ppm on the support side of the first layer region and changed therefrom so as to become 0.25 ppm in the second layer region at its region necessary for absorbing 85% of peak wavelength light of imagewise exposure light from the outermost surface. This was changed in a linear form so as to give the values shown in Table B24.

With regard to the light-receiving members thus produced, evaluation was made in the same manner as in Example B1. As a result, similar good results were obtained. More specifically, it was found that good electrophotographic performances were obtained by controlling the content of the Group IIIb element in the photoconductive layer so as to be changed linearly in multiple steps, providing no charge injection blocking layer, using $C_2H_2$ gas as the carbon source to form the photoconductive layer and surface layer which contained carbon atoms, controlling the Ch, Eg and Eu in the first layer region so as to be from 25 atom % to 40 atom %, from 1.80 eV to 1.90 eV and 55 meV or below, respectively, controlling the Ch, Eg and Eu in the second layer region so as to be from 10 atom % to 25 atom %, from 1.70 eV to 1.80 eV and 55 meV or below, respectively, and also controlling the content of the Group IIIb element in the surface-side layer region necessary for absorbing 70% or more of peak wavelength light of imagewise exposure light in the second layer region, so as to be smaller than that in the first layer region.

As is clear from the foregoing description, the electrophotographic light-receiving member of the present invention, constituted in the specific manner as described above, makes it possible to solve the various problems caused in the conventional electrophotographic light-receiving members comprised of a-Si and to obtain very good electrical, optical and photoconductive properties, service environmental properties, image characteristics and running performance.

In particular, the electrophotographic light-receiving member of the present invention makes it possible to remarkably improve temperature characteristics of sensitivity, linearity of sensitivity and temperature characteristics of chargeability and to substantially remove residual potential and occurence of photomemory. Thus, stability of the light-receiving member against service environment such as temperature can be improved and high quality image with clear halftone and high resolution can be stably obtained.

In particular, in the case where semiconductor lasers or LEDs are used as an exposure light source, light-receiving members having very good potential characteristics and image characteristics, as having superior temperature characteristics of sensitivity and linearity of sensitivity, having a higher chargeability and restrained from changes in surface potential against variations of surrounding environment (in particular, improved in temperature characteristics of chargeability), can be obtained by controlling the content of hydrogen atoms and/or halogen atoms, the optical band gap, the distribution of characteristic energy obtained from the exponential tail of light absorption spectra and the distribution of the periodic table Group IIIb element as a conductivity-controlling substance while taking account of the role of the region that absorbs a prescribed amount of light and the other region(s).

Incidentally, as to the values of ch, Eg, Eu and the like defined in the present invention, it may be considered that the results obtained by measuring various physical properties of a film formed on the desired substrate are reflected so long as the photoconductive layer of the light-receiving member is formed under the same film forming conditions. Hence, as to the various physical properties and content, those of the light-receiving member may be directly measured and analyzed, and besides those of a single film formed on the desired substrate under the same film forming conditions may be measured and analyzed.

TABLE A1

| Gas species/ Conditions | Charge injection blocking layer | Photoconductive layer First layer region | Photoconductive layer Second layer region | Surface layer |
|---|---|---|---|---|
| $SiH_4$ (SCCM) | 200 | 200 | 200 | 10 |
| $H_2$ (SCCM) | 300 | 1,000 | 1,000 | |
| Group IIIb element, based on Si atoms (ppm) | 2,000 | 2 | 0.2 | — |
| NO (SCCM) | 5 | — | — | — |
| $CH_4$ (SCCM) | — | — | — | 500 |
| Support temp.: (° C.) | 290 | 290 | 290 | 280 |
| Pressure: (Pa) | 67 | 67 | 67 | 67 |
| RF power: (W) | 500 | 800 | 800 | 200 |
| Layer thickness: ($\mu$m) | 3 | * | ** | 0.5 |

* A value given by subtracting the layer thickness of the second layer region from the layer thickness 30 $\mu$m of the photoconductive layer.
** A layer thickness for absorbing 70% of light with 680 nm wavelength.

TABLE A2

| | Light-receiving member a | b | c | d |
|---|---|---|---|---|
| Chargeability: | AA | AA | AA | AA |
| Residual potential: | A | A | A | A |
| Temperature characteristics: | AA | AA | AA | AA |
| Memory potential: | A | A | A | A |
| Temperature characteristics of sensitivity: | AA | AA | AA | AA |
| Linearity of sensitivity: | AA | AA | AA | AA |

TABLE A3

| | Light-receiving member a | b | c | d |
|---|---|---|---|---|
| Chargeability: | AA | AA | AA | AA |
| Residual potential: | AA | AA | AA | AA |
| Temperature characteristics: | AA | AA | AA | AA |
| Memory potential: | AA | AA | AA | AA |
| Temperature characteristics of sensitivity: | AA | AA | AA | AA |
| Linearity of sensitivity: | AA | AA | AA | AA |

TABLE A4

| | Light absorptance of the second layer region (%) 40 | 50 | 80 | 90 | 92 |
|---|---|---|---|---|---|
| Chargeability: | B | AA | AA | AA | AA |
| Residual potential: | A | A | A | A | B |
| Temperature characteristics: | A | AA | AA | AA | AA |
| Memory potential: | A | A | A | A | B |
| Temperature characteristics of sensitivity: | A | AA | AA | AA | A |
| Linearity of sensitivity: | A | AA | AA | AA | A |

TABLE A5

| | Content of Group IIIb element in second layer region, based on silicon atoms (ppm) | | | | | |
|---|---|---|---|---|---|---|
| | 0.01 | 0.03 | 0.10 | 2.0 | 5.0 | 5.5 |
| Chargeability: | AA | AA | AA | AA | A | B |
| Residual potential: | B | A | A | A | A | AA |
| Temperature characteristics: | AA | AA | AA | AA | A | B |
| Memory potential: | C | A | A | A | A | B |
| Temperature characteristics of sensitivity: | B | A | AA | AA | A | B |
| Linearity of sensitivity: | B | A | AA | AA | A | B |

TABLE A6

| | Content of Group IIIb element in first layer region, based on silicon atoms (ppm) | | | | | |
|---|---|---|---|---|---|---|
| | 0.05 | 0.20 | 2.0 | 10 | 25 | 30 |
| Chargeability: | B | A | AA | A | A | B |
| Residual potential: | B | A | AA | AA | AA | AA |
| Temperature characteristics: | B | A | AA | A | A | A |
| Memory potential: | B | A | AA | AA | AA | AA |
| Temperature characteristics of sensitivity: | B | A | AA | A | A | B |
| Linearity of sensitivity: | B | A | AA | A | A | B |

TABLE A7

| | Content ratio of Group IIIb element to silicon atoms | | | | | |
|---|---|---|---|---|---|---|
| | 1.1 | 1.2 | 3.0 | 60 | 200 | 600 |
| Chargeability: | B | A | AA | AA | AA | AA |
| Residual potential: | AA | A | A | A | A | B |
| Temperature characteristics: | B | A | AA | AA | AA | AA |
| Memory potential: | B | A | A | A | A | C |
| Temperature characteristics of sensitivity: | B | A | AA | AA | A | B |
| Linearity of sensitivity: | B | A | AA | AA | A | B |

TABLE A8

| | Charge | Photoconductive layer | | |
|---|---|---|---|---|
| Gas species/ Conditions | injection blocking layer | First layer region | Second layer region | Surface layer |
| $SiH_4$ (SCCM) | 200 | 100 | 100 | 10 |
| $H_2$ (SCCM) | 300 | 800 | 800 | — |
| Group IIIb element, based on Si atoms (ppm) | 2,000 | 2 | 0.2 | — |
| NO (SCCM) | 5 | — | — | — |
| $CH_4$ (SCCM) | — | — | — | 500 |
| Support temp.: (° C.) | 290 | 290 | 290 | 280 |
| Pressure: (Pa) | 67 | 67 | 67 | 67 |

TABLE A8-continued

| | Charge | Photoconductive layer | | |
|---|---|---|---|---|
| Gas species/ Conditions | injection blocking layer | First layer region | Second layer region | Surface layer |
| RF power: (W) | 500 | 100 | 100 | 200 |
| Layer thickness: (μm) | 3 | * | ** | 0.5 |

* A value given by subtracting the layer thickness of the second layer region from the layer thickness 30 μm of the photoconductive layer.
** A layer thickness for absorbing 70% of light with 680 nm wavelength.

TABLE A9

| | Charge | Photoconductive layer | | |
|---|---|---|---|---|
| Gas species/ Conditions | injection blocking layer | First layer region | Second layer region | Surface layer |
| $SiH_4$ (SCCM) | 200 | 75 | 75 | 10 |
| $H_2$ (SCCM) | 300 | 1,000 | 1,000 | — |
| Group IIIb element, based on Si atoms (ppm) | 2,000 | 2 | 0.2 | — |
| NO (SCCM) | 5 | — | — | — |
| $CH_4$ (SCCM) | — | — | — | 500 |
| Support temp.: (° C.) | 290 | 290 | 290 | 280 |
| Pressure: (Pa) | 67 | 67 | 67 | 67 |
| RF power: (W) | 500 | 100 | 100 | 200 |
| Layer thickness: (μm) | 3 | * | ** | 0.5 |

* A value given by subtracting the layer thickness of the second layer region from the layer thickness 30 μm of the photoconductive layer.
** A layer thickness for absorbing 70% of light with 680 nm wavelength.

TABLE A10

| | | Photoconductive Charge | | layer |
|---|---|---|---|---|
| Gas species/ Conditions | injection blocking layer | First layer region | Second layer region | Surface layer |
| $SiH_4$ (SCCM) | 150 | 200 | 200 | 200→20→20 |
| $H_2$ (SCCM) | 300 | 800 | 800 | — |
| Group IIIb element, based on Si atoms (ppm) | 2,000 | 10→3 | 2 | — |
| NO (SCCM) | 5 | — | — | — |
| $CH_4$ (SCCM) | — | — | — | 50→600→600 |
| Support temp.: (° C.) | 280 | 280 | 280 | 280 |
| Pressure: (Pa) | 53 | 67 | 67 | 67 |
| RF power: (W) | 300 | 650 | 650 | 150 |
| Layer thickness: (μm) | 3 | * | ** | 0.5 |

* A value given by subtracting the layer thickness of the second layer region from the layer thickness 30 μm of the photoconductive layer.
** A layer thickness for absorbing 80% of light with 680 nm wavelength.

TABLE A11

| Gas species/ Conditions | Charge injection blocking layer | Photoconductive layer First layer region | Photoconductive layer Second layer region | Surface layer |
|---|---|---|---|---|
| $SiH_4$ (SCCM) | 150 | 150 | 150 | 200→10→10 |
| $SiF_4$ (SCCM) | 5 | 1 | 1 | 5 |
| $H_2$ (SCCM) | 500 | 600 | 600 | — |
| Group IIIb element, based on Si atoms (ppm) | 1,500 | 10 | 2→1 | 1 |
| NO (SCCM) | 10 | 0.1 | 0.1 | 0.5 |
| $CH_4$ (SCCM) | 5 | 0.2 | 0.2 | 50→600→700 |
| Support temp.: (° C.) | 270 | 260 | 260 | 250 |
| Pressure: (Pa) | 40 | 53 | 53 | 53 |
| RF power: (W) | 200 | 600 | 600 | 100 |
| Layer thickness: (μm) | 3 | * | ** | 0.5 |

* A value given by subtracting the layer thickness of the second layer region from the layer thickness 30 μm of the photoconductive layer.
** A layer thickness for absorbing 60% of light with 680 nm wavelength.

TABLE A12

| Gas species/ Conditions | Charge injection blocking layer | Photoconductive layer First layer region | Photoconductive layer Second layer region | Surface layer |
|---|---|---|---|---|
| $SiH_4$ (SCCM) | 300 | 300 | 300 | 20 |
| $H_2$ (SCCM) | 300 | 1,000 | 1,000 | — |
| Group IIIb element, based on Si atoms (ppm) | 3,000 | 10→5 | 3→0.3 | — |
| NO (SCCM) | 5 | — | — | — |
| $NH_3$ (SCCM) | — | — | — | 200 |
| Support temp.: (° C.) | 250 | 250 | 250 | 250 |
| Pressure: (Pa) | 50 | 65 | 65 | 53 |
| RF power: (W) | 300 | 1,000 | 1,000 | 300 |
| Layer thickness: (μm) | 3 | * | ** | 0.3 |

* A value given by subtracting the layer thickness of the second layer region from the layer thickness 30 μm of the photoconductive layer.
** A layer thickness for absorbing 70% of light with 680 nm wavelength.

TABLE A13

| Gas species/ Conditions | Charge injection blocking layer | Photoconductive layer First layer region | Photoconductive layer Second layer region | Surface layer |
|---|---|---|---|---|
| $SiH_4$ (SCCM) | 150 | 150 | 150 | 20 |
| $H_2$ (SCCM) | 400 | 800 | 800 | — |
| Group IIIb element, based on Si atoms (ppm) | 1,500 | 7→1 | 0.5 | — |
| NO (SCCM) | 5 | — | — | 10 |
| $CH_4$ (SCCM) | — | — | — | 500 |
| Support temp.: (° C.) | 290 | 290 | 290 | 290 |

TABLE A13-continued

| Gas species/ Conditions | Charge injection blocking layer | Photoconductive layer First layer region | Photoconductive layer Second layer region | Surface layer |
|---|---|---|---|---|
| Pressure: (Pa) | 55 | 60 | 60 | 50 |
| RF power: (W) | 500 | 600 | 600 | 200 |
| Layer thickness: (μm) | 2 | * | ** | 0.5 |

* A value given by subtracting the layer thickness of the second layer region from the layer thickness 30 μm of the photoconductive layer.
** A layer thickness for absorbing 90% of light with 680 nm wavelength.

TABLE A14

| Gas species/ Conditions | Photoconductive layer First layer region | Photoconductive layer Second layer region | Surface layer |
|---|---|---|---|
| $SiH_4$ (SCCM) | 100 | 100 | 200→50→20 |
| $H_2$ (SCCM) | 500 | 500 | — |
| Group IIIb element, based on Si atoms (ppm) | 5→1 | 0.2 | — |
| $C_2H_2$ (SCCM) | 2 | 2 | 20→200→300 |
| Support temp.: (° C.) | 280 | 280 | 270 |
| Pressure: (Pa) | 65 | 65 | 60 |
| RF power: (W) | 400 | 400 | 300 |
| Layer thickness: (μm) | * | ** | 0.5 |

* A value given by subtracting the layer thickness of the second layer region from the layer thickness 30 μm of the photoconductive layer.
** A layer thickness for absorbing 70% of light with 680 nm wavelength.

TABLE B1

| Gas species/ Conditions | Charge injection blocking layer | Photoconductive layer First layer region | Photoconductive layer Second layer region | Surface layer |
|---|---|---|---|---|
| $SiH_4$ (SCCM) | 200 | 100 | 100 | 10 |
| $H_2$ (SCCM) | 500 | 800 | 600 | — |
| Group IIIb element, based on Si atoms (ppm) | 2,000 | 1 | 0.5 | — |
| NO (SCCM) | 5 | — | — | — |
| $CH_4$ (SCCM) | — | — | — | 500 |
| Support temp.: (° C.) | 280 | 280 | 260 | 260 |
| Pressure: (Pa) | 67 | 70 | 70 | 62 |
| RF power: (W) | 300 | 400 | 100 | 200 |
| Layer thickness: (μm) | 3 | 24 | 6 | 0.5 |

TABLE B2

| Gas species/ Conditions | Charge injection blocking layer | Photoconductive layer First layer region | Photoconductive layer Second layer region | Surface layer |
|---|---|---|---|---|
| $SiH_4$ (SCCM) | 200 | 100 | 100 | 10 |
| $H_2$ (SCCM) | 500 | 800 | 600 | — |
| Group IIIb element, based on Si atoms (ppm) | 2,000 | 1 | 0.5 | — |
| NO (SCCM) | 5 | — | — | — |
| $CH_4$ (SCCM) | — | — | — | 500 |
| Support temp.: (° C.) | 280 | 280 | 260 | 260 |
| Pressure: (Pa) | 65 | 62 | 62 | 58 |
| RF power: (W) | 300 | 200 | 100 | 200 |
| Layer thickness: (μm) | 3 | 24 | 6 | 0.5 |

TABLE B3

| Gas species/ Conditions | Charge injection blocking layer | Photoconductive layer First layer region | Photoconductive layer Second layer region | Surface layer |
|---|---|---|---|---|
| $SiH_4$ (SCCM) | 200 | 100 | 100 | 10 |
| $H_2$ (SCCM) | 500 | 800 | 600 | — |
| Group IIIb element, based on Si atoms (ppm) | 2,000 | 1.0 | * | — |
| NO (SCCM) | 5 | — | — | — |
| $CH_4$ (SCCM) | — | — | — | 500 |
| Support temp.: (° C.) | 280 | 280 | 260 | 260 |
| Pressure: (Pa) | 59 | 70 | 68 | 62 |
| RF power: (W) | 300 | 400 | 100 | 200 |
| Layer thickness: (μm) | 3 | ** | ** | 0.5 |

* 0.3 ppm in each layer region for absorbing 50%, 60%, 70%, 80% or 90% of peak wavelength light, and 1.0 ppm in other region.
** Layer thickness ratio of the first layer region and second layer region to the total layer thickness 30 μm of the photoconductive layer was changed.

TABLE B4

| Gas species/ Conditions | Charge injection blocking layer | Photoconductive layer First layer region | Photoconductive layer Second layer region | Surface layer |
|---|---|---|---|---|
| $SiH_4$ (SCCM) | 200 | 100 | 100 | 10 |
| $H_2$ (SCCM) | 500 | 800 | 600 | — |
| Group IIIb element, based on Si atoms (ppm) | 2,000 | 1.0 | * | — |
| NO (SCCM) | 5 | — | — | — |
| $CH_4$ (SCCM) | — | — | — | 500 |
| Support temp.: (° C.) | 280 | 280 | 260 | 260 |
| Pressure: (Pa) | 55 | 65 | 65 | 58 |

TABLE B4-continued

| Gas species/ Conditions | Charge injection blocking layer | Photoconductive layer First layer region | Photoconductive layer Second layer region | Surface layer |
|---|---|---|---|---|
| RF power: (W) | 300 | 200 | 100 | 200 |
| Layer thickness: (μm) | 3 | ** | ** | 0.5 |

* 0.3 ppm in each layer region for absorbing 50%, 60%, 70%, 80% or 90% of peak wavelength light, and 1.0 in other region.
** Layer thickness ratio of the first layer region second layer region to the total layer thickness 30 μm of the photoconductive layer was changed.

TABLE B5

| Gas species/ Conditions | Charge injection blocking layer | Photoconductive layer First layer region | Photoconductive layer Second layer region | Surface layer |
|---|---|---|---|---|
| $SiH_4$ (SCCM) | 150 | 125 | 100 | 10 |
| $H_2$ (SCCM) | 600 | 1,000 | 700 | — |
| Group IIIb element, based on Si atoms (ppm) | 2,000 | 2.0 | * | — |
| NO (SCCM) | 5 | — | — | — |
| $CH_4$ (SCCM) | — | — | — | 500 |
| Support temp.: (° C.) | 260 | 260 | 260 | 260 |
| Pressure: (Pa) | 55 | 70 | 70 | 40 |
| RF power: (W) | 200 | 500 | 150 | 200 |
| Layer thickness: (μm) | 3 | 20 | 10 | 0.5 |

* 0.4 ppm in the layer region for absorbing 80% of peak wavelength light, and 2.0 ppm in other region.

TABLE B6

| Gas species/ Conditions | Charge injection blocking layer | Photoconductive layer First layer region | Photoconductive layer Second layer region | Surface layer |
|---|---|---|---|---|
| $SiH_4$ (SCCM) | 350 | 100 | 100 | 200→20→20 |
| $H_2$ (SCCM) | 300 | 800 | 600 | — |
| Group IIIb element, based on Si atoms (ppm) | 2,000 | 4.0 | * | — |
| NO (SCCM) | 5 | — | — | — |
| $CH_4$ (SCCM) | — | — | — | 50→600→600 |
| Support temp.: (° C.) | 260 | 260 | 290 | 280 |
| Pressure: (Pa) | 55 | 70 | 70 | 65 |
| RF power: (W) | 300 | 500 | 100 | 150 |
| Layer thickness: (μm) | 3 | 20 | 10 | 0.5 |

* 0.4 ppm in the layer region for absorbing 80% of peak wavelength light, and 4.0 ppm in other region.

TABLE B7

| Gas species/ Conditions | Charge injection blocking layer | Photoconductive layer First layer region | Photoconductive layer Second layer region | Surface layer |
|---|---|---|---|---|
| $SiH_4$ (SCCM) | 300 | 100 | 100 | 200→10→10 |
| $SiF_4$ (SCCM) | 5 | 2 | 1 | 5 |
| $H_2$ (SCCM) | 500 | 1,000 | 1,000 | — |
| Group IIIb element, based on Si atoms (ppm) | 1,500 | 5.0→ | →0.1 | 1 |
| NO (SCCM) | 10 | 0.2 | 0.1 | 0.5 |
| $CH_4$ (SCCM) | 5 | 0.5 | 0.2 | 50→600→700 |
| Support temp.: (° C.) | 270 | 260 | 260 | 250 |
| Pressure: (Pa) | 40 | 55 | 55 | 50 |
| RF power: (W) | 400 | 450 | 120 | 100 |
| Layer thickness: (μm) | 3 | 23 | 7 | 0.5 |

TABLE B8

| Gas species/ Conditions | IR absorption layer | Charge injection blocking layer | Photoconductive layer First layer region | Photoconductive layer Second layer region | Surface layer |
|---|---|---|---|---|---|
| $SiH_4$ (SCCM) | 150 | 150 | 150 | 75 | 150→15→10 |
| $GeH_4$ (SCCM) | 50 | — | — | — | — |
| $H_2$ (SCCM) | 200 | 200 | 800 | 800 | — |
| Group IIIb element, based on Si atoms (ppm) | 3,000 | 2,000 | 8.0→ | →0.1 | — |
| NO (SCCM) | 15→10 | 10→0 | — | — | — |
| $CH_4$ (SCCM) | — | — | — | — | 0→500→600 |
| Support temp.: (° C.) | 270 | 280 | 280 | 260 | 260 |
| Pressure: (Pa) | 60 | 55 | 56 | 56 | 55 |
| RF power: (W) | 300 | 300 | 650 | 180 | 150 |
| Layer thickness: (μm) | 1 | 3 | 22 | 5 | 0.7 |

TABLE B9

| Gas species/ Conditions | Charge injection blocking layer | Photoconductive layer First layer region | Photoconductive layer Second layer region | Surface layer |
|---|---|---|---|---|
| $SiH_4$ (SCCM) | 200 | 200→150 | 150→100 | 200→10 |
| $H_2$ (SCCM) | 600 | 800 | 800→600 | — |
| Group IIIb element, based on Si atoms (ppm) | 1,500 | 6→2 | 2→1→0.5 | — |
| NO (SCCM) | 10 | — | — | 10→600 |
| $CH_4$ (SCCM) | — | — | — | 50→600→700 |
| Support temp.: (° C.) | 300 | 280 | 280 | 270 |
| Pressure: (Pa) | 55 | 65 | 70 | 50 |
| RF power: (W) | 200 | 700 | 600 | 150 |

TABLE B9-continued

| Gas species/ Conditions | Charge injection blocking layer | Photoconductive layer First layer region | Photoconductive layer Second layer region | Surface layer |
|---|---|---|---|---|
| Layer thickness: (μm) | 3 | 20 | 1→8 | 0.5 |

TABLE B10

| Gas species/ Conditions | Charge injection blocking layer | Photoconductive layer First layer region | Photoconductive layer Second layer region | Surface layer |
|---|---|---|---|---|
| $SiH_4$ (SCCM) | 300 | 100 | 300 | 200→12→10 |
| $SiF_4$ (SCCM) | 5 | 3 | 3 | 10 |
| $H_2$ (SCCM) | 400 | 2,000 | 1,500 | — |
| Group IIIb element, based on Si atoms (ppm) | 1,500 | 3.0→1.0 | 1.0→0.3 | — |
| NO (SCCM) | 10 | — | — | — |
| $CH_4$ (SCCM) | — | — | — | 0→500→550 |
| Support temp.: (° C.) | 250 | 250 | 300 | 280 |
| Pressure: (Pa) | 70 | 75 | 75 | 60 |
| RF power: (W) | 500 | 400 | 500 | 300 |
| Layer thickness: (μm) | 3 | 18 | 12 | 0.5 |

TABLE B11

| Gas species/ Conditions | Charge injection blocking layer | Photoconductive layer First layer region | Photoconductive layer Second layer region | Surface layer |
|---|---|---|---|---|
| $SiH_4$ (SCCM) | 300 | 300 | 150 | 20 |
| He (SCCM) | 300 | 1,000 | 2,000 | — |
| Group IIIb element, based on Si atoms (ppm) | 3,000 | 10→ | →1.0 | — |
| NO (SCCM) | 5 | — | — | — |
| $NH_3$ (SCCM) | — | — | — | 200 |
| Support temp.: (° C.) | 290 | 280 | 260 | 250 |
| Pressure: (Pa) | 46 | 40 | 40 | 40 |
| RF power: (W) | 300 | 1,300 | 400 | 300 |
| Layer thickness: (μm) | 3 | 15 | 12 | 0.3 |

TABLE B12

| Gas species/ Conditions | Charge injection blocking layer | Photoconductive layer First layer region | Photoconductive layer Second layer region | Surface layer |
|---|---|---|---|---|
| $SiH_4$ (SCCM) | 300 | 200 | 300 | 20 |
| $H_2$ (SCCM) | 800 | 2,500 | 1,500 | — |

TABLE B12-continued

| Gas species/ Conditions | Charge injection blocking layer | Photoconductive layer First layer region | Photoconductive layer Second layer region | Surface layer |
|---|---|---|---|---|
| Group IIIb element, based on Si atoms (ppm) | 1,500 | 1.5→1 | 1→0.2 | — |
| NO (SCCM) | 5 | — | — | 10 |
| $CH_4$ (SCCM) | — | — | — | 500 |
| Support temp.: (° C.) | 290 | 290 | 290 | 290 |
| Pressure: (Pa) | 38 | 38 | 38 | 38 |
| RF power: (W) | 500 | 800 | 650 | 300 |
| Layer thickness: (μm) | 2 | 15 | 15 | 0.5 |

TABLE B13

| Gas species/ Conditions | Charge injection blocking layer | Photoconductive layer First layer region | Photoconductive layer Second layer region | Intermediate layer | Surface layer |
|---|---|---|---|---|---|
| $SiH_4$ (SCCM) | 150 | 200 | 60 | 100 | 10 |
| He (SCCM) | 300 | 800 | 1,000 | — | — |
| $PH_{3\ (ppm)}$ (based on $SiH_4$ ) | 1,000 | — | — | — | — |
| Group IIIb element, based on Si atoms (ppm) | — | 8.0→ | →0.1 | 500 | — |
| $CH_4$ (SCCM) | 50 | — | — | 300 | 500 |
| Support temp.: (° C.) | 300 | 280 | 260 | 250 | 250 |
| Pressure: (Pa) | 55 | 70 | 70 | 50 | 50 |
| RF power: (W) | 300 | 900 | 200 | 300 | 200 |
| Layer thickness: (μm) | 3 | 20 | 10 | 0.1 | 0.5 |

TABLE B14

| Gas species/ Conditions | Photoconductive layer First layer region | Photoconductive layer Second layer region | Surface layer |
|---|---|---|---|
| $SiH_4$ (SCCM) | 300→150 | 150 | 200→50→20 |
| $H_2$ (SCCM) | 1,500→800 | 800 | — |
| Group IIIb element, based on Si atoms (ppm) | 20→8→3→ | →0.3 | — |
| $C_2H_2$ (SCCM) | 10 | 10 | 10→200→300 |
| Support temp.: (° C.) | 280 | 280 | 280 |
| Pressure: (Pa) | 65 | 60 | 30 |
| RF power: (W) | 1,200→600 | 400 | 300 |
| Layer thickness: (μm) | 8→8→4→ | 10 | 0.5 |

TABLE B15

| Gas species/ Conditions | Charge injection blocking layer | Photoconductive layer First layer region | Photoconductive layer Second layer region | Surface layer |
|---|---|---|---|---|
| $SiH_4$ (SCCM) | 150 | 125 | 100 | 10 |
| $H_2$ (SCCM) | 600 | 1,000 | 650 | — |
| Group IIIb element, based on Si atoms (ppm) | 2,000 | 2.0 | * | — |
| NO (SCCM) | 5 | — | — | — |
| $CH_4$ (SCCM) | — | — | — | 500 |
| Support temp.: (° C.) | 260 | 260 | 260 | 260 |
| Pressure: (Pa) | 55 | 70 | 70 | 40 |
| RF power: (W) | 200 | 250 | 120 | 200 |
| Layer thickness: (μm) | 3 | 20 | 10 | 0.5 |

* 0.4 ppm in the layer region for absorbing 80% of peak wavelength light, and 2.0 ppm in other region.

TABLE B16

| Gas species/ Conditions | Charge injection blocking layer | Photoconductive layer First layer region | Photoconductive layer Second layer region | Surface layer |
|---|---|---|---|---|
| $SiH_4$ (SCCM) | 300 | 100 | 100 | 200→20→20 |
| He (SCCM) | 300 | 1,000 | 800 | — |
| Group IIIb element, based on Si atoms (ppm) | 2,000 | 6.5 | * | — |
| NO (SCCM) | 5 | — | — | — |
| $CH_4$ (SCCM) | — | — | — | 50→600→600 |
| Support temp.: (° C.) | 260 | 260 | 290 | 280 |
| Pressure: (Pa) | 55 | 70 | 70 | 65 |
| RF power: (W) | 300 | 300 | 150 | 150 |
| Layer thickness: (μm) | 3 | 20 | 10 | 0.5 |

* 0.1 ppm in the layer region for absorbing 80% of peak wavelength light, and 6.5 ppm in other region.

TABLE B17

| Gas species/ Conditions | Charge injection blocking layer | Photoconductive layer First layer region | Photoconductive layer Second layer region | Surface layer |
|---|---|---|---|---|
| $SiH_4$ (SCCM) | 300 | 100 | 100 | 200→10→10 |
| $SiF_4$ (SCCM) | 5 | 3 | 1 | 5 |
| $H_2$ (SCCM) | 500 | 1,000 | 1,000 | — |
| Group IIIb element, based on Si atoms (ppm) | 1,500 | 8.0→ | →0.2 | 1 |
| NO (SCCM) | 10 | 0.2 | 0.1 | 0.5 |
| $CH_4$ (SCCM) | 5 | 0.5 | 0.2 | 50→600→700 |
| Support temp.: (° C.) | 270 | 260 | 260 | 250 |
| Pressure: (Pa) | 40 | 55 | 55 | 50 |

TABLE B17-continued

| Gas species/ Conditions | Charge injection blocking layer | Photoconductive layer First layer region | Photoconductive layer Second layer region | Surface layer |
|---|---|---|---|---|
| RF power: (W) | 400 | 350 | 90 | 100 |
| Layer thickness: (μm) | 3 | 23 | 7 | 0.5 |

TABLE B18

| Gas species/ Conditions | IR absorption layer | Charge injection blocking layer | Photoconductive layer First layer region | Photoconductive layer Second layer region | Surface layer |
|---|---|---|---|---|---|
| $SiH_4$ (SCCM) | 350 | 350 | 350 | 300 | 175→15→10 |
| $GeH_4$ (SCCM) | 50 | — | — | — | — |
| $H_2$ (SCCM) | 1,500 | 1,500 | 1,400 | 1,200 | — |
| Group IIIb element, based on Si atoms (ppm) | 3,000 | 2,000 | 10→ | →0.15 | — |
| NO (SCCM) | 15→10 | 10→0 | — | — | — |
| $CH_4$ (SCCM) | — | — | — | — | 0→525→650 |
| Support temp.: (° C.) | 270 | 280 | 280 | 260 | 260 |
| Pressure: (Pa) | 60 | 55 | 56 | 56 | 58 |
| RF power: (W) | 550 | 550 | 650 | 250 | 180 |
| Layer thickness: (μm) | 1 | 3 | 22 | 5 | 0.7 |

TABLE B19

| Gas species/ Conditions | Charge injection blocking layer | Photoconductive layer First layer region | Photoconductive layer Second layer region | Surface layer |
|---|---|---|---|---|
| $SiH_4$ (SCCM) | 300 | 300→150 | 150→100 | 200→10 |
| $H_2$ (SCCM) | 1,000 | 800 | 800→600 | — |
| Group IIIb element, based on Si atoms (ppm) | 1,500 | 8.5→2.8 | 2.8→1→0.5 | |
| NO (SCCM) | 10 | — | — | — |
| $CH_4$ (SCCM) | — | — | — | 10→600 |
| Support temp.: (° C.) | 300 | 280 | 280 | 270 |
| Pressure: (Pa) | 55 | 65 | 70 | 50 |
| RF power: (W) | 200 | 550 | 280 | 150 |
| Layer thickness: (μm) | 3 | 20 | 1→8 | 0.5 |

TABLE B20

| Gas species/ Conditions | Charge injection blocking layer | Photoconductive layer First layer region | Photoconductive layer Second layer region | Surface layer |
|---|---|---|---|---|
| $SiH_4$ (SCCM) | 300 | 120 | 150 | 220→10→8 |
| $SiF_4$ (SCCM) | 5 | 3 | 3 | 10 |
| $H_2$ (SCCM) | 400 | 2,000 | 1,500 | — |
| Group IIIb element, based on Si atoms (ppm) | 1,500 | 4.0→ | 2.7→0.25 | — |
| NO (SCCM) | 10 | — | — | — |
| $CH_4$ (SCCM) | — | — | — | 0→550→600 |
| Support temp.: (° C.) | 250 | 250 | 300 | 280 |
| Pressure: (Pa) | 65 | 70 | 68 | 60 |
| RF power: (W) | 500 | 250 | 200 | 320 |
| Layer thickness: (μm) | 3 | 18 | 12 | 0.5 |

TABLE B21

| Gas species/ Conditions | Charge injection blocking layer | Photoconductive layer First layer region | Photoconductive layer Second layer region | Surface layer |
|---|---|---|---|---|
| $SiH_4$ (SCCM) | 300 | 380 | 150 | 20 |
| He (SCCM) | 500 | 1,700 | 2,000 | — |
| Group IIIb element, based on Si atoms (ppm) | 3,000 | 12→ | →0.5 | — |
| NO (SCCM) | 5 | — | — | — |
| $NH_3$ (SCCM) | — | — | — | 200 |
| Support temp.: (° C.) | 290 | 280 | 260 | 250 |
| Pressure: (Pa) | 55 | 50 | 50 | 48 |
| RF power: (W) | 300 | 800 | 200 | 300 |
| Layer thickness: (μm) | 3 | 15 | 12 | 0.3 |

TABLE B22

| Gas species/ Conditions | Charge injection blocking layer | Photoconductive layer First layer region | Photoconductive layer Second layer region | Surface layer |
|---|---|---|---|---|
| $SiH_4$ (SCCM) | 300 | 250 | 300 | 25 |
| $H_2$ (SCCM) | 800 | 2,200 | 1,800 | — |
| Group IIIb element, based on Si atoms (ppm) | 1,500 | 4.5→2 | 2→0.1 | — |
| NO (SCCM) | 5 | — | — | 7 |
| $CH_4$ (SCCM) | — | — | — | 600 |
| Support temp.: (° C.) | 290 | 290 | 290 | 290 |
| Pressure: (Pa) | 40 | 45 | 45 | 40 |
| RF power: (W) | 500 | 500 | 350 | 300 |
| Layer thickness: (μm) | 2 | 15 | 15 | 0.5 |

TABLE B23

| Gas species/ Conditions | Charge injection blocking layer | Photoconductive layer First layer region | Photoconductive layer Second layer region | Intermediate layer | Surface layer |
|---|---|---|---|---|---|
| $SiH_4$ (SCCM) | 150 | 250 | 100 | 100 | 10 |
| He (SCCM) | 300 | 800 | 1,000 | — | — |
| $PH_3$ (ppm) (based on $SiH_4$) | 1,000 | — | — | — | — |
| Group IIIb element, based on Si atoms (ppm) | — | 9.5→ | →0.15 | 500 | — |
| $CH_4$ (SCCM) | 50 | — | — | 300 | 500 |
| Support temp.: (° C.) | 300 | 280 | 260 | 250 | 250 |
| Pressure: (Pa) | 35 | 50 | 48 | 45 | 45 |
| RF power: (W) | 300 | 600 | 150 | 300 | 200 |
| Layer thickness: (μm) | 3 | 20 | 10 | 0.1 | 0.5 |

TABLE B24

| Gas species/ Conditions | Photoconductive layer First layer region | Photoconductive layer Second layer region | Surface layer |
|---|---|---|---|
| $SiH_4$ (SCCM) | 300→125 | 125 | 200→50→20 |
| $H_2$ (SCCM) | 1,800→1,000 | 1,000 | — |
| Group IIIb element, based on Si atoms (ppm) | 22→7→2→ | →0.25 | — |
| $C_2H_2$ (SCCM) | 10 | 10 | 10→200→300 |
| Support temp.: (° C.) | 280 | 280 | 280 |
| Pressure: (Pa) | 45 | 60 | 20 |
| RF power: (W) | 700→350 | 200 | 300 |
| Layer thickness: (μm) | 8→8→4→ | 10 | 0.5 |

What is claimed is:

1. An electrophotographic light-receiving member comprising a conductive support and provided thereon a photoconductive layer comprising a first layer region and a second layer region, said photoconductive layer formed of a non-single-crystal material mainly composed of silicon atom and containing at least one of hydrogen atom and halogen atom and at least one element belonging to Group IIIb of the periodic table; wherein the photoconductive layer has on the surface side thereof the second layer region and on the support side thereof the first layer region; the second layer region has a thickness sufficient to absorb from 50% to 90% of light from a semiconductor laser or light-emitting diode having a long wavelength incident thereon during image-wise exposure of said electrophotographic light-receiving member and wherein the first layer region has an element belonging to Group IIIb element in a fixed content or in a decreasing concentration from the support side to the surface layer side, the second layer region has an element belonging to Group IIIb of the periodic table in a smaller content than the first layer region, the Group IIIb element in the second layer region is in a decreasing concentration from the support side to the surface layer side, and the photoconductive layer is selected from the following (a), (b) or (c):

(a) the photoconductive layer has a hydrogen and/or halogen atom content from 10 to 30 atom %, an optical band gap (Eg) from 1.75 to 1.85 eV, and a characteristic energy (Eu) obtained from the exponential tail of light absorption spectra, from 55 to 65 meV, (b) the photoconductive layer has a hydrogen and/or halogen atom content from 10 to 20 atom %, an optical band gap (Eg) of 1.75 eV or less, and a characteristic energy (Eu) obtained from the exponential tail of light absorption spectra, of 55 meV or less, or (c) the photoconductive layer has a hydrogen and/or halogen atom content from 25 to 35 atom %, an optical band gap (Eg) of 1.80 eV or more, and a characteristic energy (Eu) obtained from the exponential tail of light absorption spectra, of 55 meV or less.

2. The electrophotographic light-receiving member according to claim 1, wherein the ratio of the content of the element belonging to Group IIIb of the periodic table in the first layer region to the content of the element belonging to Group IIIb of the periodic table in the second layer region is from 1.2 to 200.

3. The electrophotographic light-receiving member according to claim 1, wherein the element belonging to Group IIIb of the periodic table is contained in the second layer region in an amount of from 0.03 ppm to 5 ppm based on silicon atoms.

4. The electrophotographic light-receiving member according to claim 1, wherein the element belonging to Group IIIb of the periodic table is contained in the first layer region in an amount of from 0.2 ppm to 25 ppm based on silicon atoms.

5. The electrophotographic light-receiving member according to claim 1, wherein at least one element of carbon, oxygen and nitrogen is contained in the photoconductive layer.

6. The electrophotographic light-receiving member according to claim 1, wherein the photoconductive layer has a thickness of from 20 μm to 50 μm.

7. The electrophotographic light-receiving member according to claim 1, which further comprises a surface layer formed of a non-single-crystal material mainly composed of silicon atom and containing at least one element of carbon, oxygen and nitrogen.

8. The electrophotographic light-receiving member according to claim 7, wherein the surface layer has a thickness of from 0.01 μm to 3 μm.

9. The electrophotographic light-receiving member according to claim 1, which further comprises a charge injection blocking layer formed of a non-single-crystal material mainly composed of silicon atom and containing at least one of hydrogen atom and halogen atom, at least one element of carbon, oxygen and nitrogen and at least one of an element belonging to Group IIIb and an element belonging to Group Vb of the periodic table; the photoconductive layer being provided on the charge injection blocking layer.

10. The electrophotographic light-receiving member according to claim 9, wherein the charge injection blocking layer has a thickness of from 0.1 μm to 5 μm.

* * * * *

UNITED STATES PATENT AND TRADEMARK OFFICE

CERTIFICATE OF CORRECTION

PATENT NO. : 6,379,852 B2
DATED : April 30, 2002
INVENTOR(S) : Shinji Tsuchida et al.

Figure 15:
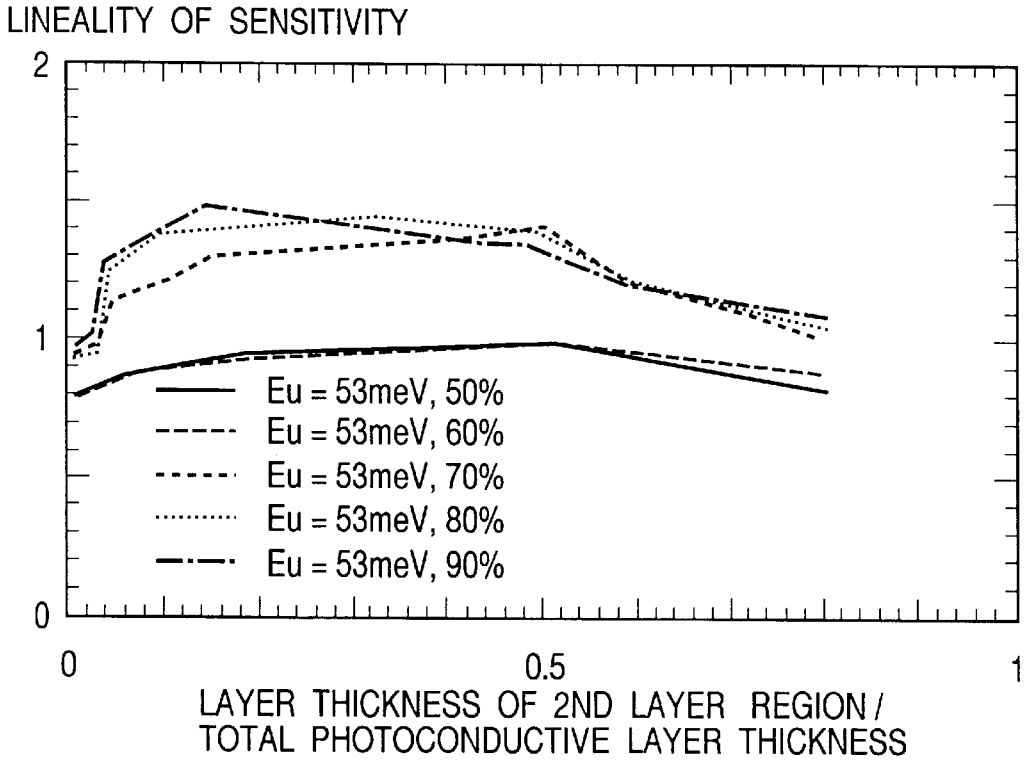
FIG. 15 is a graph showing another example of the relationship between i) the layer thickness of, and the range of controlling the content of periodic table Group IIIb element according to absorptance of light in, the second layer region of the photoconductive layer and ii) the linearity of sensitivity, in the electrophotographic light-receiving member of the present invention.

It is certified that error appears in the above-identified patent and that said Letters Patent is hereby corrected as shown below:

Drawings,
Fig. 15, “LINEALITY” should read -- LINEARITY --.

Column 3,
Line 44, “use” should read -- use, --.

Column 4,
Line 5, “been not” should read -- not been --; and
Line 29, “more” should read -- greater --.

Column 6,
Line 45, “illustrates” should read -- illustrate --.

Column 7,
Line 52, “took” should read -- taken --.

Column 8,
Line 32, “coefficient a” should read -- coefficient α --; and
Line 47, “In $\alpha=(1/Eu)\cdot h\nu=\alpha_1$” should read -- In $\alpha=(1/Eu)\cdot h\nu+\alpha_1$ --.

Column 11,
Line 55, “the the” should read -- the --; and
Line 56, “to to” should read -- to --.

Column 14,
Line 42, “hydrogen-atoms” should read -- hydrogen atoms --.

Column 15,
Line 2, “carries” should read -- carriers --; and
Line 44, “ppm in.” should read -- ppm. --.

Column 16,
Line 19, “and and” should read -- and --.

Column 20,
Line 42, “SiF4” should read -- $SiF_4$ --.

UNITED STATES PATENT AND TRADEMARK OFFICE

CERTIFICATE OF CORRECTION

PATENT NO. : 6,379,852 B2
DATED : April 30, 2002
INVENTOR(S) : Shinji Tsuchida et al.

It is certified that error appears in the above-identified patent and that said Letters Patent is hereby corrected as shown below:

Column 21,
Line 10, “ppm” should read -- ppm, --;
Line 27, “$B_5H9$,” should read -- $B_5H_9$, --; and
Line 33, “$P2H_4$” should read -- $P_2H_4$ --.

Column 23,
Line 23, “ppm” should read -- ppm, --; and
Line 24, “ppm” (both occurrences) should read -- ppm, --.

Column 24,
Line 58, “more improve” should read -- improving --.

Column 25,
Line 20, “$PH_{31}$” should read -- $PH_3$, --.

Column 27,
Line 3, “1 μm m” should read -- 1 μm --.

Column 29,
Line 15, “0.01 ppm 0.03 ppm” should read -- 0.01 ppm, 0.03 ppm, --;
Line 16, “0.01 ppm 2 ppm” should read -- 0.01 ppm, 2 ppm, --;
Line 57, “0.15 ppm” should read -- 0.15 ppm, --;
Line 58, “ppm 2 ppm 10 ppm” should read -- ppm, 2 ppm, 10 ppm, --; and
Line 66, “sail” should be deleted.

Column 32,
Line 64, “0.01 ppm 0.03 ppm” should read -- 0.01 ppm, 0.03 ppm, --; and
Line 65, “ppm 2 ppm” should read -- ppm, 2 ppm, --.

Column 33,
Line 25, “0.15 ppm” should read -- 0.15 ppm, --; and
Line 26, “ppm 2 ppm 10 ppm” should read -- ppm, 2 ppm, 10 ppm, --.

Column 36,
Line 7, “0.01 ppm 0.03 ppm” should read -- 0.01 ppm, 0.03 ppm, --;
Line 8, “ppm 2 ppm” should read -- ppm, 2 ppm, --;
Line 35, “0.15 ppm” should read -- 0.15 ppm, --; and
Line 36, “ppm 2 ppm 10 ppm” should read -- ppm, 2 ppm, 10 ppm, --.

UNITED STATES PATENT AND TRADEMARK OFFICE

CERTIFICATE OF CORRECTION

PATENT NO. : 6,379,852 B2
DATED : April 30, 2002
INVENTOR(S) : Shinji Tsuchida et al.

It is certified that error appears in the above-identified patent and that said Letters Patent is hereby corrected as shown below:

Column 41,
Line 38, “1.0 ppm” should read -- 1.0 ppm, --.

Column 45,
Line 56, “0.4 ppm” should read -- 0.4 ppm, --.

Column 46,
Line 37, “0.1 ppm” should read -- 0.1 ppm, --.

Column 52,
Line 45, “0.4 ppm “ should read -- 0.4 ppm, --.

Column 53,
Line 17, “28 atomo,” should read -- 28 atom%, --; and
Line 27, “0.1 ppm” should read -- 0.1 ppm, --.

Column 59,
Line 35, “occurence” should read -- occurrence --; and
Line 57, “ch,” should read -- Ch, --.

Column 62,
Table A10, “Photoconductive
Charge layer” should read

-- Photoconductive
Charge layer --.

UNITED STATES PATENT AND TRADEMARK OFFICE

CERTIFICATE OF CORRECTION

PATENT NO. : 6,379,852 B2
DATED : April 30, 2002
INVENTOR(S) : Shinji Tsuchida et al.

It is certified that error appears in the above-identified patent and that said Letters Patent is hereby corrected as shown below:

Column 66,
Line 18, "region second" should read -- region and second --.

Signed and Sealed this

Twentieth Day of August, 2002

*Attest:*

*Attesting Officer*

JAMES E. ROGAN
*Director of the United States Patent and Trademark Office*